US008821649B2

(12) United States Patent
Kanda et al.

(10) Patent No.: US 8,821,649 B2
(45) Date of Patent: Sep. 2, 2014

(54) MAGNETIC MATERIAL AND MOTOR USING THE SAME

(75) Inventors: Takayuki Kanda, Hitachi (JP); Matahiro Komuro, Hitachi (JP); Hiroyuki Suzuki, Hitachi (JP); Yuichi Satsu, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 657 days.

(21) Appl. No.: 13/029,348

(22) Filed: Feb. 17, 2011

(65) Prior Publication Data

US 2011/0240909 A1 Oct. 6, 2011

(30) Foreign Application Priority Data

Mar. 30, 2010 (JP) ..... 2010-079790

(51) Int. Cl.
*H01F 1/00* (2006.01)
*H01F 1/058* (2006.01)

(52) U.S. Cl.
CPC ..... *H01F 1/058* (2013.01)
USPC ..... 148/100; 148/101; 148/300; 420/83

(58) Field of Classification Search
CPC ..... H01F 1/00
USPC ..... 148/100–101, 300–302; 420/83
See application file for complete search history.

(56) References Cited

U.S. PATENT DOCUMENTS

| | | | | |
|---|---|---|---|---|
| 6,419,759 | B1 * | 7/2002 | Yang et al. | 148/302 |
| 7,806,991 | B2 | 10/2010 | Komuro et al. | |
| 2005/0081959 | A1 | 4/2005 | Kim et al. | |
| 2010/0007232 | A1 * | 1/2010 | Komuro et al. | 310/156.01 |

FOREIGN PATENT DOCUMENTS

| | | |
|---|---|---|
| BR | PI 9701631-4 A | 7/1998 |
| JP | 2001-93713 | 4/2001 |
| JP | 2003-282312 | 10/2003 |
| JP | 2006-303433 | 11/2006 |
| JP | 2006-303434 | 11/2006 |
| JP | 2006-303435 | 11/2006 |
| JP | 2006-303436 | 11/2006 |
| JP | 2007-194599 | 8/2007 |

OTHER PUBLICATIONS

NPL-1: Ardisson et al, Magnetic improvement of R2Fe17 compounds due to the addition of fluorine, Journal of Materials Science letters 16 (1997) pp. 1658-1661.*

* cited by examiner

*Primary Examiner* — Jie Yang
(74) *Attorney, Agent, or Firm* — Antonelli, Terry, Stout & Kraus, LLP.

(57) ABSTRACT

Characteristics of a magnetic material are improved without using a heavy rare earth element as a scarce resource. By incorporating fluorine into a magnetic powder and controlling the crystal orientation in crystal grains, a magnetic material securing magnetic characteristics such as coercive force and residual flux density can be fabricated. As a result, the resource problem with heavy rare earth elements can be solved, and the magnetic material can be applied to magnetic circuits that require a high energy product, including various rotating machines and voice coil motors of hard discs.

9 Claims, 2 Drawing Sheets

MAGNETIC MATERIAL AND MOTOR USING THE SAME

BACKGROUND OF THE INVENTION

1. Field of the Invention

The present invention relates to a magnetic material using no heavy rare earth elements, and a motor using the magnetic material.

2. Background Art

Patent Documents 1 to 5 disclose conventional rare earth-sintered magnets containing a fluoride or an oxy-fluoride. Patent Document 6 discloses mixing a rare earth fluoride fine powder (1 to 20 μm) and a NdFeB powder. A Brazilian Patent of Patent Document 7 describes an example of $Sm_2Fe_{17}$ being fluorinated.

Patent Document 1: JP Patent Publication (Kokai) No. 2003-282312A

Patent Document 2: JP Patent Publication (Kokai) No. 2006-303436A

Patent Document 3: JP Patent Publication (Kokai) No. 2006-303435A

Patent Document 4: JP Patent Publication (Kokai) No. 2006-303434A

Patent Document 5: JP Patent Publication (Kokai) No. 2006-303433A

Patent Document 6: U.S. Patent No. 2005/0081959

Patent Document 7: Brazilian Patent No. 9701631-4A

Conventional inventions described above are substances obtained by reacting a Nd—Fe—B based magnetic material or a Sm—Fe based material with a compound containing fluorine, and particularly disclose a lattice dilation and an effect on raising the curie point presumed to be due to the incorporation of fluorine atoms by the reaction of $Sm_2Fe_{17}$ with fluorine.

However, the disclosed SmFeF-based material has a low curie point of 155° C. and an unknown magnetization value, and no analysis revealing that fluorine is present in its main phase is disclosed. Even if fluorine is detected by an analysis of a whole sample having been subjected to a fluorination treatment in the analysis of fluorine after the fluorination treatment, the presence of fluorine in the main phase has not been verified. This is because various types of fluorides are formed on the surface of the treated material after the fluorination treatment, and the fluorine concentration detected by means that detects fluorine together with fluorine in the fluorides on the surface does not indicate that the main phase (a ferromagnetic having a main structure constituting crystal grains and powder) contains fluorine. Even if a main phase contains fluorine, since the fluorination treatment progresses from the surface of the main phase, a phase having a high fluorine concentration in the vicinity of the surface and a phase having a low fluorine concentration in the vicinity of the center are formed, and the difference in the crystal orientation between these phases different in the fluorine concentration causes various types of defects and a decrease in the coercive force. Therefore, no practical permanent magnetic material cannot be provided unless the crystal orientation difference is controlled.

On the other hand, in the Nd—Fe—B based magnet, the coercive force is increased by use of a fluoride containing a heavy rare earth element. The fluoride is not produced by the reaction of fluorinating the main phase, but the heavy rare earth element reacts with or diffuses into the main phase. Since such a heavy rare earth element is expensive and rare, the decrease in heavy rare earth elements poses a problem from the viewpoint of the environmental protection. Light rare earth elements, which are less expensive than heavy rare earth elements, are Sc, Y and elements of atomic number 57 to 62, and some of the elements is used for magnetic materials. A material most mass-produced among iron-based magnets other than oxides is a $Nd_2Fe_{14}B$-based magnet, but in order to secure the heat resistance, the addition of a heavy rare earth element such as Tb or Dy is essential. Since a $Sm_2Fe_{17}N$-based magnet cannot be sintered and generally used as bond magnets, it has a drawback in the performance. An $R_2Fe_{17}$ (R is a rare earth element) based alloy has a low curie point (Tc), but since a compound into which carbon or nitrogen has intruded has a high curie point and high magnetization, the alloy is applied to various types of magnetic circuits.

In order to mass-produce materials into which fluorine atoms have intruded as magnets of such interstitial compounds, magnetic characteristics such as the coercive force and the residual flux density need to be secured by controlling the crystal orientation in magnetic powders or crystal grains of fluorides having the rhombohedral, tetragonal or monoclinic crystal structure in their parent phase, for example, fluorides of a $Th_2Zn_{17}$-type $Sm_2Fe_{17}F_3$ alloy, a $ThMn_{12}$-type $NdFe_{11}TiF_x$ alloy, an $R_3(Fe, Ti)_{29}$-type $Sm_3(Fe, Ti)_{29}F_5$ alloy, and a $Sm_3(Fe, Cr)_{29}F_x$ alloy.

The present invention has been achieved in consideration of the above-mentioned viewpoints, and has an object to provide a magnetic material improved in characteristics in the magnetic material using no heavy rare earth element as a scarce resource, and a motor using the magnetic material.

SUMMARY OF THE INVENTION

The magnetic material according to the present invention to solve the above-mentioned problem is a magnetic material wherein the material has a main phase containing fluorine, and a crystal grain or a magnetic powder has the same crystal system in a central portion and in a surface and an angular difference in crystal orientation of 45° or less in average between the central portion and the surface.

A decrease in the coercive force caused by various types of defects due to the difference in the crystal orientation is suppressed by adjusting, in the main phase in terms of volume of a magnet, for a fluorine-containing crystal grain or magnetic powder constituted of crystals having different fluorine concentrations between the center and the interface as the peripheral side as viewed from the center or the surface vicinity, crystal orientations of the center and the peripheral side or the interface vicinity so that an angle between an axis a of $Re_lFe_mF_x$ and an axis a of $Re_sFe_tF_y$ is 45° or less in average, or an angle between an axis c of $Re_lFe_mF_x$ and an axis c of $Re_sFe_tF_y$ is 45° or less in average.

Here, Re is a rare earth element including Y (yttrium); Fe is iron; F is fluorine; l, m, x, s, t and y are a rational number, and $l<m$, $s<t$ and $x<y$; and $Re_lFe_mF_x$ is a fluoride of the central portion, and $Re_sFe_tF_y$ is a fluoride of the peripheral side.

The crystal orientation of the peripheral side in deriving the angular difference described above refers to a local average orientation determined from electron beam diffraction and X-ray diffraction in the range of 0 to 1 μm from the outermost periphery of a parent phase. The crystal orientation of the central portion refers to an average orientation determined by means of evaluating the crystal orientation such as electron beam diffraction in the range of 0 to 1 μm nearly from the center of a magnetic powder or crystal grain.

In order to provide the fluoride with the stabilization of the crystal structure and the high performances of magnetic characteristics, a transition element M is added, and for exhibiting a high coercive force, a relation needs to be held in which an angle between an axis a of $Re_l(Fe_mM_{1-m})F_x$ and an axis a of $Re_s(Fe_tM_{1-t})F_y$ is 45° or less in average, or the angle between an axis c of $Re_l(Fe_mM_{1-m})F_x$ and the axis c of $Re_s(Fe_tM_{1-t})F_y$ is 45° or less in average.

Here, Re is a rare earth element including Y (yttrium); Fe is iron; F is fluorine; l, m, x, s, t and y are a rational number, and l<m, s<t and x<y; and $Re_l(Fe_mM_{1-m})F_x$ is a fluoride in the central portion, and $Re_s(Fe_tM_{1-t})F_y$ is a fluoride in the peripheral side.

In the present invention, in a fluoride having a rhombohedral, tetragonal, monoclinic or hexagonal crystal structure as a parent phase, an orientation difference between crystals having different fluorine concentrations or an orientation difference in the orientation of one crystal axis is 45° or less in average, whereby a high coercive force and a high residual flux density can simultaneously be achieved.

In the magnetic material according to the present invention, the angular difference in the crystal orientation between the central portion and the surface of the crystal grain or magnetic powder is 45° or less in average, whereby a high coercive force and a high residual flux density both can simultaneously be satisfied.

A phase containing a group 17 element such as fluorine is formed in a magnetic powder or an iron powder constituted of a light rare earth element and iron, while the crystal orientation is being controlled, and the powder is heat treated and molded, thereby providing the magnetic powder achieving a high coercive force and a high magnetic flux density; and application of moldings obtained by solidifying the powder to rotating machines can provide a low iron loss and a high induced voltage, and the moldings can be applied to magnetic circuits necessitating a high energy product, including various types of rotating machines and voice coil motors of hard discs.

DESCRIPTION OF SYMBOLS

Figure 1:
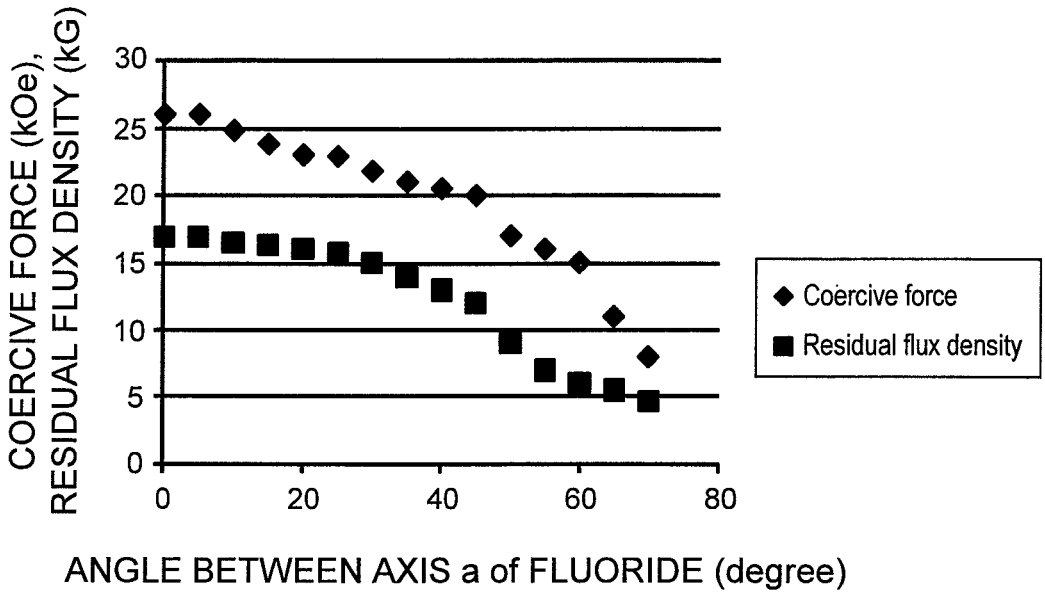
FIG. 1 is a diagram showing relations between the angle between axis a of the fluorides according to the present invention, and the coercive force and residual flux density thereof.

10 RARE EARTH FLUORIDE PHASE
11 IRON/COBALT-RICH PHASE
12 RARE/EARTH/IRON/COBALT FLUORIDE PHASE

DETAILED DESCRIPTION OF THE PREFERRED EMBODIMENTS

In order to simultaneously achieve both a residual flux density and a high coercive force of a magnet, the squareness ratio of a demagnetization curve needs to be raised. Preferred embodiments to achieve all of the residual flux density, high coercive force and squareness ratio will be described hereinafter.

In order to raise the residual flux density, it is effective to increase the total magnetic moment of materials or elements constituting a magnet. A stable material having a highest saturation magnetic flux density is an FeCo-based alloy. As a metastable phase, a compound in which nitrogen has intruded interstitially has a high magnetic flux density.

Since a group 17 element including fluorine has a high electronegativity and largely changes the distribution of the electron density of states of iron, cobalt and the like, making the compound or alloy having a high magnetic flux density contain the element provides a higher magnetic flux density.

Disposition of fluorine at an interatomic position or a displacement position changes the electronic states of adjacent atoms, and involves the deformation of crystals due to the lattice distortion, and additionally an increase in the magnetic moment due to the magnetovolume effect.

In order to raise the coercive force, the magnetocrystalline anisotropy needs to be made large. Since a group 17 element such as fluorine has a high electronegativity, anisotropy can be imparted to the distribution of the density of states of atoms such as iron and cobalt, thereby increasing the magnetocrystalline anisotropy energy.

Making an FeCo alloy having a saturation magnetic flux density of 2.4 T contain 5 atomic % of fluorine to cause the crystal lattice to dilate by about 1% can provide an anisotropic magnetic field of 2 MA/m. At this time, in order to raise the residual flux density, it is important to raise the squareness of the demagnetization curve.

In order to raise the residual flux density while the saturation magnetic flux density under application of a sufficiently high magnetic field is maintained, it is important to raise the coercive force so that the magnetization does not easily reverse or rotate. Places where the reversion or rotation of the magnetization easily occurs are interfaces having various types of defects, discontinuous portions of crystal lattices, interfaces with heterophases, and the like. By eliminating such places as many as possible, the residual flux density is increased. Therefor, in crystal grains and powder of compounds containing a group 17 element such as fluorine, it is important to align the crystal orientations of the compounds having different concentrations of the group 17 element.

In order to control the crystal orientations of compounds having different fluorine concentrations in a fluoride, it is important to control the concentration of fluorine, to control the atomic position where a fluorine atom is disposed, and to raise the crystal stability of the fluoride.

Specific controls include the interstitial disposition of fluorine, making the fluorine concentration disposed at interstitial positions in the range of 0.1 to 5 atomic %, raising the degree of order of fluorine and iron, and the formation of a fluoride energetically more stable than the main phase of an oxyfluoride and the like on grain boundaries or outermost surfaces.

In order to form fluorides by aligning crystal orientations of the interior and the peripheral portion of a crystal grain or magnetic powder, it is first essential that crystal orientations in the crystal grain or magnetic powder before the fluorination are aligned, and it is further important that by making fluorides, additionally oxides, carbides and the like, which exhibit poor lattice matching with an interstitial fluoride in the magnetic powder or crystal grain during the fluorination, grow as little as possible, the growth of the interstitial fluoride having a different orientation from the interface exhibiting poor matching is suppressed.

In order to align orientations of crystals, in which fluorine atoms intrude in lattices having iron atoms or rare earth atoms as their skeleton, inside a crystal grain or magnetic powder in such a way, the fluorination needs to be carried out at a lower temperature than a temperature at which a nonmagnetic or paramagnetic fluoride easily grows.

Carrying out the fluorination at a low temperature forms an interstitial compound rather than grows a stable fluoride such as $Fe_xF_y$ (X and Y are each an integer) or an oxy-fluoride inside the crystal grain or inside the magnetic powder. On the outermost peripheral surface of a parent phase crystal grain or a parent phase magnetic powder having been fluorinated, a fluoride or oxy-fluoride containing at least one constituting element of the parent phase is formed in a layer form.

Fluorine-containing compounds other than interstitial fluorides are formed on a part of the outermost surface or a part of the crystal boundary of the magnetic powder or crystal grain containing interstitial fluorides. It is essential for exhibiting a high coercive force that: the crystal grain or magnetic powder is constituted of $Re_l(Fe_mM_{1-m})F_x$, $Re_s(Fe_tM_{1-t})F_y$ and $(Re, Fe, M)_aO_bF_c$; and the $Re_l(Fe_mM_{1-m})F_x$ is formed in the central portion, the $Re_s(Fe_tM_{1-t})F_y$ is formed in the peripheral portion, and the $(Re, Fe, M)_aO_bF_c$ is formed on the outer side of the peripheral portion or grain boundary; Re is a rare earth element including Y, Fe is iron, F is fluorine, a group 17 element or fluorine and an interstitial element other than fluorine, and M is a transition element; and further a relation needs to be held in which the angle between the axis a of the $Re_l(Fe_mM_{1-m})F_x$ and the axis a of the $Re_s(Fe_tM_{1-t})F_y$ is 45° or less in average, or the angle between the axis c of the $Re_l(Fe_mM_{1-m})F_x$ and the axis c of the $Re_s(Fe_tM_{1-t})F_y$ is 45° or less in average.

That is, this means that in the equivalent arbitrary crystal orientations, the orientation difference between a fluoride, $Re_s(Fe_tM_{1-t})F_y$, in the periphery and a fluoride, $Re_l(Fe_mM_{1-m})F_x$, in the central portion is 45° or less. Here, l, m, x, s, t, y, a, b and c are each a rational number; and there are relations of $l<m$, $s<t$ and $x<y$. The $(Re, Fe, M)_aO_bF_c$ is a fluoride, oxy-fluoride or oxide containing at least one of Re, Fe and M, and has a smaller magnetization than the parent phase.

If the angular difference between the crystal axes exceeds 45°, it is likely that boundaries accompanied by defects and dislocations due to the angular difference are formed; the magnetic reversion easily occurs and the coercive force becomes small; and the residual flux density decreases.

In the present invention, fluorine (F) plays an important role. Fluorine is known to have a highest electronegativity in the periodic table, and becomes easily anions. In the hitherto history of magnetic materials, boron, carbon, nitrogen and oxygen have been used in practical materials. However, halogen elements including fluorine have no sufficient information on fundamental physical properties, the reaction process, and the like.

In the periodic table, oxygen, nitrogen and carbon, which are near fluorine, grow as alloys or compounds by various types of reactions with Fe, and develop magnetization. Iron-oxygen systems have various fundamental data on ferrites, and there are knowledges on ferromagnetic irons containing nitrogen and carbon.

By contrast, there are few reports on ferromagnetic iron/fluorine systems. The following results have recently been acquired from study results of basic experiments of solutions of fluorides and fluorine-containing gas reactions. 1) Fluorine can be incorporated in an iron-based or cobalt-based ferromagnetic phase. 2) Fluorine can be disposed at an interstitial position in an iron crystal lattice. 3) Iron in which fluorine has been incorporated is stable at room temperature. 4) A ferromagnetic phase in which fluorine has been incorporated is decomposed by heating.

With respect to magnetic materials, the following effects by incorporation of fluorine have been further confirmed. 1) The incorporation of fluorine increases the magnetocrystalline anisotropy energy. 2) Fluorine increases the unit lattice volume, and increases the magnetic moment due to the magnetovolume effect. 3) The distribution of the electronic density of states of adjacent atoms is made anisotropic. 4) Atoms on the periphery of fluorine exhibit the exchange interaction through the fluorine. 5) Formation of a compound with an element having a small electronegativity remarkably deforms the electronic density of states, and affects the spin arrangement. 6) Formation of a compound containing another light element improves the stability of a fluoride.

The above-mentioned effects are effects which would not be observed if nitrogen alone or oxygen alone were incorporated, and such a view partially holds that the effects have both the effect of nitrogen and the effect of oxygen. The incorporation of the above-mentioned properties to magnetic materials can greatly reduce the use amount of a heavy rare earth element or a rare earth element, which has been indispensable conventionally. It has been found further that if the magnetic performance necessary for application products is optimally designed, a magnetic material using no rare earth element can be provided by selection of a process and material system of a fluorinated magnetic material.

Means of a magnetic material using no rare earth element will be described hereinafter.

The fundamental physical properties of the magnetic material are the saturation magnetic flux density, the curie point and the magnetocrystalline anisotropy energy. In order to achieve a high performance of a magnet, these three fundamental physical properties need to be made larger than those of conventional magnetic materials using rare earth elements.

In order to raise the saturation magnetic flux density, an Fe—Co alloy is used for a main phase to secure a maximum saturation magnetic flux density of about 2.4 T. Since an Fe—Co alloy or an Fe-based alloy is used for the main phase, and no rare earth element is used, the curie point can be raised higher than the conventional case of using a rare earth element for the main phase.

The most important value is the magnetocrystalline anisotropy energy, and how the coercive force is developed has a problem so far. In order to develop the coercive force, the present invention employs the following means.

1) A shape anisotropy is imparted to a ferromagnetic main phase containing no rare earth element. 2) Fluorides having a high magnetocrystalline anisotropy magnetically coupling to a main phase are formed to suppress the magnetic reversion of the main phase. 3) The size of the main phase is made to be a size of several hundred nanometers or less, which makes a single domain. 4) Fluorides having a small magnetization are formed between main phase crystal grains to eliminate magnetic continuity between the main phase grains.

The reason why fluorine is effective when the coercive force is developed by these means 1) to 4) lie in that the control of the atomic position of fluorine or a composition and structure of a fluoride can increase the coercive force. That is, in the case where fluorine atoms are disposed in the vicinity of Fe, Co, Mn or Cr, since the distribution of the electronic density of states of these elements varies due to the high electronegativity of fluorine, anisotropy is caused in the electronic density of states to increase the magnetocrystalline anisotropy.

The exchange interaction is caused between peripheral elements through fluorine atoms to cause strong exchange coupling between spins and restrain the magnetization. Such increases in the exchange interaction and the magnetocrystalline anisotropy are caused by the high electronegativity of fluorine; and addition of an element having a low electronegativity can increase more the anisotropy of the distribution of the electronic density of states and increase the magnetocrystalline anisotropy Hereinafter, Examples will be described.

Example 1

In the present Example, a fabrication method of a magnetic material which has a phase of the central portion having a low fluorine concentration and a phase of the surface having a high fluorine concentration, and has a crystal orientation difference between the both of 45° or less in average, and a magnet using the magnetic material will be described.

In order to fabricate a $NdFe_{12}F$ magnet, a master alloy of Nd and iron are melted in vacuum so that the atomic ratio of Nd and Fe becomes 1:12. After the melting and cooling are repeated several times in order to homogenize the composition of the master alloy, the composition is again melted and quenched to form a foil piece of about 100 μm in thickness, which thereafter is pulverized in a hydrogen atmosphere. The pulverized powder has an average powder diameter of 10 to 100 μm.

The pulverized powder and an ammonium fluoride powder are mixed in an alcohol solvent, charged in a vessel with stainless balls whose surface is fluorinated for prevention of oxidation and suppression of impurity commingling, and subjected to ball milling while heated at 100° C. by an external heater. From the melting and quenching to ball milling, heating and molding were progressed in a hydrogen-containing atmosphere in order to prevent oxidation and secure magnetic characteristics. Fluorination progresses by heating and the effect of pulverization by balls and pulverization by hydrogen, and a fluorinated magnetic powder having an average powder diameter of 0.5 to 2 μm is fabricated.

As a result of carrying out the ball milling for 100 hours, F (fluorine) diffuses from the powder surface, and a magnetic powder having a composition of $NdFe_{12}F$ is formed. The central portion of the powder is $NdFe_{12}F_{0.01-0.1}$. A fluoride having a higher fluorine concentration than that of the fluoride of the powder central portion has the same crystal structure and a different lattice volume, and has a larger lattice volume than that of the fluoride having the lower concentration; and these fluorides have an orientation relation in crystal orientation.

It was confirmed by electron beam diffraction images by an electron microscope that axis directions of the axis c or the axis a of the fluoride in the central portion and the peripheral portion of the powder were nearly parallel. After the magnetic powder is molded at a magnetic field of 10 kOe and at a pressure of 1 t/cm$^2$, the powder is compression molded under heating at 400° C. and 10 t/cm$^2$.

Some of the fluorides of the magnetic powder surfaces cohere by heating and molding to provide a block body in which the volume of the fluorinated magnetic powder accounts for 90 to 99% of the whole block body. After the block body was aged at a temperature equal to or lower than a molding temperature, and quenched, a magnetic field of 25 kOe was applied in the anisotropic direction, and magnet characteristics were confirmed, which were a residual flux density of 1.8 T, a coercive force of 25 kOe, and a curie point of 520° C.

The $NdFe_{12}F$ magnet exhibiting the above-mentioned characteristics has different fluorine concentrations between the crystal grain boundary and the crystal grain central portion. The fluorine concentration is recognized to be high in the vicinity of the crystal grain boundary and low in the crystal grain central portion, and the concentration difference is recognized to be 0.1 atomic % or higher. The fluorine concentration difference can be confirmed by wavelength-dispersive X-ray spectroscopy. On the crystal grain boundary or the magnet surface, a phase grows which has a body-centered tetragonal or cubic structure such as NdOF, $NdF_3$, and a fluoride or oxy-fluoride grows which contains impurities such as hydrogen carbon or nitrogen whose compositions are different from the main phase ($NdFe_{12}F$).

If the volume occupied by such a fluoride or oxy-fluoride in the whole increases, the residual flux density decreases; therefore, the volume fraction to a main phase having an average grain diameter of 2 μm is desirably 10% or less, and in order to make the residual flux density 1.5 T or more, the volume fraction needs to be 5% or less. Magnetic characteristics nearly equal to the residual flux density of 1.8 T, the coercive force of 25 kOe and the curie point of 520° C. as in the present Example can be acquired by fluorides, other than $NdFe_{12}F$, such as $Nd(Fe_{0.9}Co_{0.1})_{12}F$, $Nd(Fe_{0.9}Mn_{0.1})_{12}F$, $CeFe_{12}F$, $PrFe_{12}F$, $YFe_{12}F$ and $La(Fe_{0.9}Co_{0.1})_{12}F$; and with a rare earth element denoted as RE, a transition metal element excluding iron and a rare earth element denoted as M and fluorine denoted as F, $$RE_x(Fe_sM_T)_YF_Z+RE_U(Fe_SM_T)_VF_W$$

(wherein X, Y, Z, S, T, U, V and W are positive numbers) exhibits the magnetic characteristics when X<Y, Z<Y, S>T, U<V, W<V and Z<W; and the $RE_x(Fe_sM_T)_YF_Z$ of the first term is a fluoride in the crystal grain central portion or the magnetic powder central portion, and the $RE_U(Fe_SM_T)_VF_W$ of the second term is a fluoride in the vicinity of the crystal grain boundary or in the magnetic powder surface portion.

In order to make the residual flux density 1.5 T or more, it is needed that X<Y/10, Z<3, Z<Y/4, T<0.4 and S>T, and that the volume fraction of fluorides and oxy-fluorides exhibiting no ferromagnetism other than the main phase is 0.01 to 10% with respect to the main phase having a body-centered tetragonal or hexagonal structure; and compounds, which have different fluorine concentrations and at least one axis directions of which are nearly parallel, have grown in the main phase. The formation of a fluoride or oxy-fluoride and main phases parallel in the axis direction and having different fluorine concentrations are inevitable for securing magnet characteristics to enhance the structural stability.

The reactive ball milling process or reactive mechanical alloying process in the present Example is applicable to the fluorination treatment of every powder material. That is, the interior of a vessel is heated by heating temperature conditioning capable of heating at a higher temperature than 20° C.; a powder or a gas containing fluorine is filled in the vessel to give reactivity; and by combining a mechanical reaction by balls (nascent surface formation, pulverization, activation of abraded portions, and the like) with a chemical reaction and a diffusive reaction, fluorination progresses at a relatively low temperature (50° C. to 500° C.). This means can be applied not only to rare earth/iron/fluorine-based magnetic materials but also to rare earth/cobalt/fluorine-based or cobalt/iron/fluorine-based magnetic materials, and parent phases having different fluorine concentrations and parallel axis directions grow, thereby obtaining a high coercive force.

In the case of fluorides containing no rare earth element, fluorides of at least two compositions are formed in a magnetic powder or crystal grain, and some of fluorine atoms are disposed at interstitial positions of iron or a transition metal element other than iron; and the fluorides are represented by the following composition formula.

$$(Fe_SM_T)_YF_Z+(Fe_UM_V)_WF_X$$

wherein M denotes the transition metal element other than iron, and F denotes fluorine; S, T, Z, U, V, W and X are positive numbers; the $(Fe_SM_T)_YF_Z$ of the first term corresponds to a composition of the central portion of the magnetic powder or crystal grain, and the $(Fe_UM_V)_WF_X$ of the second term corresponds to a composition of the peripheral portion of the magnetic powder or crystal grain; and Z<Y, X<W and Z<X. In order to raise the magnetic flux density, desirably S>T and U>V; and in order to obtain a high coercive force of 1 kOe to 20 kOe at 20° C., there are made conditions that the angle between the axis a of the $(Fe_SM_T)_YF_Z$ and the axis a of the $(Fe_UM_V)_WF_X$ is 45° or less in average, and the angle between the axis c of the $(Fe_SM_T)_YF_Z$ and the axis c of the $(Fe_UM_V)_WF_X$ is 45° or less in average.

Example 2

In the present Example, a fabrication method of a magnetic material in which the crystal orientation difference inside the magnetic powder can be made 45° or less, and magnetic characteristics of a magnet fabricated thereby will be described.

100 g of a $Sm_2Fe_{17}N_3$ magnetic powder having a grain diameter of 1 to 10 μM is mixed with 100 g of ammonium fluoride powder. The mixed powder is charged in a reaction vessel, and heated by an external heater. The ammonium fluoride is thermally decomposed by heating, and $NH_3$ and a fluorine-containing gas are generated. Through the fluorine-containing gas, some of N atoms in the magnetic powder start to be replaced with F (fluorine) at 50 to 600° C. In the case of the heating temperature of 200° C., a part of N is displaced with F, and $Sm_2Fe_{17}(N, F)_3$ grows in which fluorine and nitrogen are disposed at interstitial positions in a $Th_2Zn_{17}$ or $Th_2Ni_{17}$ structure. By setting the cooling rate after the retained heating at 1° C./min, some of N and F atoms are regularly arranged. After the completion of the reaction, the vessel interior is replaced by Ar gas for prevention of oxidation. Displacement of F with N locally dilates the lattice volume of the compound, and the magnetic moment of Fe increases. Some of N or F atoms are disposed at positions different from the interstitial positions before the reaction.

Such a magnetic powder containing $Sm_2Fe_{17}(N, F)_3$ contains 0.1 atomic % to 15 atomic % of fluorine, and a main phase in the vicinity of the grain boundary in the magnetic powder and a main phase in the grain thereof have fluorine concentrations different by about 0.1 to 5%. Such a difference in the fluoride concentration can be analyzed by energy-dispersive X-ray spectroscopy (EDX) or wavelength-dispersive X-ray spectroscopy having an electron beam diameter of 100 nm. The crystal orientation and orientation difference of a fluoride can be analyzed from the analysis of diffraction patterns observed by moving electron beam diffraction, using electron beams of 1 to 200 nm in beam diameter, from the center of a magnetic powder or crystal grain.

The fluorination progresses at 50 to 600° C. as described above, but on a high-temperature side of 500 to 600° C., the orientation difference between fluorides in a magnetic powder becomes 45° or more in average. This is caused by the formation of Fe—F based iron fluorides such as $FeF_2$ and $FeF_3$, rare earth fluorides such as $SmF_3$ and oxy-fluorides such as SmOF inside the magnetic powder in addition to the intrusion of fluorine into the $Th_2Zn_{17}$ or $Th_2Ni_{17}$ structure, and the disturbance of crystal orientations due to differences in the crystal structure and the lattice constant from those of the parent phase.

By contrast, in the case of fluorination at a low temperature less than 500° C., Fe—F based iron fluorides such as $FeF_2$ and $FeF_3$, rare earth fluorides such as $SmF_3$ and oxy-fluorides such as SmOF, which are different in the materials and the crystal structure from the main phase, do no grow in the central portion of the magnetic powder, and such compounds, amorphous fluorides or oxy-fluorides, or oxides are observed in the outermost peripheral portion of the magnetic powder, and the orientation difference between fluorides having different fluorine concentrations inside the magnetic powder becomes 40° or less.

Therefore, in order to make the difference in the crystal orientation between fluorides having different intruded-fluorine concentrations inside the magnetic powder and the crystal grain to be 45° or less, it is essential to set the fluorination reaction temperature using ammonium fluoride at less than 500° C.

In the case of carrying out the reaction at 200° C., it was confirmed by transmission electron beam diffraction pattern measured in a beam diameter of 100 nm that the difference in the crystal orientation was 0° to 20°, and that the axis c of a fluoride of 0.1 atomic % grown in the magnetic powder central portion and the axis c of a fluoride of 5 atomic % grown in the magnetic powder peripheral portion were nearly parallel, or the axis a of the fluoride of 0.1 atomic % grown in the magnetic powder central portion and the axis a of the fluoride of 5 atomic % grown in the magnetic powder peripheral portion were nearly parallel.

The basic magnetic properties of such a magnetic powder are a curie point of 400 to 600° C., a saturation magnetic flux density of 1.4 to 1.9 T and an anisotropic field of 2 to 20 MA/m, and a magnet having a residual flux density of 1.5 T can be fabricated by molding the magnetic powder.

Figure 2:
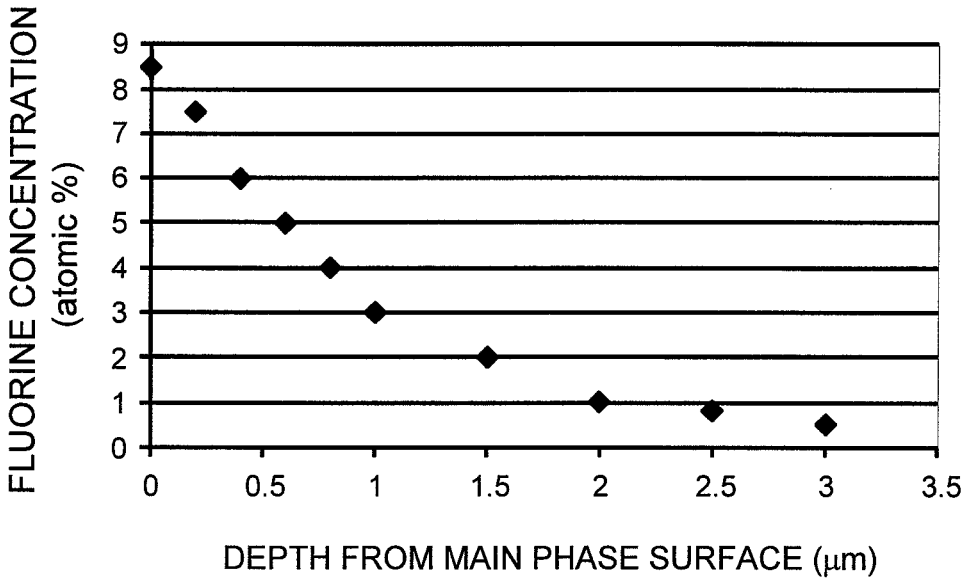
FIG. 2 is a diagram showing a relation between the depth from the main phase surface according to the present invention and the fluorine concentration thereof.

Relations between magnetic characteristics of a magnet having as a main phase $Sm_2Fe_{17}F_{1-3}$ being a fluorine-interstitial compound fabricated by changing the fluorination reaction temperature and the grain diameter of the magnetic powder, and the angle between the axis a of a fluoride in the magnetic powder are shown in FIG. 1. The fluorine concentration of a powder fluorinated with a decomposed gas of ammonium fluoride for 20 hours at 200° C. exhibits a fluorine concentration distribution shown in FIG. 2.

The fluorine concentration on the main phase surface is 8.5 atomic %; the fluorine concentration decreases toward the center portion direction of the main phase; and that becomes 0.5 to 1 atomic % in the vicinity of the center. The crystal structure in the central portion and in the vicinity of the surface of the main phase is a $Th_2Zn_{17}$ or $Th_2Ni_{17}$ structure, and the lattice constant varies by the fluorine concentration. The crystal orientation of a main phase having 0.5 to 1 atomic % of fluorine in the central portion and the crystal orientation of the high-fluorine concentration portion of the main phase surface can be evaluated as an orientation difference or an angular difference by electron beam diffraction. One example of the results is shown in FIG. 1.

The difference in the axis direction of the axis a between fluorides having intruded fluorine largely affects magnetic characteristics, and a larger angular difference is likely to more decrease the coercive force and the residual flux density. Particularly if the angular difference becomes 45° or more, since the residual flux density becomes less than 1 T and the coercive force becomes less than 20 kOe, the angular difference is desirably less than 45°, and is desirably as small as possible.

The fluorine concentration difference (atomic %) between a peripheral fluoride and an internal fluoride of each of different kinds of fluorine-containing magnetic powders, the orientation difference (degree) between the peripheral fluoride and the internal fluoride, and magnetic characteristics are collectively shown in Tables 1 to 5. The peripheral fluoride refers to one in the peripheral side of the main phase, and the internal fluoride refers to one in a portion having a small fluorine concentration in the main phase interior or the main phase central portion; a fluorine concentration difference between main phases of the peripheral side and the interior is recognized, and a smaller angular difference in the crystal orientation is likely to more increase the residual flux density and the coercive force.

Magnetic powder materials in which the crystal orientation difference inside the magnetic powder can be made 45° or less by incorporating a group 17 element such as fluorine are, other than $Sm_2Fe_{17}N_3$, $Re_lFe_mN_n$ (Re is a rare earth elements, and l, m and n are positive integers), $Re_lFe_mC_n$ (Re is a rare earth elements, and l, m and n are positive integers), $Re_lFe_mB_n$ (Re is a rare earth elements, and l, m and n are positive integers), $Re_lFe_m$ (Re is a rare earth element, and l and m are positive integers), and $M_lFe_m$ (M is at least one transition element other than Fe, Fe is iron, and l and m are positive integers). An oxy-fluoride containing Re grows on the surface of such a magnetic powder as a result of reduction of a main phase, whose oxygen concentration is decreased. Even if hydrogen, oxygen, carbon and nitrogen are contained in a less amount than the fluorine concentration at interstitial positions of the main phase as inevitable impurities, and even if a transition element is contained at displacement positions of the main phase in an amount not changing the crystal structure, magnetic characteristics can be maintained.

TABLE 1

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 1 | $NdFe_{11}TiF$ | 0.2 | 1.0 | 26.0 | 1.6 |
| 2 | $NdFe_{11}TiF$ | 0.2 | 46.0 | 18.0 | 1.0 |
| 3 | $NdFe_{11}TiF$ | 0.5 | 2.0 | 25.0 | 1.4 |
| 4 | $NdFe_{14}TiF$ | 0.1 | 3.0 | 24.0 | 1.7 |
| 5 | $NdFe_{18}TiF$ | 0.2 | 5.7 | 23.7 | 1.7 |
| 6 | $NdFe_{21}TiF$ | 0.2 | 4.6 | 21.6 | 1.8 |
| 7 | $NdFe_{29}TiF$ | 0.1 | 3.4 | 20.3 | 1.8 |
| 8 | $Nd_2Fe_{14}B_{0.9}F_{0.1}$ | 0.1 | 2.5 | 13.7 | 1.6 |
| 9 | $Nd_2Fe_{14}BF_{0.01}$ | 0.2 | 5.0 | 14.5 | 1.6 |
| 10 | $Nd_2Fe_{14}B_{0.9}F_{0.05}$ | 0.1 | 8.0 | 15.3 | 1.7 |
| 11 | $Nd_2Fe_{14}Al_{0.05}B_{0.9}F_{0.1}$ | 0.1 | 7.0 | 17.5 | 1.6 |
| 12 | $Nd_2Fe_{14}B_{0.9}N_{0.1}F_{0.1}$ | 0.3 | 8.5 | 14.1 | 1.6 |
| 13 | $Nd_2Fe_{14}B_{0.9}C_{0.05}F_{0.1}$ | 0.2 | 7.4 | 13.8 | 1.6 |
| 14 | $Pr_{0.2}Nd_{1.8}Fe_{14}B_{0.9}F_{0.1}$ | 0.5 | 13.5 | 14.8 | 1.7 |
| 15 | $Pr_{0.2}Nd_{1.8}Fe_{13}CoB_{0.9}F_{0.1}$ | 0.4 | 11.3 | 15.7 | 1.7 |
| 16 | $Fe_7CoF_{0.2}$ | 0.3 | 8.3 | 8.4 | 1.6 |
| 17 | $Fe_7Co_2F_{0.2}$ | 0.2 | 6.3 | 9.5 | 1.7 |
| 18 | $Fe_7Co_{2.5}F_{0.2}$ | 0.1 | 5.9 | 10.0 | 1.8 |
| 19 | $Fe_7Co_3F_{0.2}$ | 0.9 | 6.0 | 11.0 | 1.9 |
| 20 | $Fe_7Co_3F_{0.2}$ | 0.9 | 18.5 | 8.6 | 1.7 |
| 21 | $Fe_7Co_3F_{0.2}$ | 0.7 | 27.0 | 7.1 | 1.5 |
| 22 | $Fe_7Co_3F_{0.2}$ | 1.0 | 38.0 | 6.5 | 1.1 |
| 23 | $Fe_7Co_3F_{0.2}$ | 0.9 | 47.0 | 4.2 | 0.7 |
| 24 | $Fe_7Co_3F_{0.2}$ | 0.1 | 5.8 | 12.1 | 1.6 |
| 25 | $Fe_7Co_3F_{0.2}$ | 0.0 | 5.5 | 8.5 | 1.4 |
| 26 | $Fe_7Co_3F_{0.1}$ | 0.8 | 4.0 | 9.0 | 1.7 |
| 27 | $Fe_7Co_3H_{0.1}F_2$ | 0.8 | 5.2 | 7.5 | 1.7 |
| 28 | $Fe_7Co_3H_{0.1}F_3$ | 0.9 | 5.5 | 7.4 | 1.7 |
| 29 | $Fe_7Co_3H_{0.1}F_4$ | 0.9 | 6.1 | 8.5 | 1.8 |
| 30 | $Fe_7Co_3H_{0.2}F_4$ | 1.1 | 5.8 | 8.9 | 1.8 |
| 31 | $Fe_7Co_3H_{0.5}F_4$ | 1.2 | 7.1 | 11.5 | 1.8 |
| 32 | $Fe_7Co_3H_{0.1}C_{0.1}F_2$ | 0.8 | 9.5 | 12.1 | 1.7 |
| 33 | $Fe_7Co_3H_{0.1}C_{0.1}F_2$ | 0.7 | 9.2 | 11.5 | 1.7 |
| 34 | $Sm_{0.1}Zr_{0.2}Fe_7Co_3H_{0.1}C_{0.1}F_2$ | 0.9 | 5.6 | 12.5 | 1.8 |
| 35 | $Sm_{0.1}Zr_{0.2}Fe_7Co_3H_{0.1}C_{0.1}F_3$ | 1.1 | 5.2 | 13.2 | 1.8 |
| 36 | $Sm_{0.1}Zr_{0.2}Fe_7Co_3H_{0.1}C_{0.1}F_4$ | 1.9 | 1.2 | 14.5 | 1.8 |
| 37 | $Sm_{0.1}Zr_{0.2}Fe_7Co_3H_{0.1}C_{0.1}N_{0.1}F_{0.5}$ | 2.5 | 5.5 | 13.2 | 1.7 |
| 38 | $Sm_{0.1}Zr_{0.2}Fe_7Co_3H_{0.1}C_{0.1}N_{0.1}O_{0.01}F_{0.5}$ | 3.8 | 8.9 | 15.2 | 1.6 |
| 39 | $Fe_7Co_3NiF_{0.2}$ | 0.9 | 5.0 | 7.5 | 1.6 |
| 40 | $Fe_7Co_3CrF_{0.2}$ | 0.7 | 7.6 | 12.5 | 1.6 |
| 41 | $Fe_7Co_3MnF_{0.3}$ | 0.8 | 8.5 | 12.2 | 1.7 |
| 42 | $Fe_7Co_3TiF_{0.3}$ | 0.9 | 11.0 | 12.1 | 1.6 |
| 43 | $Fe_7Co_3N_{0.5}F_{0.5}$ | 1.1 | 8.5 | 8.1 | 1.2 |
| 44 | $Fe_7Co_3NdF_{0.3}$ | 1.0 | 7.8 | 11.5 | 1.7 |
| 45 | $Fe_7Co_3LaF_{0.3}$ | 0.9 | 3.5 | 12.2 | 1.8 |
| 46 | $Fe_7Co_3LaAl_{0.1}F_{0.3}$ | 1.1 | 2.6 | 12.9 | 1.7 |
| 47 | $Fe_7Co_3NdAl_{0.1}F_{0.3}$ | 1.2 | 8.5 | 13.6 | 1.8 |
| 48 | $Fe_7Co_3VAl_{0.1}F_{0.3}$ | 1.2 | 5.2 | 13.4 | 1.8 |
| 49 | $Fe_7Co_3ZrAl_{0.1}F_{0.3}$ | 1.1 | 2.1 | 15.2 | 1.7 |
| 50 | $Fe_7Co_3CaAl_{0.1}F_{0.3}$ | 1.3 | 2.5 | 18.3 | 1.9 |

TABLE 2

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 51 | $Fe_7Co_3CaAl_{0.1}F_{0.3}$ | 1.2 | 18.6 | 18.1 | 1.8 |
| 52 | $Fe_7Co_3CaAl_{0.1}F_{0.3}$ | 1.2 | 21.3 | 16.4 | 1.7 |
| 53 | $Fe_7Co_3CaAl_{0.1}F_{0.3}$ | 1.3 | 29.5 | 14.1 | 1.6 |
| 54 | $Fe_7Co_3CaAl_{0.1}F_{0.3}$ | 1.3 | 46.3 | 8.5 | 0.5 |
| 55 | $Fe_7Co_3BaAl_{0.1}F_{0.3}$ | 1.2 | 2.8 | 20.2 | 2 |
| 56 | $Fe_7Co_3KAl_{0.1}F_{0.3}$ | 1.2 | 5.5 | 19.5 | 1.9 |
| 57 | $Fe_7Co_3Nb_{0.1}Mo_{0.1}Al_{0.1}F_{0.3}$ | 1.3 | 3.7 | 20.2 | 2.1 |
| 58 | $Fe_7Co_3NdCl_{0.1}F_{0.3}$ | 1 | 3.3 | 19.3 | 1.9 |
| 59 | $Fe_7Co_3NdTi_{0.1}F_{0.3}$ | 0.9 | 5.8 | 20.5 | 2.1 |
| 60 | $Fe_7Co_3Sm_{0.5}TiF_{0.4}$ | 0.8 | 4.2 | 17.5 | 1.7 |
| 61 | $Fe_7Co_3Y_{0.5}TiF_{0.5}$ | 0.7 | 8.9 | 17.5 | 1.8 |
| 62 | $Fe_7Co_3Sm_{0.5}ZrF_{0.4}$ | 0.6 | 7.5 | 18.5 | 1.8 |
| 63 | $Fe_7Co_3Sm_{0.5}CaF_{0.4}$ | 0.9 | 7.9 | 20.5 | 1.8 |
| 64 | $Fe_7Co_3Sm_{0.5}B_{0.5}Al_{0.01}F_{0.4}$ | 0.6 | 8.5 | 20.1 | 1.9 |
| 65 | $Fe_7Co_3Sm_{0.5}Cu_{0.2}F_{0.4}$ | 0.7 | 10.5 | 19.1 | 1.8 |
| 66 | $Fe_7Co_3Sm_{0.5}N_{0.2}F_{0.4}$ | 0.5 | 10.9 | 18.5 | 1.9 |
| 67 | $Fe_7Co_3Sm_{0.01}N_{0.2}F_{0.4}$ | 0.4 | 8.5 | 20.2 | 1.8 |
| 68 | $Fe_7Co_3Sm_{0.1}F_{0.1}$ | 0.6 | 9.5 | 19.1 | 1.7 |
| 69 | $Fe_7Co_3Sm_{0.01}F_{0.1}$ | 0.8 | 11.5 | 17.2 | 1.6 |
| 70 | $Fe_7Co_3Sm_{0.05}F_{0.1}$ | 0.9 | 12.5 | 17.9 | 1.7 |
| 71 | $Fe_7Co_3Nd_{0.1}F_{0.1}$ | 1.2 | 11.3 | 15.2 | 1.5 |
| 72 | $Fe_7Co_3La_{0.1}F_{0.1}$ | 1.1 | 8.5 | 16.5 | 1.6 |
| 73 | $Fe_7Co_3Ce_{0.1}F_{0.1}$ | 1 | 9.5 | 17.5 | 1.6 |
| 74 | $Fe_7Co_3Sm_{0.1}H_{0.1}F_{0.1}$ | 0.9 | 12.5 | 17.1 | 1.7 |
| 75 | $Fe_7Co_3Sm_{0.1}Cl_{0.1}F_{0.1}$ | 0.8 | 4.5 | 17.8 | 1.6 |
| 76 | $Fe_7Co_3Sm_{0.1}Br_{0.1}F_{0.1}$ | 0.6 | 4.8 | 18.5 | 1.7 |
| 77 | $Fe_7Co_3Sm_{0.1}I_{0.1}F_{0.1}$ | 0.8 | 3.5 | 16.5 | 1.6 |
| 78 | $Fe_7Co_3Sm_{0.1}H_{0.1}Cl_{0.1}F_{0.1}$ | 0.5 | 2.5 | 18.2 | 1.7 |
| 79 | $Fe_7Co_3Sm_{0.2}F_{0.1}$ | 0.5 | 3.6 | 14.5 | 1.5 |
| 80 | $Fe_7Co_3Cu_{0.2}Zr_{0.1}F_{0.1}$ | 0.7 | 3.3 | 15.8 | 1.6 |
| 81 | $Fe_7Co_3Nb_{0.2}Zr_{0.1}F_{0.1}$ | 0.7 | 5.6 | 18.5 | 1.7 |
| 82 | $Fe_7Co_3LiF_{0.02}$ | 0.2 | 4.5 | 16.7 | 1.6 |
| 83 | $Fe_7Co_3NaF_{0.05}$ | 0.3 | 8.2 | 17.5 | 1.6 |
| 84 | $Fe_7Co_3MgF_{0.05}$ | 0.2 | 5.5 | 12.5 | 1.4 |
| 85 | $Fe_7Co_3AlF_{0.1}$ | 0.4 | 12.5 | 18.6 | 1.8 |
| 86 | $Fe_7Co_3SiF_{0.2}$ | 0.4 | 10.5 | 12.3 | 1.5 |
| 87 | $Fe_7Co_3PF_{0.3}$ | 0.5 | 5.9 | 9.5 | 1.1 |
| 88 | $Fe_7Co_3Cl_{0.1}F_{0.3}$ | 0.5 | 18.5 | 12.8 | 1.2 |
| 89 | $Fe_7Co_3SF_{0.10}$ | 0.2 | 16.5 | 9.3 | 1 |
| 90 | $Fe_7Co_3LaH_{0.1}F_{0.1}$ | 0.2 | 15.5 | 17.5 | 1.6 |
| 91 | $Fe_7Co_3LaO_{0.1}F_{0.12}$ | 0.3 | 12.3 | 18.6 | 1.6 |
| 92 | $Fe_7Co_3SrH_{0.1}F_{0.13}$ | 0.3 | 17.5 | 18.1 | 1.7 |
| 93 | $Fe_6Co_4F_{0.2}$ | 0.5 | 8.6 | 16.5 | 1.7 |
| 94 | $Fe_6Co_4MnF_{0.2}$ | 0.7 | 5.5 | 15.1 | 1.6 |
| 95 | $Fe_6Co_4F_{0.1}N_{0.2}$ | 0.6 | 5.9 | 12.3 | 1.7 |
| 96 | $Fe_6Co_4AlF_{0.1}N_{0.2}$ | 0.9 | 7.5 | 18.5 | 1.6 |
| 97 | $Fe_6Co_4VF_{0.1}N_{0.2}$ | 0.6 | 6.6 | 17.4 | 1.5 |
| 98 | $Fe_6Co_4NdF_{0.1}N_{0.2}$ | 0.9 | 8.4 | 19.5 | 1.7 |
| 99 | $Fe_6Co_4YF_{0.1}N_{0.2}$ | 0.6 | 5.9 | 10.6 | 1 |
| 100 | $Fe_6Co_4CrF_{0.2}$ | 0.5 | 5.1 | 12.4 | 1.5 |

TABLE 3

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 101 | $Sm_2Fe_{17}F_2$ | 0.7 | 8.5 | 25.8 | 1.6 |
| 102 | $SmFe_{11}TiN_{0.4}F_{0.1}$ | 0.9 | 9.3 | 28.1 | 1.6 |
| 103 | $NdFe_{12}TiF$ | 1.2 | 5.7 | 25.8 | 1.7 |
| 104 | $Nd_3Fe_{29}TiF$ | 1.1 | 11.5 | 27.5 | 1.6 |
| 105 | $Nd_2Fe_{14}C_{0.5}F_{0.5}$ | 0.2 | 5.8 | 21 | 1.5 |
| 106 | $Nd_3(Fe_{0.9}Co_{0.1})_{29}TiF$ | 1.2 | 12.3 | 28.9 | 1.6 |
| 107 | $Nd_{0.75}Zr_{0.2}Fe_{0.7}Co_{0.3}F_{0.05}$ | 0.5 | 6.5 | 23.5 | 1.7 |
| 108 | $Sm_{0.5}Zr_{0.3}Fe_{0.7}Co_{0.3}F_{0.06}$ | 0.4 | 8.5 | 22.1 | 1.8 |
| 109 | $Sm_{0.4}Zr_{0.3}Fe_{0.7}Co_{0.3}F_{0.04}$ | 0.5 | 5.5 | 21.3 | 1.7 |
| 110 | $(Sm_{0.5}Zr_{0.3}Fe_{0.7}Co_{0.3})_{10}F_{0.06}$ | 1.1 | 13 | 21.5 | 1.75 |
| 111 | $(Sm_{0.3}Zr_{0.3}Fe_{0.7}Co_{0.3})_{10}F_2$ | 1.2 | 8.5 | 18.2 | 1.8 |
| 112 | $(Sm_{0.3}Zr_{0.3}Fe_{0.7}Co_{0.3})_{10}F_4$ | 1.5 | 9.2 | 22.5 | 1.75 |
| 113 | $(Sm_{0.5}Zr_{0.3}Fe_{0.7}Co_{0.3})_{10}Ca_{0.01}F_{0.06}$ | 1.2 | 10 | 22.5 | 1.8 |
| 114 | $(Sm_{0.5}Zr_{0.3}Fe_{0.7}Co_{0.3})_{10}Ca_{0.02}F_{0.06}$ | 1.5 | 7 | 23.8 | 1.8 |

TABLE 3-continued

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 115 | $(Sm_{0.5}Zr_{0.3}Fe_{0.7}Co_{0.3})_{10}Ca_{0.05}F_{0.06}$ | 1.6 | 4 | 28.5 | 1.9 |
| 116 | $(Sm_{0.5}Zr_{0.2}Cu_{0.1}Fe_{0.7}Co_{0.3})_{10}F_{0.2}$ | 1.8 | 5 | 27.1 | 1.8 |
| 117 | $(Sm_{0.5}Zr_{0.2}Cu_{0.1}Fe_{0.7}Co_{0.3})_{10}F_{0.3}$ | 1.8 | 6.5 | 28.5 | 1.8 |
| 118 | $(Sm_{0.5}Zr_{0.2}Cu_{0.1}Fe_{0.6}Co_{0.4})_{10}F_{0.4}$ | 2.2 | 5.8 | 29.5 | 1.6 |
| 119 | $(Sm_{0.5}Zr_{0.2}Cu_{0.1}Fe_{0.9}Co_{0.1})_{10}F_{0.9}$ | 3.5 | 2.5 | 25.2 | 1.4 |
| 120 | $Sm(Co_{0.70}Fe_{0.21}Cu_{0.06}Zr_{0.03})_{7.4}$ | 0 | — | 27 | 1.1 |
| 121 | $Sm(Co_{0.70}Fe_{0.21}Cu_{0.06}Zr_{0.03})_{7.4}F_{0.1}$ | 0.5 | 2.5 | 29.2 | 1.1 |
| 122 | $Sm(Co_{0.70}Fe_{0.21}Cu_{0.06}Zr_{0.03})_{7.4}F_{0.2}$ | 1.1 | 2.9 | 30.1 | 1.2 |
| 123 | $Sm(Co_{0.70}Fe_{0.21}Cu_{0.06}Zr_{0.03})_{7.4}F_{0.4}$ | 1.6 | 3.1 | 31.5 | 1.3 |
| 124 | $Sm(Co_{0.70}Fe_{0.21}Cu_{0.06}Zr_{0.03})_{7.4}F_{0.7}$ | 2.8 | 4.5 | 33.2 | 1.4 |
| 125 | $(Sm_{0.5}Zr_{0.3}Fe_{0.9}Ni_{0.1})_{10}F_{0.06}$ | 2.5 | 12.5 | 11.2 | 1.5 |
| 126 | $Sm_2Fe_{15}GaF_2$ | 0.9 | 5.5 | 19.5 | 1.5 |
| 127 | $Sm_2Fe_{15}GaCF$ | 0.5 | 10.5 | 18.2 | 1.5 |
| 128 | $Sm_2Fe_{17}F_{0.2}$ | 0.7 | 2 | 18.5 | 1.5 |
| 129 | $Sm_2Fe_{17}F_{0.5}$ | 0.9 | 4.7 | 19.5 | 1.6 |
| 130 | $Sm_2Fe_{17}F_{0.5}$ | 0.8 | 8.5 | 18.8 | 1.6 |
| 131 | $Sm_2Fe_{17}F_{0.5}$ | 0.7 | 11 | 17.1 | 1.5 |
| 132 | $Sm_2Fe_{17}F_{0.5}$ | 0.9 | 15.8 | 16.5 | 1.4 |
| 133 | $Sm_2Fe_{17}F_{0.5}$ | 1 | 34.7 | 15.5 | 1.1 |
| 134 | $Sm_2Fe_{17}F_{0.5}$ | 1.1 | 46.5 | 7.1 | 0.5 |
| 135 | $Sm_2Fe_{17}F$ | 0.9 | 13.5 | 21.8 | 1.5 |
| 136 | $Sm_2Fe_{17}NF_2$ | 1.2 | 14.6 | 22.6 | 1.6 |
| 137 | $Sm_2Fe_{17}N_{0.1}F_2$ | 1.2 | 15.5 | 23.5 | 1.8 |
| 138 | $Sm_2Fe_{17}N_2F$ | 0.8 | 11.2 | 23.6 | 1.7 |
| 139 | $Sm_2Fe_{17}C_2F$ | 0.5 | 11.5 | 24.7 | 1.7 |
| 140 | $Sm_2Fe_{17}B_3F$ | 0.5 | 12.7 | 22.1 | 1.6 |
| 141 | $Sm_2Fe_{17}N_{2.8}F_{0.1}$ | 0.4 | 13.2 | 26.6 | 1.7 |
| 142 | $Sm_2Fe_{17}N_{2.8}F_{0.2}$ | 0.3 | 9.3 | 21.8 | 1.6 |
| 143 | $Sm_2Fe_{17}CF$ | 0.5 | 2.8 | 19.3 | 1.5 |
| 144 | $Sm_2Fe_{17}CF$ | 0.7 | 48 | 9.5 | 1.1 |
| 145 | $Sm_2Fe_{17}CF$ | 0.9 | 51 | 5.5 | 0.4 |
| 146 | $Sm_2Fe_{17}H_{0.1}F$ | 0.5 | 1.5 | 19.5 | 1.65 |
| 147 | $Sm_2Fe_{17}H_{0.2}F$ | 0.4 | 2.5 | 18.7 | 1.65 |
| 148 | $Sm_2Fe_{17}H_{0.3}F$ | 0.3 | 2.1 | 18.5 | 1.65 |
| 149 | $Sm_2Fe_{17}H_{0.1}F_{3.5}$ | 0.8 | 3.2 | 21.2 | 1.71 |
| 150 | $Sm_2Fe_{17}H_{0.2}F_{3.7}$ | 0.7 | 3.5 | 21.5 | 1.7 |

TABLE 4

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 151 | $Sm_2Fe_{17}H_{0.3}F_{3.9}$ | 0.9 | 3.3 | 23.2 | 1.7 |
| 152 | $Sm_2Fe_{17}H_{0.1}F_{1.6}$ | 2 | 3.5 | 20.5 | 1.6 |
| 153 | $Sm_2Fe_{17}H_{0.1}F_{1.7}$ | 2.5 | 3.8 | 20.6 | 1.7 |
| 154 | $La_2Fe_{17}H_{0.1}F_{1.8}$ | 2.8 | 5.6 | 16.7 | 1.6 |
| 155 | $Ce_2Fe_{17}H_{0.1}F_{1.7}$ | 2.5 | 2.9 | 15.2 | 1.5 |
| 156 | $Pr_2Fe_{17}H_{0.1}F_{1.7}$ | 3.5 | 3.2 | 19.5 | 1.6 |
| 157 | $Nd_2Fe_{17}H_{0.1}F_{1.7}$ | 1.5 | 5.6 | 20.1 | 1.7 |
| 158 | $Eu_2Fe_{17}H_{0.1}F_{1.7}$ | 3.2 | 8.5 | 15.4 | 1.6 |
| 159 | $Gd_2Fe_{17}H_{0.1}F_{1.7}$ | 2.6 | 7.6 | 14.2 | 1.5 |
| 160 | $Y_2Fe_{17}H_{0.1}F_{1.7}$ | 3.1 | 9.1 | 13.2 | 1.4 |
| 161 | $Sm_{23}Fe_{27}V_2F_4$ | 2.1 | 11.2 | 18.2 | 1.5 |
| 162 | $Sm_{23}Fe_{27}V_2F_3$ | 1.8 | 5.8 | 17.5 | 1.5 |
| 163 | $Sm(Fe_{11}Ti)F_{0.2}$ | 0.2 | 5.1 | 15.3 | 1.4 |
| 164 | $Mn_4AlF_{0.1}$ | 1.3 | 14.7 | 11.5 | 1.1 |
| 165 | $Fe_2Mn_4AlF_{0.1}$ | 1.2 | 5.9 | 12.6 | 1.2 |
| 166 | $Fe_3Mn_4AlF_{0.1}$ | 2.2 | 4.2 | 12.8 | 1.2 |
| 167 | $Fe_4Mn_4AlF_{0.1}$ | 2.5 | 5.1 | 12.9 | 1.3 |
| 168 | $Fe_5Mn_4AlF_{0.1}$ | 3.1 | 8.5 | 13.1 | 1.3 |
| 169 | $(FeCo)_4Mn_4AlF_{0.1}$ | 3.5 | 2.6 | 13.2 | 1.3 |
| 170 | $(Fe_{0.9}Co_{0.1})_4Mn_2AlF_{0.1}$ | 3.1 | 4.7 | 13.5 | 1.4 |
| 171 | $(Sm_{0.01}Fe_{0.8}Co_{0.19})_4Mn_2AlF_{0.1}$ | 2.2 | 8.1 | 15.8 | 1.5 |
| 172 | $CuMn_4AlF_{0.1}$ | 1.4 | 9.1 | 11.6 | 1.1 |
| 173 | $CuMn_4AlF_{0.2}$ | 1.5 | 7.5 | 12.5 | 1.2 |
| 174 | $CuMn_4AlF_{0.3}$ | 1.6 | 7.9 | 12.8 | 1.3 |
| 175 | $CuMn_4A_{10.5}Si_{0.5}F_{0.1}$ | 0.8 | 8.1 | 14.1 | 1.2 |
| 176 | $Co_3Mn_4AlF_{0.1}$ | 0.9 | 6.5 | 16.1 | 1.1 |
| 177 | $CrMn_4AlF_{0.1}$ | 0.8 | 8.9 | 11.3 | 0.8 |
| 178 | $NbMn_4AlF_{0.1}$ | 0.8 | 5.1 | 9.4 | 0.7 |

TABLE 4-continued

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 179 | $Mn_4AlF_{0.2}$ | 1.1 | 2.2 | 11.5 | 0.9 |
| 180 | $Mn_4AlF_{0.5}$ | 0.7 | 3.1 | 11.9 | 0.9 |
| 181 | $Mn_4AlF_{0.75}$ | 1.6 | 5.2 | 12.6 | 1.1 |
| 182 | $Mn_4AlF$ | 1.8 | 6.1 | 13.1 | 1.1 |
| 183 | $Mn_4AlF_{1.2}$ | 1.9 | 7.3 | 14.5 | 1.2 |
| 184 | $Mn_4AlF_{1.5}$ | 2.1 | 8.2 | 15.7 | 1.2 |
| 185 | $Mn_4AlF_2$ | 3.5 | 9.5 | 16.1 | 1.3 |
| 186 | $Mn_4AlF_3$ | 3.9 | 11.5 | 17.3 | 1.3 |
| 187 | $Mn_4AlF_5$ | 5.4 | 12.6 | 18.2 | 1.4 |
| 188 | $Mn_4AlCuF_2$ | 2.1 | 5.2 | 13.5 | 1.1 |
| 189 | $Mn_4AlMgF_2$ | 1.9 | 2.3 | 11.2 | 1 |
| 190 | $Mn_4AlCoF_2$ | 1.8 | 2.1 | 14.5 | 1.2 |
| 191 | $Mn_4AlCoF_2$ | 1.6 | 10.3 | 14.2 | 1.2 |
| 192 | $Mn_4AlCoF_2$ | 1.8 | 17.5 | 13.1 | 1.1 |
| 193 | $Mn_4AlCoF_2$ | 1.6 | 25.8 | 12.4 | 1 |
| 194 | $Mn_4AlCoF_2$ | 1.7 | 35.2 | 11.5 | 0.9 |
| 195 | $Mn_4AlCoF_2$ | 1.6 | 47.1 | 3.5 | 0.2 |
| 196 | $Mn_4AlFeF_2$ | 1.8 | 3.8 | 12.3 | 1.1 |
| 197 | $Mn_4AlFeHF_2$ | 2.2 | 6.5 | 11.8 | 1 |
| 198 | $Mn_4AlFeNF_2$ | 2.4 | 5.7 | 10.6 | 1.1 |
| 199 | $Mn_4AlFeNaF_2$ | 2.5 | 8.1 | 11.3 | 1.1 |
| 200 | $Mn_4AlCoNaNF_2$ | 1.9 | 3.2 | 13.8 | 1.2 |

TABLE 5

| No. | Material | Fluorine concentration difference between peripheral fluoride and internal fluoride (atomic %) | Orientation difference between peripheral fluoride and internal fluoride (degree) | Coercive force (kOe) | Residual flux density (T) |
|---|---|---|---|---|---|
| 201 | $Mn_4AlMg_{0.2}NF_2$ | 1.8 | 3.8 | 14.1 | 1.1 |
| 202 | $Mn_4AlClF_2$ | 2.1 | 8.3 | 15.1 | 1.2 |
| 203 | $Mn_4AlBrF_2$ | 2.2 | 8.8 | 12.1 | 0.9 |
| 204 | $Mn_4AlP_{0.1}NF_2$ | 2.5 | 5.4 | 11.2 | 1.1 |
| 205 | $Mn_4AlS_{0.1}NF_2$ | 1.9 | 6.6 | 10.2 | 0.8 |
| 206 | $Mn_4AlK_{0.1}NF_2$ | 2.5 | 7.3 | 11.4 | 1.1 |
| 207 | $Mn_4AlNa_{0.1}NF_2$ | 3.5 | 9.5 | 12.4 | 1.2 |
| 208 | $Fe_{29}Nd_3FTi$ | 1.7 | 4 | 27 | 1.5 |
| 209 | $Fe_{29}Nd_3FTi$ | 1.6 | 5.9 | 26 | 1.5 |
| 210 | $Fe_{29}Nd_3FTi$ | 1.5 | 14.6 | 25.8 | 1.4 |
| 211 | $Fe_{29}Nd_3FTi$ | 1.7 | 31 | 21 | 1.2 |
| 212 | $Fe_{29}Nd_3FTi$ | 1.8 | 38 | 17.6 | 1.1 |
| 213 | $Fe_{29}Nd_3FTi$ | 1.9 | 40 | 12.4 | 1 |
| 214 | $Fe_{29}Nd_3FTi$ | 1.8 | 48 | 4.2 | 0.3 |
| 215 | $Fe_{28}CoNd_3FTi$ | 0.5 | 12.5 | 27.5 | 1.6 |
| 216 | $Fe_{28}CoNd_3FTi$ | 0.6 | 5.6 | 28.5 | 1.6 |
| 217 | $Fe_{28}CoNd_3FTi$ | 0.3 | 5.8 | 29.1 | 1.6 |
| 218 | $Fe_{29}Nd_3FB_{0.2}Ti$ | 1.7 | 15.2 | 13.5 | 1.5 |
| 219 | $Fe_{29}Nd_3FB_{0.1}Ti$ | 1.5 | 11.3 | 15.5 | 1.4 |
| 220 | $Mn_4AlC_{0.1}F$ | 1.5 | 8 | 11.3 | 1.2 |
| 221 | $Mn_4AlC_{0.2}F$ | 1.4 | 6 | 11.5 | 1.1 |
| 222 | $Mn_3AlC_{0.3}F$ | 1.2 | 5 | 11.8 | 0.9 |
| 223 | $Mn_4CrAlC_{0.4}F$ | 1.7 | 10 | 10.9 | 1.1 |
| 224 | $Mn_4NF$ | 2.5 | 6.1 | 11.5 | 1.1 |
| 225 | $Mn_4AlCoCu_{0.1}NF$ | 2.1 | 3.7 | 12.5 | 1.2 |
| 226 | $Mn_5CuF$ | 1.4 | 4.7 | 13.1 | 1.1 |
| 227 | $Mn_5CuF$ | 1.3 | 5.4 | 12.7 | 1.1 |
| 228 | $Mn_5CuNa_{0.1}F$ | 2.2 | 2.8 | 13.6 | 1.1 |
| 229 | $Mn_5CuK_{0.05}F$ | 2.5 | 1.2 | 14.1 | 1.1 |
| 230 | $Mn_5CuLi_{0.05}F$ | 3.1 | 0.6 | 13.8 | 1.1 |

Example 3

In the present Example, a fabrication process of a magnetic material in which a vapor-deposited Fe grain and a SmF-based alcohol solution are used; the fluorine concentration is different between the central portion and the surface and the difference in the crystal orientation is 45° or less in average, and magnetic characteristics of a magnet fabricated thereby will be described.

A vapor-deposition source is disposed in a vacuum vessel and Fe is evaporated. The vacuum degree is $1\times10^{-4}$ Torr or lower; and Fe is evaporated in the vessel by resistance heating to fabricate a grain of 100 nm in grain diameter. An alcohol solution containing compositional components of $SmF_{2\text{-}3}$ is applied on the Fe grain surface, and dried at 200° C. to thereby form a fluoride film of 1 to 10 nm in average film thickness on the Fe grain surface. The Fe grain coated with the fluoride film is mixed with ammonium fluoride ($NH_4F$), and heated by an external heater. The heating temperature is 200° C.; and after the magnetic powder is exposed to a gas of $(NH_4)HF_2$, or ammonia and hydrogen fluoride, and held for 1 hour or more at 200° C., the magnetic powder is quenched to 50° C. or lower at a cooling rate of at most 100° C./min.

By treating the series of processes from the evaporation of Fe to the quenching without atmospheric opening, a powder having an oxygen concentration of 10 to 1,000 ppm can be obtained. Some of fluorine atoms move atomic positions of Fe and are disposed at tetrahedral or octahedral interstitial positions of a unit lattice of Fe. Since ammonium fluoride is used, nitrogen and hydrogen, in addition to fluorine, intrude into the Fe grain or the fluoride film. Also carbon, hydrogen or oxygen atoms in the alcohol solution are commingled in the Fe grain or the fluoride film. By aging the quenched powder at 100° C. for 20 hours, a compound of $Sm_{1-2}Fe_{14-20}F_{2-3}$ having a structure in which the $Th_2Zn_{17}$ structure is dilated by the incorporation of fluorine, or a $CaCu_5$ structure grows.

The concentration distribution of fluorine atoms is seen from the surface to the center of the quenched powder; the fluorine concentration is likely to be higher in the periphery side of the quenched powder than the center thereof; the fluorine concentration in the central portion is 0.5 atomic % and the fluorine concentration in the peripheral portion is 9 atomic %; the fluoride in the peripheral portion has a larger unit cell volume or lattice volume than the fluoride in the central portion; and the fluoride in the magnetic powder peripheral portion and the fluoride in the central portion have the similar crystal structure, and a relation of similarity is recognized in some of lattice constants. It is recognized in the $Th_2Zn_{17}$ structure of the central portion having a fluorine concentration of 0.5 atomic % and the $Th_2Zn_{17}$ structure of the peripheral portion having a fluorine concentration of 9 atomic % that the axis a of the $Th_2Zn_{17}$ structure (the central portion having a fluorine concentration of 0.5 atomic %)//the axis a of the $Th_2Zn_{17}$ structure (the peripheral portion having a fluorine concentration of 9 atomic %), or the axis c of the $Th_2Zn_{17}$ structure (the central portion having a fluorine concentration of 0.5 atomic %)//the axis c of the $Th_2Zn_{17}$ structure (the peripheral portion having a fluorine concentration of 9 atomic %), and a compound containing a rare earth element and fluorine, such as $SmF_3$ or SmOF, grows on a part of the powder surface. This powder is compression molded or partially sintered at 500° C. or less so that the difference in the crystal orientation between the central portion of the magnetic powder or crystal grain and the peripheral portion thereof is made 45° or less, to obtain a magnet, whose magnetic characteristics are a residual flux density of 1.3 to 1.5 T, a coercive force of 20 to 30 kOe and a curie point of 480° C., and which can be applied to various types of magnetic circuits such as motors and medical equipment.

Example 4

In the present Example, a fabrication process of a magnetic material in which a $Sm_2Fe_{17}N_3$ magnetic powder and a SmF-based fluoride are used; the fluorine concentration is different between the central portion and the surface and the difference in the crystal orientation is 45° or less in average, and magnetic characteristics of a magnet fabricated thereby will be described.

100 g of a $Sm_2Fe_{17}N_3$ magnetic powder having a grain diameter of 1 to 10 μm and coated with 0.5% by weight of an alcohol solution in which a SmF-based fluoride is swollen is mixed with 100 g of an ammonium fluoride powder having an average grain diameter of 0.1 μm. The mixed powder is charged in a reaction vessel and heated by an external heater. The ammonium fluoride is thermally decomposed by heating, and $NH_3$ and a fluorine-containing gas are generated. Through the fluorine-containing gas, some of N atoms in the magnetic powder start to be displaced with fluorine (F) at 200 to 400° C. In the case of the heating temperature of 300° C., fluorine atoms diffuse while deforming the crystal structure of a parent phase, and a part of N is displaced with F. Since the reaction is carried out at a low temperature, and therefore, the structure of the parent phase before the fluorination is almost maintained in the fluorination, the principal axis directions of the magnetic powder peripheral portion having a high average fluorine concentration and the magnetic powder central portion having a low average fluorine concentration are nearly parallel, and there are observed no crystals whose crystal orientations are different by 45° or more.

$Sm_2Fe_{17}(N, F)_3$ or $Sm_2Fe_{17}(N, F)_2$ grows with the SmOF formation on the powder surface under such conditions. By setting the cooling rate after the retained heating at 1° C./min, some of N and F atoms are regularly arranged. After the completion of the reaction, the vessel interior is replaced by Ar gas for prevention of oxidation. Displacement of F with N dilates the lattice volume of the compound, and the magnetic moment of Fe increases. Some of N or F atoms are disposed at positions different from the interstitial positions before the reaction.

Such a magnetic powder containing $Sm_2Fe_{17}(N, F)_3$ contains 0.5 atomic % of fluorine in the magnetic powder central portion and 12 atomic % thereof in the vicinity of the magnetic powder peripheral portion; and the main phases different in the fluorine content have the similar crystal structure, and the crystal orientations have nearly parallel a axes.

In the case where a crystal grain or magnetic powder could be fabricated such that the difference in the crystal orientation between main phases having different fluorine contents was 45° C. or less in one crystal grain or magnetic powder, magnetic characteristics exhibited a curie point of 400° C. to 600° C., a saturation magnetic flux density of 1.4 to 1.9 T and a coercive force of 20 kOe to 30 kOe. Magnetic powders in which the magnetic moment increases and the coercive force exceeds 20 kOe due to the incorporation of fluorine are other than $Sm_2Fe_{17}N_3$, $Re_lFe_mN_n$ (Re is a rare earth element, and l, m and n are positive integers), $Re_lCo_mN_n$ (Re is a rare earth element, and l, m and n are positive integers), $Re_lMn_mN_n$ (Re is a rare earth element, and l, m and n are positive integers), $Re_lCr_mN_n$ (Re is a rare earth element, and l, m and n are positive integers) and $Re_lMn_mO_n$ (Re is a rare earth element, and l, m and n are positive integers), which have a $CaCu_5$ structure or a tetragonal; and the crystal orientation difference between main phases having different fluorine concentrations and a similar structure in the magnetic powder is 45° C. or less in one crystal grain or magnetic powder, and in order to make the residual flux density 1.6 T or more, and the coercive force 20 kOe or more, the crystal orientation difference is desirably 10° or less.

Such a compound in which some of fluoride atoms are disposed at interstitial positions of a lattice, and the crystal orientation difference between fluoride crystals having different fluorine concentrations can be made 10° or less can be fabricated in, other than a magnetic powder, a thin film, a thick film, a sintered compact or a foil; and even if the crystal grain boundary or magnetic powder surface inside these fluorine-containing ferromagnetic materials contains the growth of an oxy-fluoride containing Re, and oxygen, carbon and hydrogen as impurities and metal elements in the range of not changing the main phase crystal structure, the magnetic characteristics do not largely vary.

Example 5

In the present Example, a fabrication process of a magnetic material in which an amorphous Fe powder and a NdF-based fluoride are used; the fluorine concentration and the nitrogen concentration are different between the central portion and the surface and the difference in the crystal orientation is 45° or less in average, and magnetic characteristics of a magnet fabricated thereby will be described.

After an amorphous Fe powder having an average grain diameter of 0.1 μm is reduced with hydrogen, and oxygen on the surface is removed, the Fe powder is mixed with a NdF-based alcohol solution to form an amorphous NdF-based film on the surface. The average film thickness is 1 to 10 nm. After the Fe powder coated with the amorphous fluoride is mixed with an ammonium fluoride powder, and heated at 200° C. for 100 hours, the mixture is held and aged at 150° C. for 100 hours, whereby it is confirmed that fluorine and nitrogen atoms diffuse from the Fe powder surface, and there are unit lattices anisotropic in fluorine and nitrogen atom arrangements. Some of fluorine and nitrogen atoms are regularly arranged and expand the Fe atomic interval, thereby increasing the magnetic moment of Fe. A part of Fe forms an $Fe_{16}F_2$ phase or an $Fe_8F$ phase as an ordered phase with fluorine. Also a part of Nd diffuses in the Fe powder, and $Nd_2Fe_{17}(N, F)_3$ grows.

A magnetic field is applied to such a powder at 100° C. or lower, and a load of 1 t/cm$^2$ is applied thereto to fabricate a temporarily molded body. The temporarily molded body is subjected to a heat molding under irradiation of an electromagnetic wave in an ammonium fluoride gas, whereby a powder containing a $Th_2Zn_{17}$ structure and a ferromagnetic phase of a tetragonal structure can be sintered.

An anisotropic magnet in which crystal orientations of a magnetic powder have been aligned by a magnetic field before the sintering can be fabricated; although $Nd_2Fe_{17}(N, F)$ in the magnetic powder central portion has a lattice constant different from that of $Nd_2Fe_{17}(N, F)_3$ in the magnetic powder peripheral portion, these have the same crystal structure, and the directions of the axis a and the axis c are nearly parallel in the magnetic powder central portion and the magnetic powder peripheral portion. The magnetic characteristics at 20° C. exhibit a residual flux density of 1.6 T and a coercive force of 25 kOe. At the triple point of the grain boundary after the sintering, cubic NdOF partially grows to decrease the oxygen concentration of the main phase. When the ratio of fluorine and nitrogen is about 1:1, the curie point is 490° C.

Example 6

In the present Example, a fabrication process of a magnetic material in which an amorphous Fe powder and a SmF-based fluoride are used; the fluorine concentration is different between the central portion and the surface and the difference in the crystal orientation is 45° or less in average, and magnetic characteristics of a magnet fabricated thereby will be described.

After an amorphous Fe powder having an average grain diameter of 0.1 μm is reduced with hydrogen, and oxygen on the surface is removed, the Fe powder is mixed with a SmF-based alcohol solution to form an amorphous SmF-based film on the surface. The average film thickness is 20 nm. After the Fe powder coated with the amorphous fluoride is mixed with an ammonium fluoride powder, and heated at 200° C. for 100 hours, the mixture is held and aged at 150° C. for 100 hours, whereby it is confirmed that fluorine and nitrogen atoms diffuse from the Fe powder surface while maintaining the crystal structure, and there are unit lattices anisotropic in fluorine and nitrogen atom arrangements. Some of fluorine and nitrogen atoms are regularly arranged and expand the Fe atomic interval, thereby increasing the magnetic moment of Fe. Also a part of Sm diffuses in the Fe powder, and $Sm_2Fe_{17}(N, F)_{0.1\text{-}3}$ grows accompanied by an oxy-fluoride on the grain boundary or the surface.

A magnetic field is applied to such a powder at 100° C. or lower, and a load of 1 t/cm$^2$ is applied thereto to fabricate a temporarily molded body. After the SmF-based alcohol solution is impregnated, then alcohol contents is dried and removed, the temporarily molded body is subjected to a heat molding under irradiation of an electromagnetic wave in an ammonium fluoride gas, whereby a powder containing a $Th_2Zn_{17}$ structure and a ferromagnetic phase of a tetragonal structure can be sintered.

The magnetic powder is oriented by a magnetic field before the sintering to fabricate an anisotropic magnet, and the magnetic characteristics at 20° C. exhibit a residual flux density of 1.5 T and a coercive force of 30 kOe. A fluorine-rich phase is formed at the grain boundary, and the parent phase contains fluorine and nitrogen. The fluorine concentration in the vicinity of the grain boundary and the surface is about 10 atomic %, and is higher than the fluorine concentration (about 0.1 to 1%) in the grain center; and the lattice constant is likely to be large, and the orientation difference between the axes a of fluoride crystals having different fluorine concentrations is 0 to 15° by an electron beam diffraction pattern. A part of fluorine combines with oxygen to form an oxy-fluoride, thereby decreasing the oxygen concentration inside the Fe powder. When the ratio of fluorine and nitrogen is about 1:1, the curie point is 490° C., and a higher fluorine concentration of the parent phase is likely to give a higher curie point.

Example 7

The present Example is related to obtaining a $Sm_2Fe_{17}F_x$ magnetic powder excellent in magnetic characteristics by fluorination of a $Sm_2Fe_{17}$ magnetic powder using a solution.

100 g of a $Sm_2Fe_{17}$ magnetic powder having a grain diameter of 1 to 20 μm and 10 g of an ammonium fluoride powder are charged in squalane (main component: 2,6,10,15,19,23-hexamethyltetracosane), and the mixed solution is heated at 150° C. under stirring. The ammonium fluoride is thermally decomposed by heating, and the fluorine-containing decomposed product causes F atoms to penetrate and diffuse while the $Sm_2Fe_{17}$ magnetic powder maintains its original crystal structure, to produce $Sm_2Fe_{17}F_x$. Here, x is a positive number of 3 or less. Since the reaction is carried out under stirring in a solution, the dispersion in reaction with the magnetic powder is smaller than a method using a gas.

As a result of an analysis in the depth direction by SIMS of 5 grains randomly taken out, the deviation of the fluorine concentration at 100 nm under the surface of each grain from an average value thereof was 30% or less. Since fluorine was present mainly at interstitial positions of the $Th_2Nip$ structure, and the reaction progressed from the magnetic powder surface, the fluorine concentration at positions nearer the surface of the grain was higher, and in the compositional analysis by wavelength-dispersive X-ray spectroscopy using an electron beam of 100 nm in diameter, the fluorine concentration was 7 atomic % at positions 100 nm inside from the magnetic powder periphery, and 0.5 atomic % in the magnetic powder central portion.

Such an incorporation of fluorine expands the Fe interatomic distance, and increases the magnetic moment. The difference in the crystal orientation between the surface vicinity and the center vicinity was 45° or less in average. Nitrogen and hydrogen originated from $NH_3$ generated by the decomposition of the ammonium fluoride, and carbon and hydrogen originated from the squalane are sometimes present at some of interstitial positions, but these elements also have an effect of expanding the Fe interatomic distance. After the completion of the reaction, the magnetic powder is taken out under a nitrogen gas atmosphere for prevention of oxidation, and adhered squalane is washed with hexane, and the magnetic powder is dried under vacuum.

A magnetic field is applied to the magnetic powder thus obtained without being exposed to the air, and a load of 1 t/cm$^2$ is applied thereto to fabricate a temporarily molded body. The temporarily molded body is compression molded or partially sintered at 500° C. or lower to fabricate an anisotropic magnet in which the direction of the magnetic powder is aligned, and the magnetic characteristics at 20° C. exhibit a residual flux density of 1.5 T and a coercive force of 20 kOe. Examples of compounds usable in fluorination include, in addition to ammonium fluoride, ammonium hydrogen fluoride, ammonium hydrogen fluoride, salts consisting of an amine and hydrogen fluoride, such as triethylamine and pyridine, cesium fluoride, krypton fluoride and xenon fluoride, and on the other hand, liquids usable are, in addition to squalane, alkanes, alkenes and alkynes having 6 or more carbon atoms, carboxylic acids, alcohols, ketones, ethers, amines and perfluoroalkyl ethers.

Example 8

The present Example will describe a process of obtaining a $Sm_2Fe_{17}F_x$ powder utilizable as a magnet raw material by coprecipitating a fluoride containing Fe and Sm in a solution, reducing the fluoride and then fluorinating the resultant.

100 g of ammonium ferric citrate and 13 g of samarium acetate are added to 2 L of deionized water, and stirred to completely dissolve them. 47 g of 46-wt % hydrofluoric acid is added thereto to coprecipitate a fluoride of iron and samarium. The coprecipitation after the dissolution in a solution can provide a precipitate in which iron and samarium are homogeneously mixed, and the grain diameter is 0.05 to 30 μm. After the precipitate is washed with deionized water, the precipitate is dried under vacuum at 300° C., and further mixed with 50 g of metal potassium, and heated at 650° C. for 1 hour under a rare gas atmosphere such as argon, whereby the fluoride precipitate is reduced to make a $Sm_2Fe_{17}$ grain having a $Th_2Zn_{17}$ type crystal structure. 84 g of potassium hydrogen fluoride is further added thereto to fluorinate the residual metal potassium, and the mixture is heated at 300° C. for 1 to 20 hours whereby the $Sm_2Fe_{17}$ powder is fluorinated by decomposed substances of the potassium hydrogen fluoride while the $Th_2Zn_{17}$ type crystal structure is maintained, to produce $Sm_2Fe_{17}F_X$ in which fluorine is disposed at interstitial positions. Here, x is a positive number of 3 or less.

After cooling, the mixture was charged in a 1-wt % potassium hydroxide aqueous solution, and potassium fluoride and potassium hydrogen fluoride were thereby dissolved in water and a $Sm_2Fe_{17}F_x$ powder precipitated. Then, operations of removal of the supernatant solution, addition of deionized water, stirring and precipitation were five times repeated, and the precipitate was washed and dried under vacuum to obtain a $Sm_2Fe_{17}F_x$ powder.

This grain reflects the form of the original precipitated grain and has a spherical shape and a grain diameter of 0.05 to 30 μm, and since fluorine intrudes from the outer side of the grain, the fluorine concentration is high in the surface and low in the central portion. The crystal orientation difference between both the phases is 40° or less in average, and the Fe interatomic distance is more expanded and the magnetic moment is more increased at portions higher in the fluorine concentration. In the present process, an alkaline metal element other than potassium, such as lithium, sodium and cesium, can be used also.

Example 9

The present Example will describe a process of obtaining a NdFeTiF powder utilizable as a magnet raw material by coprecipitating a fluoride containing Fe, Nd and Ti in a solution, reducing the fluoride by ball milling and then fluorinating the resultant.

100 g of ammonium ferric citrate, 9 g of neodymium acetate and 61 g of ammonium citratoperoxotitanate(IV) were added to 2 L of deionized water, and stirred to completely dissolve these. 47 g of a 46-wt % hydrofluoric acid was added thereto to coprecipitate a fluoride containing iron, neodymium and titanium.

Since the precipitate is coprecipitated from the solution homogeneously mixed, the precipitate in which iron, neodymium and titanium are homogeneously mixed can be obtained, and has a grain diameter of 0.05 to 25 μm. After the precipitate is washed with deionized water, the precipitate is dried under vacuum at 200° C., mixed with 25 g of metal sodium, and charged in a vessel with stainless balls, and subjected to ball milling under an inert gas atmosphere such as argon for 1 to 24 hours, whereby the fluoride precipitate is reduced to make $Nd_2Fe_{11}Ti$. 67 g of sodium hydrogen fluoride is further added thereto, and subjected to ball milling at 250° C. for 1 to 20 hours, whereby the residual metal sodium is fluorinated and the $Nd_2Fe_{11}Ti$ is fluorinated while the $Nd_2Fe_{11}Ti$ maintains its crystal structure, to form $Nd_2Fe_{11}TiF$. The fluorine concentration is higher at positions nearer the grain surface, and the incorporation of fluorine dilates the crystal lattice and expands the Fe interatomic distance, thereby increasing the magnetic moment.

After cooling, the mixture is charged in a 1-wt % sodium hydroxide aqueous solution, and sodium fluoride and sodium hydrogen fluoride are thereby dissolved and a $Nd_2Fe_{11}TiF$ powder precipitates on the vessel bottom. Then, operations of removal of the supernatant solution, addition of deionized water and stirring were five times repeated, and the precipitate was washed and dried under vacuum to obtain a $Nd_2Fe_{11}TiF$ powder. The Ti element stabilizes the crystal structure and contributes to the formation of an oxide on the surface and the improvement in corrosion resistance under an atmosphere containing oxygen. Although sodium fluoride has a lower solubility to water than that of potassium fluoride, pulverization by ball milling can compensate for a decrease in the dissolution rate.

Example 10

The present Example will describe a process of obtaining a $Nd_3Fe_{29}F_3$ powder utilizable as a magnet raw material by coprecipitating a fluoride containing Fe and Nd in a solution, reducing the fluoride with calcium, and then fluorinating the resultant by ball milling.

100 g of ammonium ferric citrate and 11 g of neodymium acetate were added to 2 L of deionized water, and stirred to completely dissolve these. 47 g of a 46-wt % hydrofluoric acid was added thereto to coprecipitate a fluoride of iron and neodymium. Thereby, a precipitate in which iron and neodymium are homogeneously mixed is obtained, and has a grain diameter of 0.05 to 30 μm. The precipitate is washed with deionized water, dried under vacuum at 200° C., mixed with 45 g of metal calcium, and heated at 600° C. for 2 hours, whereby the fluoride is reduced to make $Nd_3Fe_{29}$.

After the mixture of the obtained $Nd_3Fe_{29}$, metal calcium and calcium fluoride generated by the reaction with fluorine is pulverized into a grain diameter of 50 μm or less, the pulverized mixture is charged in 300 ml of anhydrous triethylamine tris(hydrogen fluoride), and heated at 80° C. for 1 to 24 hours. Thereby, calcium is dissolved in the triethylamine solution, and the $Nd_3Fe_{29}$ is fluorinated while the $Nd_3Fe_{29}$ maintains the crystal structure to make $Nd_3Fe_{29}F_3$, which precipitates on the vessel bottom. The precipitate is taken out by decantation, washed with deionized water, and dried under vacuum to obtain a $Nd_3Fe_{29}F_3$ powder.

The powder thus obtained reflects the grain diameter of the coprecipitate, and has a grain diameter of 0.05 to 30 μm, and since the fluorination is carried out in a solution, the dispersion in the fluorination rate of each grain is small. The fluorine concentration is high in the surface and low in the central portion, and the difference in the crystal orientation between the both phases is 45° or less in average.

Example 11

The present Example will describe a process of obtaining a composite grain composed of two phases of a $Sm_2Fe_{17}F$ based one and a Fe—F based one by producing $Sm_3Fe_{29}$ using a solution and thermally decomposing the $Sm_3Fe_{29}$.

100 g of ammonium ferric citrate and 11 g of samarium acetate are added to 2 L of deionized water, and stirred to completely dissolve these, and 47 g of a 46-wt % hydrofluoric acid is further added thereto to obtain a coprecipitated product having a grain diameter of 0.5 to 30 μm in which iron and samarium are homogeneously mixed. After the product is washed with deionized water, the product is dried under vacuum at 200° C., mixed with 22 g of metal potassium, and heated at 600° C. for 2 hours, whereby the fluoride is reduced to generate $Nd_3Fe_{29}$. Then, 50 g of potassium hydrogen fluoride is added thereto, and heated at 400° C. for 2 hours, whereby the $Nd_3Fe_{29}$ is thermally decomposed while being fluorinated, to produce a grain composited of $Sm_2Fe_{17}F_3$ and $FeF_X$. Here, X is a positive number of 2 or less. After cooling, the reaction product is charged in a 1-wt % potassium hydroxide aqueous solution to dissolve and remove potassium fluoride and potassium hydrogen fluoride, and washed with water and dried under vacuum to obtain a powder composed of a composite grain of $Sm_2Fe_{17}F_3$ and $FeF_X$.

In the grain obtained by this method, two phases of $Sm_2Fe_{17}F_3$ and $FeF_X$ in nanometer unit contact with each other; the crystal orientation difference between the both is 45° or less in average; and since the $Sm_2Fe_{17}F_3$ having a large magnetic anisotropy exerts the exchange interaction on the $FeF_x$ having a large saturation magnetization, a magnet raw material is made which has a higher coercive force than the case of a simple mixture of two phases.

Example 12

In the present Example, a manufacture method of a bond magnet using the $Sm_2Fe_{17}F_3$ magnetic powder using a solution will be described.

100 g of a $Sm_2Fe_{17}$ powder having a grain diameter of 10 to 100 μm is charged with anhydrous triethylamine tris(hydrogen fluoride) and with alumina balls in a vessel; the interior thereof is displaced by argon gas; and the mixture is subjected to ball milling for 10 hours under heating at 80° C. by an external heater.

The heating and the pulverization by the balls and the reaction with triethylamine tris(hydrogen fluoride) progresses the fluorination of the $Sm_2Fe_{17}$ powder to obtain a fluoride magnetic powder having an average grain diameter of 0.5 to 5 μm. Since the fluorination progresses from the grain surface, whereas $SmFe_{12}F_{1-3}$ is formed in the grain surface, the powder central portion is $Sm_2Fe_{12}F_{0.01-0.1}$, and the crystal orientation difference between the both phases is 45° or less in average. The fluorinated magnetic powder is mixed with a phenol resin as a binder, and molded and solidified in a magnetic field to obtain a bond magnet.

As a binder, either of thermosetting resins and thermoplastic resins can be used, but usable are epoxy resins, fluororesins, silicone resins, polyester resins, polyamide resins, polyimide resins, melamine resins, polyurethane resins, polyvinyl chloride resins, polycarbonate resins, polyacetal resins, liquid crystal polymers, polyphenylene ether resins, polyether ketone resins, polyphenylene sulfide resins, and the like. On the other hand, as an inorganic binder, usable are $SiO_2$ generated by decomposition of a siloxane or silane, and the like.

Since the grain obtained using a solution has even grain diameters than that obtained by pulverization, the grain has a high fluidity, and is easily fluidized even in the case of being kneaded with a resin, thereby being capable of making a bond magnet raw material excellent in moldability.

Example 13

In the present Example, a fabrication method of a $Sm_2Fe_{17}F_3$ powder obtained by fluorinating a magnetic powder using a pressure vessel will be described.

100 g of the $Sm_2Fe_{17}$ magnetic powder having a grain diameter of 1 to 20 μm and 10 g of xenon fluoride were mixed, and charged in an autoclave whose inner wall was coated with a fluororesin, and heated at 200° C. for 24 hours. A fluorine-containing gas was generated by thermal decomposition of xenon fluoride, and reacted with the $Sm_2Fe_{17}$ to produce $Sm_2Fe_{17}F_3$ in which fluorine was positioned at interstitial positions of the crystal lattice. The gas inside the vessel was displaced by argon under heating to volatilize residual xenon fluoride, thereby obtaining a $Sm_2Fe_{17}F_3$ powder as a content.

Since xenon is a rare gas, it has no reactivity with the magnetic powder, so the intrusion of elements other than fluorine can be avoided. The obtained powder has a high fluorine concentration in the surface and a low one in the central portion due to the intrusion of fluorine from the grain surface. The crystal orientations of both the portions exhibit no large difference, and are 15° or less in average.

In the present process, other than xenon fluoride, ammonium fluoride, ammonium hydrogen fluoride, ammonium acid fluoride, salts composed of triethylamine or pyridine and hydrogen fluoride, and krypton fluoride can be used.

Example 14

In order to fabricate a $(Sm_{0.75}Zr_{0.25})(Fe_{0.7}Co_{0.3})_{10}F_{0.1-5}$ magnet, a master alloy of Sm, Zr, Co and iron is melted under vacuum so that the ratio of Sm and Zr becomes 3:1, the atomic ratio of Fe and Co becomes 7:3, and the atomic ratio of $Sm_{0.75}Zr_{0.25}$ and $Fe_{0.7}Co_{0.3}$ becomes 1:10.

After the melting and cooling are repeated several times in order to make the composition of the master alloy homogeneous, the master alloy is remelted and quenched to form a foil piece of about 100 μm in thickness, which is thereafter pulverized in a hydrogen atmosphere. The pulverized powder has an average grain diameter of 1 to 5 μM. The pulverized powder and an ammonium fluoride powder are mixed in an alcohol solvent, charged in a vessel with stainless balls whose surface has been fluorinated for prevention of oxidation and suppression of mingling of impurities, and heated at 100° C. by an external heater to progress ball milling. From the melting and quenching to ball milling and heating and molding were progressed in a hydrogen-containing atmosphere for prevention of oxidation and securing of magnetic characteristics.

The fluorination progresses by the heating and the pulverization by the balls, and the fluorinated magnetic powder having an average grain diameter of 0.5 to 2 μm is formed and crystal grains having a grain diameter of 1 to 30 nm are formed in the powder. As a result of carrying out the ball milling for 100 hours, F (fluorine) diffuses from the powder surface, and a magnetic powder having a $(Sm_{0.75}Zr_{0.25})(Fe_{0.7}Co_{0.3})_{10}F_{0.1-5}$ composition is formed.

The magnetic powder can be formed, without employing the above-mentioned ball milling, by fluorination or a diffusion treatment of fluorine involving mixing the pulverized powder and the ammonium fluoride powder, and subjecting the mixture to a heat treatment at 250° C. for 10 to 100 hours, or by a treatment in which after a solution of a fluoride swollen with an alcohol is coated and dried, fluorine is heat diffused at 200 to 500° C.

The fluorine concentration in the central portion of the powder or crystal grain is lower than that of the fluoride on the outermost periphery, and the ferromagnetic main phase in the vicinity of the powder peripheral side has the $(Sm_{0.75}Zr_{0.25})(Fe_{0.7}Co_{0.3})_{10}F_{1-5}$ composition. The crystal structure of the main phase is a hexagonal; and a fluoride having a higher fluorine concentration than a fluoride in the powder central portion has the same crystal structure as that in the powder or crystal grain central portion and has different lattice volumes, and the high-concentration fluoride has a larger lattice volume than the low-concentration fluoride.

In one crystal grain inside the magnetic powder, it was confirmed by electron beam diffraction images by an electron microscope that the difference in the axis direction of the axis c or axis a of the fluoride having a hexagonal structure was 45° or less between the central portion and the peripheral portion. At a part of the grain boundary inside the magnetic powder and the magnetic powder outermost periphery, there grow cubic, monoclinic, rhombohedral or tetragonal fluorides or oxy-fluorides having crystal structures different from the main phase. The magnetic characteristics of the magnetic powder depend on the crystal structure, the lattice dilation due to intrusion of an element such as fluorine, the crystal grain diameter, the powder shape, the compositional distribution of fluorine in the magnetic powder and the crystal grain, the crystal orientation in the crystal grain, the crystal orientation distribution in the powder, the hetero-phase growth, and the like.

The magnetic characteristics of one grain of a magnetic powder fabricated by changing the ball milling condition and the pulverization condition and having a powder diameter of 0.1 to 200 μm exhibit magnet physical property values of a saturation magnetic flux density of 1.4 to 2.0 T, a residual flux density of 0.9 to 1.6 T, an anisotropic magnetic field of 5 to 100 kOe and a curie point of 330 to 630° C. Such a powder has a plurality of crystal grains in the powder due to the quenching process; and the average fluorine concentration is different between the periphery and the center of the powder, and the peripheral side has a higher fluorine concentration, and the fluorine concentration in the main phase is higher in the peripheral side. The peripheral side refers to a main phase crystal grain of the first one from the outermost surface toward the central portion of the powder, and is not a fluoride or oxy-fluoride having a crystal structure different from that of the outermost peripheral main phase. The central portion refers to a crystal grain at the near center of the outermost peripheral surfaces facing each other of the cross-section of the powder. In the case where a main phase crystal grain is one powder, the peripheral side refers to a position by one lattice inside from a peripheral side of the main phase crystal grain, and the central portion refers to a lattice position of a central portion of the outermost peripheral surfaces facing each other.

A high-performance magnet can be manufactured from a powder, having the above-mentioned magnetic physical properties, whose magnetic characteristics, the powder diameter, the compositional distribution and the crystal orientation distribution, are properly provided. The magnetic powder in which the dispersion in the crystal orientation in the crystal grain is 45° or less, and the average fluorine concentration of the whole magnetic powder is 1 to 30 atomic % is molded at a magnetic field of 10 kOe and at a pressure of 1 t/cm$^2$, and thereafter, subjected to a rapid heat compression molding at 400° C. and 10 t/cm$^2$. Some of fluorides of the magnetic powder surface cohere with each other due to the heat molding to obtain a block body in which the volume occupied in the whole fluorinated magnetic powder is 90 to 99%. After the block body is aged at a temperature equal to or less than the molding temperature, and quenched, magnet characteristics were confirmed by impressing a magnetic field of 25 kOe in the anisotropic direction, and were a residual flux density of 1.9 T, a coercive force of 25 kOe, and a curie point of 620° C.

Since the $(Sm_{0.75}Zr_{0.25})(Fe_{0.7}Co_{0.3})_{10}F_{0.1-5}$ magnet exhibiting the above-mentioned characteristics involves the diffusion of fluorine, the fluorine concentration is different between the crystal grain boundary and the crystal grain central portion. The fluorine concentration is high in the vicinity of the crystal grain boundary, and low in the crystal grain central portion, and a concentration difference of 0.01 atomic % or more is recognized. The fluorine concentration difference can be confirmed by wavelength-dispersive X-ray spectrometer, energy loss analysis, or a mass spectrometer.

Magnet characteristics nearly equal to the residual flux density of 1.9 T, the coercive force of 25 kOe and the curie point of 620° C. as seen in the present Example can be acquired by fluorides, other than $(Sm_{0.75}Zr_{0.25})(Fe_{0.7}Co_{0.3})_{10}F_{0.1-5}$, such as $(Sm_{0.75}Zr_{0.24}Cu_{0.01})(Fe_{0.7}Co_{0.3})_{10}F_{0.1-5}$ and $(La_{0.75}Zr_{0.25})(Fe_{0.7}Co_{0.3})_{10}F_{0.1-5}$; and with a rare earth element denoted as RE, at least one transition metal element excluding iron and a rare earth element denoted as M, and fluorine as denoted as F, $$RE_X(Fe_SM_T)_YF_Z+RE_U(Fe_SM_T)_VF_W$$

(wherein X, Y, Z, S, T, U, V and W are positive numbers) exhibits the magnetic characteristics when X<Y, Z<Y, S>T, U<V, W<V and Z<W; and the $RE_X(Fe_SM_T)_YF_Z$ of the first term is a fluoride in the crystal grain central portion or the magnetic powder central portion, and the $RE_U(Fe_SM_T)_VF_W$ of the second term is a fluoride in the vicinity of the crystal grain boundary or in the magnetic powder surface portion.

In order to make the residual flux density 1.8 T or more, it is needed that X<Y/10, Z<3, Z<Y/4, T<0.4 and S>T, that the transition metal element contains Co, and that the volume fraction of the above-mentioned fluorides and oxy-fluorides exhibiting no ferromagnetism other than the main phase is suppressed to 0.01 to 10% with respect to the main phase having a cubic, rhombohedral, body-centered tetragonal or hexagonal structure; and compounds, which have different fluorine concentrations and at least uniaxial directions of which are nearly parallel, have grown in the main phase.

The formation of a fluoride or oxy-fluoride and main phases nearly parallel in the axis directions and having different fluorine concentrations are inevitable for securing magnet characteristics to enhance the structural stability. The reactive ball milling process or reactive mechanical alloying process in the present Example is applicable to the fluorination treatment of every powder material. That is, the interior of a vessel is heated by heating temperature conditioning capable of heating at a higher temperature than 20° C.; a powder or a gas containing fluorine is filled in the vessel to give reactivity; and by combining a mechanical reaction by balls (nascent surface formation, pulverization, activation of abraded portions, and the like) with a chemical reaction and a diffusive reaction, fluorination progresses at a relatively low temperature (50° C. to 500° C.).

This means can be applied not only to rare earth/iron/fluorine-based magnetic materials but also to rare earth/cobalt/fluorine-based or manganese/iron/fluorine-based magnetic materials, and parent phases having different fluorine concentrations and parallel axis directions grow, thereby obtaining a high coercive force. With fluorine, Si, B, H, C, O, N or Al as another light element, or another halogen element such as chlorine may be contained.

In the case of fluorides containing no rare earth element, fluorides of at least two compositions are formed in a magnetic powder or crystal grain, and some of fluorine atoms are disposed at interstitial positions of iron or at least one transition metal element other than iron; and the fluorides are represented by the following composition formula.

$$(Fe_SM_T)_YF_Z+(Fe_UM_V)_WF_X$$

wherein M denotes at least one transition metal element other than iron, and F denotes fluorine; S, T, Y, Z, U, V, W and X are positive numbers; the $(Fe_SM_T)_YF_Z$ of the first term corresponds to a composition of the central portion of the magnetic powder or crystal grain, and the $(Fe_UM_V)_WF_X$ of the second term corresponds to a composition of the peripheral portion of the magnetic powder or crystal grain; and Z<Y, X<W and Z<X. In order to raise the magnetic flux density, desirably S>T and U>V; and in order to obtain a high coercive force of 1 kOe to 20 kOe at 20° C., there are made conditions that the angle between the axis a of the $(Fe_SM_T)_YF_Z$ and the axis a of the $(Fe_UM_V)_WF_X$ is ±30° or less in average, and the angle between the axis c of the $(Fe_SM_T)_YF_Z$ and the axis c of the $(Fe_UM_V)_WF_X$ is ±30° or less in average. The main phase of these fluorides is a complex compound containing hydrogen, oxygen, carbon, nitrogen, boron, silicon and the like in amounts not damaging the crystal structure of the main phase, and the concentration differences in these light elements may occur between the grain boundary and the grain interior.

Example 15

In order to fabricate a $(Nd_{0.8}Ti_{0.2})(Fe_{0.7}Co_{0.3})_{10}F_{0.1-5}$ magnet, a master alloy of Nd, Ti, Co, and iron is melted under vacuum so that the atomic ratio of Nd and Ti becomes 4:1, the atomic ratio of Fe and Co becomes 7:3, and the atomic ratio of $Nd_{0.8}Ti_{0.2}$ and $Fe_{0.7}Co_{0.3}$ becomes about 1:10.

After the melting and cooling are repeated several times in order to homogenize the composition of the master alloy, the composition is again melted and quenched to form a foil piece of about 20 μm in thickness, which thereafter is pulverized in a hydrogen atmosphere. The pulverized powder has an average powder diameter of 1 to 10 μm.

The pulverized powder and an ammonium fluoride powder are mixed in an alcohol solvent, charged in a vessel with stainless balls whose surface is fluorinated for prevention of oxidation and suppression of impurity commingling, and subjected to ball milling while heated at 150° C. by an external heater.

From the melting and quenching to ball milling, heating and molding were progressed in a hydrogen-containing atmosphere in order to prevent oxidation and secure magnetic characteristics. Fluorination progresses by the heating and the pulverization by the balls, and a fluorinated magnetic powder having an average powder diameter of 0.5 to 2 μm is formed and crystal grains having a grain diameter of 1 to 100 nm is formed in the powder.

As a result of carrying out the ball milling for 100 hours, F (fluorine) diffuses from the powder surface, and a magnetic powder having a composition of $(Nd_{0.8}Ti_{0.2})(Fe_{0.7}Co_{0.3})_{10}F_{0.1-5}$ is formed. Without employing the above-mentioned ball milling, the fluorination or the diffusion treatment of fluorine may be carried out by mixing the pulverized powder and the ammonium fluoride powder, and subjecting the mixture to a heat treatment at 250° C. for 10 to 100 hours.

The central portion of the powder or crystal grain has a low fluorine concentration and also an averagely low Nd concentration, and the main phase in the vicinity of the peripheral side of the powder has a composition of $(Nd_{0.75}Ti_{0.25})(Fe_{0.7}Co_{0.3})_{10}F_{1-5}$. The crystal structure of the main phase is a hexagonal one, or a mixture of a hexagonal one with a cubic one, tetragonal, orthorhombic, monoclinic or rhombohedral one; and fluorides having a higher fluorine concentration than fluorides in the powder central portion have a crystal structure having a similarity with that in the powder or crystal grain central portion, and have a different lattice volume therefrom, and the high-concentration fluorides have a larger lattice volume than the low-concentration fluorides.

In one crystal grain in the magnetic powder, it was confirmed by electron beam diffraction images by an electron microscope that the difference in the axis direction of the axis c or axis a of a fluoride having a hexagonal structure was 45° or less between the crystal grain central portion and peripheral portion.

Fluorides or oxy-fluorides having a cubic, orthorhombic, rhombohedral, cubic or monoclinic crystal structure which is different from that of the main phase grow at a part of grain boundaries inside the magnetic powder and the outermost periphery of the magnetic powder, and a rare earth element diffuses to the part of the peripheral side of the crystal grains and powder, so that in the power or crystal grain central portion, the concentration gradient of the rare earth element is likely to become large due to the fluorination, and α-Fe, which has low concentrations of the rare earth element and fluorine, grows.

The magnetic characteristics of the magnetic powder depend on the crystal structure, the lattice dilation due to intrusion of an element such as fluoride, the crystal grain diameter, the powder shape, the compositional distribution of fluorine in the magnetic powder and the crystal grain, the crystal orientation in the crystal grain, the crystal orientation distribution in the powder, the hetero-phase growth, and the like.

The magnetic characteristics of one grain of a magnetic powder fabricated by changing the ball milling condition and the pulverization condition, the heating and aging treatment condition and having a powder diameter of 0.1 to 200 μm exhibit magnet physical property values of a saturation magnetic flux density of 1.4 to 2.1 T, a residual flux density of 0.9 to 1.7 T, an anisotropic magnetic field of 20 to 100 kOe and a curie point of 400 to 650° C.

Such a powder has a plurality of crystal grains in the powder due to the quenching process; and the average fluorine concentration is different between the periphery and the center of the powder, and the peripheral side has a higher fluorine concentration, and the fluorine concentration in the main phase is higher in the peripheral side. The peripheral side refers to the first crystal unit lattice from the outermost surface toward the central portion of the powder, and is not a fluoride or oxy-fluoride having a crystal structure different from that of the outermost peripheral main phase. The central portion refers to a crystal grain at the near center of the outermost peripheral surfaces facing each other of the cross-section of the powder. In the case where a main phase crystal grain is one powder, the peripheral side refers to a position by one lattice inside from a peripheral side of the main phase crystal grain, and the central portion refers to a lattice position of a central portion of the outermost peripheral surfaces facing each other.

A high-performance magnet can be manufactured from a powder, having the above-mentioned magnetic physical properties, whose magnetic characteristics, the powder diameter, the compositional distribution and the crystal orientation distribution, are properly provided. The magnetic powder in which the dispersion in the crystal orientation in the crystal grain is 45° or less, and the average fluorine concentration of the whole magnetic powder is 0.1 to 20 atomic % is molded at a magnetic field of 10 kOe and at a pressure of 1 t/cm$^2$, and thereafter, subjected to a rapid Ohmic compression molding at 400° C. and 1 t/cm$^2$. Some of fluorides of the magnetic powder surface cohere with each other due to the Ohmic heat molding to obtain a block body in which the volume occupied in the whole fluorinated magnetic powder is 90 to 99%. After the block body is aged at a temperature equal to or less than the molding temperature, and quenched, magnet characteristics were confirmed by impressing a magnetic field of 25 kOe in the anisotropic direction, and were a residual flux density of 1.9 T, a coercive force of 20 kOe, and a curie point of 610° C.

Since the $(Nd_{0.8}Ti_{0.2})(Fe_{0.7}Co_{0.3})_{10}F_{0.1\text{-}5}$ magnet exhibiting the above-mentioned characteristics involves the diffusion of fluorine, the fluorine concentration in the main phase is different between the crystal grain boundary and the crystal grain central portion. The fluorine concentration is high in the vicinity of the crystal grain boundary, and low in the crystal grain central portion, and a concentration difference of 0.01 atomic % or more is recognized by EPMA analysis. The fluorine concentration difference can be confirmed by wavelength-dispersive X-ray spectrometer, energy loss analysis, or a mass spectrometer.

Magnet characteristics nearly equal to the residual flux density of 1.9 T, the coercive force of 25 kOe and the curie point of 620° C. as seen in the present Example can be acquired by, other than $(Nd_{0.8}Ti_{0.2})(Fe_{0.7}Co_{0.3})_{10}F_{0.1\text{-}5}$, ferromagnetic fluorides containing a rare earth element and iron; and with a rare earth element denoted as RE, at least one transition metal element excluding iron and a rare earth element denoted as M and fluorine as denoted as F, $$RE_X(Fe_SM_T)_YF_Z+RE_U(Fe_SM_T)_VF_W$$

(wherein X, Y, Z, S, T, U, V and W are positive numbers) exhibits the magnetic characteristics when X<Y, Z<Y, S>T, U<V, W<V and Z<W; and the $RE_X(Fe_SM_T)_YF_Z$ of the first term is a fluoride in the crystal grain central portion or the magnetic powder central portion, and the $RE_U(Fe_SM_T)_VF_W$ of the second term is a fluoride in the vicinity of the crystal grain boundary or in the magnetic powder surface portion.

In order to make the residual flux density 1.8 T or more, it is needed that X<Y/10, Z<3, Z<Y/4, T<0.4 and S>T, that the transition metal element contains Co, and that the volume fraction of the above-mentioned fluorides and oxy-fluorides exhibiting no ferromagnetism other than the main phase is suppressed to 0.01 to 20% with respect to the main phase having a cubic, rhombohedral, body-centered tetragonal, monoclinic or hexagonal structure; and compounds, which have different fluorine concentrations and at least one axis directions of which are nearly parallel, have grown in the main phase. The formation of a fluoride or oxy-fluoride and main phases nearly parallel in the axis directions and having different fluorine concentrations are inevitable for securing magnet characteristics to enhance the structural stability.

The reactive ball milling process or reactive mechanical alloying process in the present Example is applicable to the fluorination treatment of every powder material. That is, the interior of a vessel is heated by heating temperature conditioning capable of heating at a higher temperature than 20° C.; a powder or a gas containing fluorine is filled in the vessel to give reactivity; and by combining a mechanical reaction by balls (nascent surface formation, pulverization, activation of abraded portions, and the like) with a chemical reaction and a diffusive reaction, fluorination progresses at a relatively low temperature (50° C. to 500° C.). This means can be applied not only to rare earth/iron/fluorine-based magnetic materials but also to rare earth/cobalt/fluorine-based or manganese/iron/fluorine-based magnetic materials, and parent phases having different fluorine concentrations and parallel axis directions grow, thereby obtaining a high coercive force. With fluorine, Si, B, H, C, O, N or Al as another light element, or another halogen element such as chlorine may be contained.

In the case of fluorides containing no rare earth element, fluorides of at least two compositions are formed in a magnetic powder or crystal grain, and some of fluorine atoms are disposed at interstitial positions of iron or at least one transition metal element other than iron; and the fluorides are represented by the following composition formula.

$$(Fe_SM_T)_YF_Z+(Fe_UM_V)_WF_X$$

wherein M denotes at least one transition metal element other than iron, and F denotes fluorine; S, T, Y, Z, U, V, W and X are positive numbers; the $(Fe_SM_T)_YF_Z$ of the first term corresponds to a composition of the central portion of the magnetic powder or crystal grain, and the $(Fe_UM_V)_WF_X$ of the second term corresponds to a composition of the peripheral portion of the magnetic powder or crystal grain; and Z<Y, X<W and Z<X. In order to raise the magnetic flux density, desirably S>T and U>V; and in order to obtain a high coercive force of 1 kOe to 20 kOe at 20° C., there are made conditions that the angle between the axis a of the $(Fe_SM_T)_YF_Z$ and the axis a of the $(Fe_UM_V)_WF_X$ is ±30° or less in average, and the angle between the axis c of the $(Fe_SM_T)_YF_Z$ and the axis c of the $(Fe_UM_V)_WF_X$ is ±30° or less in average. The main phase of these fluorides is a complex compound containing hydrogen, oxygen, carbon, nitrogen, boron, silicon and the like in amounts not damaging the crystal structure of the main phase, and the concentration differences in these light elements may occur between the grain boundary and the grain interior.

The fluoride or oxy-fluoride having a fluorine concentration of 30 atomic % to 80 atomic % in the peripheral side of the main phase contains 0.1 to 10 atomic % of iron or a transition metal other than a rare earth element, and 0.2 to 20 atomic % of a rare earth element, and the composition and crystal structure thereof vary by heating nearly to the curie point of the main phase. The fluoride or oxy-fluoride having grown as a metastable phase at a temperature equal to or lower than the curie point of the main phase exhibits superconductivity, and can be used as a superconductive magnet.

Example 16

A SmFe-based powder is fabricated, and the saturation magnetization, the anisotropic magnetic field and the curie point as fundamental physical properties of a magnet are improved by the fluorination treatment.

Sm, Zr, Fe and Co raw materials are weighed, and after $(Sm_{0.8}Zr_{0.2})(Fe_{0.7}Co_{0.3})_{10}$ is melted under vacuum, the molten metal is quenched in Ar gas using a Cu roll rotating at a speed of 40 m/s to obtain a ribbon. In this ribbon, a metastable phase is formed by the quenching, and although the crystal structure and the grain diameter of the metastable phase vary by a heat treatment at 100° C. to 500° C., in the ribbon, a foil body or a powder as it is quenched, grains having an average grain diameter of 1 to 100 nm have grown, and the ribbon is pulverized to a powder diameter of 200 μm without being exposed to the air; and a nano-grain film having a composition of $PrF_3$ and an average thickness of 1 to 500 nm is formed on the outer side of the powder by a solution treatment. The average grain diameter of the nano-grain film is 1 to 50 nm, and in the interface between the $(Sm_{0.8}Zr_{0.2})(Fe_{0.7}Co_{0.3})_{10}$ powder and the $PrF_3$ nano-grain film, fluorine, iron and cobalt easily diffuse mutually at a low temperature of 500° C. or lower.

After the formation of the nano-grain film, the nano-grain film is heated in a reductive atmosphere or in a vacuum in a temperature range of 300 to 800° C., held at the temperature for 1 to 5 hours after heating, and quenched. The heating and quenching treatment carries out fluorination, and simultaneously controls the composition and structure to improve magnetic physical properties. That is, fluorine diffuses along grain boundaries of the powder or various types of defects, and enters the parent phase, and the Sm or Fe element simultaneously diffuses from the main phase to the Pr—F film of the powder outer side. A part of oxygen in the main phase also diffuses to the Pr-f film; and in the vicinity of the central portion of the cross-section of the powder or crystal grain, a FeCo-based alloy phase or a $Fe_{0.7}Co_{0.3}$ phase having a low Sm concentration of 5 atomic % or less is formed; in the outer side thereof, $(Sm_{0.8}Zr_{0.2})(Fe_{0.7}Co_{0.3})_{10}$ and $(Sm_{0.8}Zr_{0.2})(Fe_{0.7}Co_{0.3})_{10}F_{0.1\text{-}3}$ grow; and in the outer side of these phases or on the peripheral side, fluorides or oxy-fluorides having a fluorine concentration of 15 to 80 atomic %, such as $(Sm, Pr, Fe)F_2$, $(Sm, Pr, Fe)F_3$, $(Sm, Pr, Fe, Co)F_2$, $(Sm, Pr, Fe, Co)F_3$, (Sm, Pr, Fe, Co) OF, or (Sm, Pr, Fe, Co)OF, are formed.

The magnetic characteristics of such a powder were a saturation magnetization of 170 emu/g, an anisotropic magnetic field of 50 kOe and a curie point of 852K. The values of the magnetic characteristics are raised due to the fluorination; the FeCo-based alloy phase or the $Fe_{0.7}Co_{0.3}$ phase contributes to an increase in the magnetization; the $(Sm_{0.8}Zr_{0.2})(Fe_{0.7}Co_{0.3})_{10}F_{0.1\text{-}3}$ increases the anisotropy energy, and raises the curie point; and since an exchange coupling acts between these ferromagnetic phases, the residual magnetization also increases.

In order to make the fluorination further progress to improve magnetic characteristics, fluorination using a gas produced by decomposition of ammonium fluoride was attempted after the above-mentioned heating and quenching. As a result of mixing the magnetic powder with an ammonium fluoride powder of the same weight as that of the magnetic powder, and heating the mixture in the temperature range of 200 to 500° C. for 5 hours, and quenching, a magnet is obtained whose magnetic characteristics are a saturation magnetization of 190 emu/g, an anisotropic magnetic field of 60 kOe, a curie point of 892K, and an energy product, (BH), of 10 to 30 MGOe. It was confirmed that in the magnetic powder, there grew an Fe—Co alloy phase having a body-centered cubic structure or a body-centered tetragonal structure, a $TbCu_7$ phase, and fluorides and oxy-fluorides having a fluorine concentration of 30 to 80% and a crystal grain diameter of 1 to 100 nm.

The Fe and the Fe—Co alloy phase having a body-centered cubic structure or a body-centered tetragonal structure grown by the fluorination treatment using ammonium fluoride are in direct contact with the $TbCu_7$ phase, and some of interfaces make a matching interface, so the ferromagnetic exchange coupling works; therefore, the residual flux density increases. In order to develop such an exchange coupling, enhancement of the lattice matching between body-centered cubic or body-centered tetragonal and the $TbCu_7$ phase is effective; and the angular dispersion in the principal axis direction of each crystal is desirably small, and the angular dispersion is desirably ±30° or less.

The above-mentioned magnet having an energy product of 10 to 30 MGOe is constituted of a high-magnetization phase composed of Fe and the Fe—Co alloy phase having a body-centered cubic structure or a body-centered tetragonal structure, a high-magnetic anisotropy phase composed of compounds which have a $TbCu_7$, $Th_2Zn_{17}$ or $ThMn_{12}$ structure and in which fluorine atoms, fluorine and nitrogen, fluorine and hydrogen, fluorine and carbon, fluorine and oxygen or fluorine and boron intrude, and cubic, hexagonal, orthorhombic or rhombohedral fluorides and oxy-fluorides having a higher fluorine concentration than the above-mentioned fluorine-interstitial compounds; and the exchange coupling of a part of the high-magnetization phase and a part of the high-magnetic anisotropy phase magnetically restricts part of the magnetization of the high-magnetization phase by the high-magnetic anisotropy phase, and the magnet exhibits higher magnetic characteristics than SmZrFeCoN-based magnets, which are nitrogen-interstitial compounds.

The reason of exhibiting higher magnetic characteristics than nitrogen-interstitial compounds is as follows. 1) Since the fluorine atom has a higher electronegativity than the nitrogen atom, the magnetic moment of an iron or cobalt atom by localization of electrons is raised. Further since the electronic density of states or the distribution of charges by the localization of electrons causes a deviation, the anisotropy energy increased. Hence, the saturation magnetization and the residual magnetization increase, and a maximum of 70 MGOe thereof can be obtained by control of the composition, texture and structure. 2) With the diffusion of fluorine by the fluorination, diffusion of a rare earth element progresses, and simultaneously with the formation of fluorine-interstitial compounds, the ferromagnetic exchange coupled phase rich in iron or in iron and cobalt is formed by contact with the fluorine-interstitial compounds. Generation of a compositional modification of the rare earth element by the fluorination causes a rise in magnetic characteristics. 3) Fluorides and oxy-fluorides grow on a part of the powder peripheral side or the crystal grain boundary by the fluorination, and since these compounds have reductive action, oxygen as an impurity in the crystal grain is removed and the magnetization is increased. The reductive action removes minute oxides, decreases magnetization reversion sites caused oxygen-rare earth coupling and oxygen-iron coupling, and cleaning exchange coupled interfaces, whereby magnetic characteristics are improved and the thermal decomposition of fluorine-interstitial compounds is suppressed. Further, the growth of fluorides by excessive fluorination can decrease the average grain diameter by pulverization of the powder, and an anisotropic powder can be fabricated by pulverization using fluorine. 4) A change in the texture or structure due to the diffusion of fluorine causes the magnetic anisotropy to be developed. 5) The control of the charge distribution by the incorporation of fluorine and the addition of an element having a smaller electronegativity than iron causes physical properties of the magnet to be improved. For the reasons from 1) to 5), the magnetic characteristics are more improved than for nitrogen-interstitial compounds, and the use amount of a rare earth element can be reduced.

Example 17

Fe and Co pieces having a purity of 99.8% or higher are weighed, and melted under vacuum to fabricate an Fe-30 atomic % Co alloy. Vacuum deposition is carried out using the alloy as a vapor deposition source. A glass is used as a substrate, and patterns are formed of a resist on the glass substrate. An Fe-30 atomic % Co alloy film is formed on the resist by vacuum deposition. The temperature of the substrate is 100° C., and the degree of vacuum is 1 to $0.1\times10^{-5}$ Torr. The patterns are 12 nm×105 nm, and the portions excluding the alloy deposited in the rectangular patterns are removed by milling to leave only the films of the alloy deposited in the 12 nm×105 nm. The film thickness is 10 nm.

Before peeling the resist, an alcohol solution not containing crystal grains of $MgF_2$ containing 0.1 atomic % of Co swollen with the alcohol is applied, and heated at 200° C., whereby a $MgF_2$-0.1% Co film can be formed even in the interface of the resist and the alloy film, so that flat ribbons are formed in which the $MgF_2$-0.1% Co film of about 1 nm in thickness is adhered on the periphery of the 10×100×10 nm Fe-30% Co alloy.

The ribbons are mixed in an alcohol solution, and charged in a metal mold to which a magnetic field can be applied; and molding is carried out at an application of a magnetic field of 10 kOe and at a load of 0.5 t/cm$^2$ to make the 100-nm direction of the Fe-30% Co alloy averagely parallel with the magnetic field direction. At this time, since the crystal structure of the $MgF_2$-0.1% Co film is in a metastable state, Co added in the fluoride solution is arranged in the magnetic field direction by the application of the magnetic field, and is distributed unevenly at the interface with the Fe-30% Co alloy. This is because Co in the fluoride solution behaves ferromagnetically, and Co having a lowly dimensional shape in which Co atoms in the fluoride are linked together in a cluster form or a network form and having magnetic anisotropy adhere to the interface with the Fe-30% Co alloy, thereby increasing the magnetic anisotropy energy.

After the solvent is heated and removed from the above-mentioned molded body, the molded body is further molded at 300° C. and a load of 2 t/cm$^2$ to obtain a molded body of 98% in density. In the molded body, the Fe-30% Co ribbons are averagely parallelly arranged with the magnetic field application direction, and are coated with the fluoride film on the ribbons; and the c axes of Co grains are arranged nearly parallelly with the magnetic field direction in the fluoride side in the vicinity of the interface of the fluoride and the Fe-30% Co ribbons.

The shape magnetic anisotropy of the Fe-30% Co ribbon and the uniaxial magnetic anisotropy of the Co grains act in nearly the same direction, thereby developing a high magnetic anisotropy energy. The average size of the ribbon is 10×100×10 nm, and has a high size precision because of being formed through a photolithographic process, with 90% of the ribbons having a size precision within of ±20%; and a material is made whose composition is modulated according to periods of the major axis and the minor axis of the ribbon size. The ribbon corner portion may be circular.

Setting the volume fraction of the Fe-30% Co alloy occupied in the molded body at 80% and setting that of the fluoride containing the Co grains at about 20% can confirm a residual flux density of 1.7 T and a coercive force of 11 kOe at 20° C. In order to make the coercive force exceed 10 kOe, Co grains of about 1 nm in grain diameter formed from the fluoride solution are needed, and the coercive force in the case of no Co grain is 3 kOe, and the demagnetization easily occurs. If Co grains of 2 to 20 nm in grain diameter are in the range of 0.05 to 10%, an effect of increasing the coercive force can be acquired, and makes a coercive force of 5 kOe or higher. In the case of the Co grains in the range of 10% or more, the Co grains are liable to aggregate, are hardly arranged in a lowly dimensional manner, and are liable to link the Fe-30% Co alloy ribbons with the Co grains, whereby since the $MgF_2$ film between the ribbons becomes discontinuous, the coercive force hardly increases.

As combinations similar to the present Example satisfying the residual flux density of 1.5 T or more and the coercive force of 5 kOe or more, in place of the Fe-30% Co alloy, alloys such as Fe-0 to 40% Co and Fe-0 to 30% Co-0 to 20% Ni, and alloys in which various types of transition metal elements are added in the concentration of 10 atomic % or less to the former alloys can be applied; in place of the Co grain, rare earth/cobalt-based or rare earth/iron-based alloys containing a rare earth element in a concentration of 20 atomic % or less, ferromagnetic grains having uniaxial magnetic anisotropy and having a diameter of 1 to 3 nm such as a NiAlCo alloy-based grain and a MnAl alloy-based grain, and ferrimagnetic and antiferromagnetic grains such as a FeMn-based grain, a NiNn-based grain, iron oxide and iron fluoride can be used; and with respect to the ribbon size, it is needed for the coercive force of 5 kOe or more that the ratio of the minimum size and the maximum size is 5 or more, and desirably 10 to 100 in the size of length, width and height in the range of 1 to 100 nm×10 to 10,000×1 to 1,000 nm, and the above-mentioned composition having ferromagnetism is modulated according to the period near the ribbon size.

The ratio of the maximum concentration and the minimum concentration (for example, a value of the maximum Fe concentration divided by the minimum Fe concentration) of the modulated composition is 2 to 10,000; and for elements constituting ferromagnetism other than Fe, the ratio is desirably 1.5 to 50,000, and in order to develop a coercive force of 5 kOe or more, the ratio is desirably 10 or more. Even if these ferromagnetic grains are contained and light elements and metal impurities such as oxygen, nitrogen, hydrogen, carbon and boron are contained on the grain surface or grain boundary, if the concentration of light elements is 1,000 ppm or less and the concentration of the metal elements is 1% or less, magnetic characteristics are not largely decreased, and even if minute amounts of these light elements and metal elements are distributed unevenly and the composition is modulated, there arises no problem.

Example 18

Fe and Co metal lumps having an oxygen concentration of 200 ppm or less are weighed, and melted in an argon gas. The melted Fe-30% alloy is placed on a vapor deposition source heater of a vacuum deposition apparatus, and heated and evaporated. A Fe-30% Co alloy grain having a grain diameter of about 10 nm is fabricated from a discontinuous film composed of an Fe-30% alloy crystal grain on a substrate cooled to 20° C., and charged in an alcoholic solvent. A solution in which $MgF_2$-1% Co is swollen with the alcoholic solvent and ammonium fluoride ($NH_4F$) are mixed, and a film composed of a metastable crystal structure of $MgF_{2+\alpha}$-1% Co, whose fluorine is oversaturated is formed on the Fe-30% Co alloy grain surface.

The Fe-30% Co alloy grain to which the alcoholic solvent and together the $MgF_{2+\alpha}$-1% Co film are adhered is charged in a metal mold to which a magnetic field can be applied, and the grain is pressurized at an application of a magnetic field of 10 kOe and a pressure of 1 t/cm$^2$. The solvent is discharged from gaps of the metal mold simultaneously with the pressurization, and a molded body of a magnetic field-oriented $MgF_{2+\alpha}$-1% Co film-adhered Fe-30% Co alloy grain is obtained.

The molded body is heat molded while not being exposed to the air, whereby the spherical Fe-30% Co alloy grain is deformed to a flat form, and Co grains having a grain diameter of about 1 nm whose c axes are aligned in the magnetic field direction are coated on the flat grain of the ratio of the minor axis length and the major axis length of 1:5. The heat molding is carried out under the condition of 500° C. and 1 t/cm$^2$; and during the heating, a part of Co or the Fe-30% Co alloy grain is fluorinated by the decomposition reaction of ammonia fluoride to make Co or an Fe-30% Co grain having a fluorine concentration of 0.1 to 10 atomic %.

In the molded body after the heat molding, the surface of Fe-30% Co-0.2% F grains is coated with Co-0.1% F grains whose c axes are oriented, and on its outer side, a $MgF_X$ (X=1.5 to 2.5) layer is formed; when the volume fraction of the Fe-30% Co-0.2% F grain is 80%, the volume fraction of the Co-0.1% F grain is 15%, and the $MgF_X$ (X=1.5 to 2.5) layer is 5%, the residual flux density becomes 1.7 T, and the coercive force becomes 12 kOe.

The heat molded body is nearly equal to a composition-modulated body constituted mainly of three phases of Fe-30% Co-0.2% F, Co-0.1% F and $MgF_X$ (X=1.5 to 2.5). That is, the molded body is a ferromagnetic body in which the concentration distributions of Fe and Co are regularly or periodically modulated; the modulation period is constituted of a plurality of periods, and the period components contain the crystal grain diameter and the width of a fluorine-containing grain boundary phase such as a fluoride; by designing and controlling these periods, fundamental magnetic physical properties such as the coercive force, residual flux density, saturation magnetic flux density and anisotropy energy can be controlled; and in order to make the coercive force and the residual flux density 10 kOe or more and 1 T or more, respectively without using a rare earth element, the average dispersion in the variation width of the modulation period needs to be ±50% or less, and desirably ±30% or less.

In such a bulk ferromagnetic body having the grain boundary containing fluorine and using no rare earth element, by making the ferromagnetic body have a periodical structure constituted of a plurality of periods, making the average crystal orientations oriented nearly in the same direction, and making the ferromagnetic element content of the grain boundary phase containing fluorine to be 0.1 to 50 atomic %, the coercive force of 5 kOe or more, the residual flux density of 1.0 T or more and the curie point of 500° C. or higher can be achieved. Further by making such a bulk ferromagnetic body contain 0.01 to 5 atomic % of a rare earth element, a coercive force two to ten times a coercive force before the addition of the rare earth element can be achieved, and a material can be obtained which has magnetic characteristics equal to or more than those of conventional $Nd_2Fe_{14}B$ and $Sm_2Fe_{17}N_3$ magnets even in a smaller rare earth element concentration of the material than that of the magnets.

Example 19

After iron and cobalt of 99% in purity are weighed, and dried under vacuum, the mixture is arc melted in an argon gas to fabricate an Fe-30 atomic % Co alloy. The alloy is charged in a glass tube, high-frequency melted in an argon gas atmosphere, and thereafter, the melted alloy is blown out for quenching from a blowout port of the glass tube to a rotating roll. The powder fabricated by quenching has a flat form or a ribbon form, and is mixed in a mineral oil without being exposed to the air. The mineral oil contains about 1% by weight of ammonium fluoride dissolved, and by heating the mineral oil at 150° C., a part of the ammonium fluoride in the mineral oil is decomposed, and the decomposed gas components fluorinate the quenched powder.

Some of fluorine atoms intrude interstitially in the Fe-30 atomic % Co alloy and expand the inter atomic distance, thereby increasing the atomic magnetic moment. The fluorination at 200° C. or higher easily grows stable compounds such as $FeF_2$ and $FeF_3$. By contrast, a low temperature of 100° C. or lower hardly progresses the fluorination. The Fe-30 atomic % Co alloy in which fluorine atoms have intruded has a fluorine concentration of 0.01 to 1 atomic %, and an increase in the atomic magnetic moment and an increase in the crystal anisotropy energy are observed. With the fluorine concentration of 1 to 15 atomic %, the coercive force was increased since the uniaxial magnetic anisotropy energy increased; and with the fluorine concentration of 10 atomic %, a coercive force of 5 kOe was confirmed.

The Fe-30% Co-10% F alloy powder fabricated through the solution fluorination process is molded in a magnetic field, and thereafter heat molded at 200° C., whereby a powder of an Fe—Co—F alloy having a body-centered tetragonal or face-centered tetragonal structure, on the surface of which $(Fe, Co)F_2$ or $(Fe, Co)F_3$ has grown, is molded in a density of 99%, and on a part of the power surface, oxy-fluorides grow. At this time, a magnet having a saturation magnetic flux density of 2.6 T and a residual flux density of 1.7 T can be fabricated. In the present Example, an Fe-30% Co-5% Cr alloy obtained by adding 5 atomic % of Cr to an Fe-30 atomic % Co alloy is quenched in a mineral oil and thereafter heated and fluorinated as described above, whereby Cr is likely to distribute unevenly in a region of the powder surface containing much fluorine, and the powder central portion becomes a Fe-rich phase, and the powder peripheral portion becomes a CoCr-rich phase. The Fe-rich phase was a phase of from 70 atomic % of Fe to 95 atomic % of Fe, and the CoCr-rich phase was a phase of 40 to 60% of Co, 20 to 40% of Cr and 0.1 to 15% of F (fluorine); and since the uneven distribution of Cr formed an FeCoCrF-based phase having a crystal structure partially different from the Fe-rich phase, the coercive force was increased, and magnetic characteristics of a residual flux density of 1.7 T and a coercive force of 10.5 kOe were confirmed.

Such an uneven distribution of an added element progresses at a low temperature of 150 to 200° C. by the fluorination treatment using gas components containing fluorine, and also transition metal elements other than Cr, Fe and Co, and rare earth elements as elements to be added can be unevenly distributed in the vicinity of the boundary of the powder or grain while the composition is modulated according to a period near the size of the crystal grain, and the magnetocrystalline anisotropy of the unevenly distributed phase increases; therefore, since the magnetic anisotropy energy or the anisotropic magnetic field of the magnetic powder or the molded body increases, the coercive force is increased. In the case of altering ammonium fluoride to $KHF_2$ as a fluorinating agent, on a part of the grain boundary or the surface, an antiferromagnetic phase such as $KCoF_3$ grows, and the exchange coupling with a ferromagnetic phase acts, consequently increasing the coercive force in the demagnetization direction.

Example 20

After iron, cobalt and zirconium of 99% in purity are weighed, and dried under vacuum, the mixture is arc melted in an argon gas to fabricate an Fe-30 atomic % Co-5 atomic % Zr alloy. The alloy is charged in a glass tube, high-frequency melted in an argon gas atmosphere (0.2 atm), and thereafter, the melted alloy is blown out for quenching from a blowout port of the glass tube to a rotating roll which is rotating at a peripheral speed of 40 m/s and whose surface is water cooled at 10° C. The powder fabricated by quenching has a flat form or a ribbon form, and has a crystal grain diameter of 20 nm in average, and is mixed in a mineral oil having a boiling point of 250 to 300° C. without being exposed to the air. The mineral oil contains about 5% by weight of ammonium fluoride dissolved, and by heating the mineral oil at 150° C., a part of the ammonium fluoride in the mineral oil is decomposed, and the quenched powder is fluorinated.

Some of fluorine atoms intrude from the crystal grain boundary of the Fe-30 atomic % Co-5 atomic % Zr alloy into between cubic or hexagonal lattices inside the crystal grain and amorphous regions, or displace them, and contract the inter atomic distance, thereby increasing the atomic magnetic moment or the magnetocrystalline anisotropy energy. The fluorination at 200° C. or higher easily grows stable compounds such as $(Fe, Co)F_2$ and $(Fe, Co)F_3$. By contrast, a low temperature of 100° C. or lower hardly progresses the fluorination.

The Fe-30 atomic % Co-5 atomic % Zr alloy in which fluorine atoms have intruded has a fluorine concentration of 0.01 to 1 atomic %, and an increase in the atomic magnetic moment and an increase in the crystal anisotropy energy are observed. Hydrogen and nitrogen as decomposed components of ammonium fluoride partially react also. With the fluorine concentration of 1 to 15 atomic %, the coercive force was increased since the uniaxial magnetic anisotropy energy increased; and with the fluorine concentration of 10 atomic %, a coercive force of 12 kOe was confirmed.

The Fe-30% Co-5% Zr-10% F alloy powder fabricated through the solution fluorination process is molded in a magnetic field, and thereafter heat molded at 200° C., whereby a powder of an Fe—Co—Zr—F alloy having a cubic, tetragonal, hexagonal, orthorhombic, rhombohedral, monoclinic or triclinic crystal structure including a body-centered tetragonal, face-centered tetragonal structure or hexagonal close-packed structure, on the surface of which $(Fe, Co, Zr)F_2$, $(Fe, Co, Zr)(O, F)_2$, $(Fe, Co, Zr)(C, O, F)_2$ and $(Fe, Co, Zr)(N, C, O, F)_2$, or $(Fe, Co, Zr)F_3$, $(Fe, Co, Zr)(O, F)_3$, $(Fe, Co, Zr)(C, O, F)_3$ and $(Fe, Co, Zr)(N, C, O, F)_3$ have grown, is molded in a density of 99%, and on a part of the power surface, oxyfluorides grow. At this time, a magnet having a saturation magnetic flux density of 2.5 T and a residual flux density of 1.7 T can be fabricated.

In the present Example, an Fe-30% Co-15% Cr-5% Zr alloy obtained by adding 15 atomic % of Cr to an Fe-30% Co-5% Zr-10% alloy is quenched in a mineral oil and thereafter heated and fluorinated as described above, whereby Cr is likely to distribute unevenly in a region of the powder surface containing much fluorine, and the powder central portion becomes a Fe-rich phase, and the powder peripheral portion becomes a CoCr-rich phase. The Fe-rich phase was a phase of from 70 atomic % of Fe to 80 to 90 atomic % of Fe, and the CoCr-rich phase was a phase of 40 to 70% of Co, 20 to 40% of Cr and 0.1 to 15% of F (fluorine); and since the uneven distribution of Cr formed an FeCoCrZrF-based phase having a crystal structure partially different from the Fe-rich phase, the coercive force was increased, and magnetic characteristics of a residual flux density of 1.7 T and a coercive force of 10.5 kOe were confirmed.

Such an uneven distribution of an added element progresses at a low temperature of 150 to 200° C. by the fluorination treatment using a fluorine-containing gas such as ammonium fluoride or ammonium hydrogen fluoride, and also transition metal elements other than Cr, Fe, Co and Zr, and rare earth elements as elements added at 0.1 to 30 atomic % can be unevenly distributed in the vicinity of the boundary of the powder or grain, and the magnetocrystalline anisotropy of the unevenly distributed phase increases; therefore, since the magnetic anisotropy energy or the anisotropic magnetic field of the magnetic powder or the molded body increases, the coercive force is increased.

Example 21

After iron of 99% or more in purity is reductively melted in a hydrogen atmosphere, the iron is quenched and thereafter pulverized in an inert gas atmosphere to obtain a powder having an average powder diameter of 1 to 20 μm. The powder is mixed in a mineral oil containing 10% by weight of ammonium fluoride ($NH_4F$) dissolved therein, and heated at 170° C. for 20 hours, whereby the fluorination of the powder progresses by decomposition of the ammonium fluoride. In the mineral oil, other than ammonium fluoride, various types of metal salts and gelatinous metal fluorides can be dissolved, and the decomposition of ammonium fluoride and the deposition of metals and metal fluorides can simultaneously be progressed.

A slurry-like mineral oil in which 10% by weight of ammonium fluoride and Co grains of 1 to 10 nm in grain diameter are mixed is mixed with the above-mentioned flat-shaped iron powder having an average grain diameter of 1 to 20 μm, and subjected to mechanical alloying or ball milling. As the balls, a high-purity iron fluoride ($FeF_2$) was used, and as a result of progressing the reactive ball milling at 170° C., it was confirmed by X-ray diffraction, electron beam diffraction, neutron beam diffraction or wavelength-dispersive X-ray spectrometer that a Co-1 to 30% Fe phase and $(Co, Fe)F_2$ and $(Co, Fe)F_3$ grow on the surface of the iron powder, and a part of fluorine intrude in between lattices of a CoFe-based alloy and Fe. The mixture of the mineral oil and the powder was temporarily molded in a magnetic field, and thereafter heat molded to obtain a molded body of 99% in density.

In the molded body, Fe, an Fe—F alloy or an Fe—Co—F alloy having a body-centered cubic or body-centered tetragonal structure is formed with the volume fraction of 70% in the central portion of the flat-shaped powder; a ferromagnetic fluorine-containing phase of Fe-50 to 90% Co-0.1 to 15% F grows nearly continuously with the volume fraction of 20% along the grain boundary or the powder surface in its peripheral side; and further, $(Fe, Co)F_2$ and $(Fe, Co)F_3$ are formed with the volume fraction of about 5% on a part of the grain boundary or its outermost surface. As a result of the evaluation of magnetic characteristics of the molded body after magnetization at 15 kOe, the residual flux density was 1.5 T, and the coercive force was 13 kOe. As the fluorinating agent, ammonium fluoride such as $NH_4HF_2$ may be used.

Example 22

After cobalt of 99% or more in purity is reductively melted in a hydrogen atmosphere, the cobalt is quenched and thereafter pulverized in an inert gas atmosphere to obtain a flat-shaped powder having an average powder diameter of 1 to 20 μm. The powder is mixed in a mineral oil containing 10% by weight of ammonium fluoride and iron fluoride dissolved therein, and heated at 170° C. for 20 hours, whereby the fluorination of the powder progresses by decomposition of the ammonium fluoride, and the deposition of iron grains of 1 to 30 nm in grain diameter progresses. In the mineral oil, other than ammonium fluoride and iron fluoride, various types of metal salts and gelatinous metal fluorides can be dissolved and the decomposition of ammonium fluoride and the deposition of metal fluorides other than iron can simultaneously be progressed also.

A slurry-like mineral oil in which 10% by weight of ammonium fluoride and Fe grains of 1 to 30 nm in grain diameter are mixed is subjected to mechanical alloying or ball milling. As the balls, a high-purity iron fluoride ($FeF_2$) was used, and as a result of progressing the reactive ball milling at 170° C., it was confirmed by X-ray diffraction, electron diffraction, neutron beam diffraction or wavelength-dispersive X-ray spectrometer that a Co-1 to 40% Fe phase and $(Co, Fe)F_2$ and $(Co, Fe)F_3$, and $(Co, Fe)_x(OF)_y$ (x and y are positive numbers) grow on the surface of the cobalt powder, and a part of fluorine, hydrogen or carbon intrudes in between lattices of a CoFe-based alloy and Fe. The mixture of the mineral oil and the powder was temporarily molded in a magnetic field, and thereafter heat molded to obtain a molded body of 99% in density.

In the molded body, Co, a Co—F alloy or an Fe—Co—F alloy having a hexagonal close-packed structure, face-centered cubic or body-centered tetragonal structure is formed with the volume fraction of 80% in the central portion of the flat-shaped cobalt powder; a ferromagnetic fluorine-containing phase of Fe-50 to 90% Co-0.1 to 15% F grows nearly continuously with the volume fraction of 10% along the grain boundary or the powder surface in its peripheral side; and further, $(Fe, Co)F_2$, $(Fe, Co)F_3$ and oxygen or hydrogen-containing fluorides thereof are formed with the volume fraction of about 10% on a part of the grain boundary or its outermost surface. As a result of the evaluation of magnetic characteristics of the molded body after magnetization at 15 kOe, the residual flux density was 1.4 T, and the coercive force was 15 kOe. Since the magnet of the present Example uses no rare earth element, a low cost can be achieved, and the material is effective from the viewpoint of the resource and environment protection.

In order to acquire magnetic characteristics nearly equal to the residual flux density of 1.4 T and the coercive force of 15 kOe as seen in the present Example, as a constituting phase of a bulk material, there are needed at least three phases of a ferromagnetic body having a saturation magnetic flux density of 1.5 T or more, a ferromagnetic body obtained by making the former ferromagnetic body contain 0.1 atomic % or more and 15 atomic % or less of fluorine, and a high-concentration fluorine-containing phase containing 50 atomic % or more of fluorine, or 50% or more of the sum of fluorine and oxygen; and the composition or the structure of the bulk material desirably forms a material having an average period in the range of 1 to 100 nm, and the ferromagnetic element concentration in the high-concentration fluorine-containing phase needs to be in the range of 0.1 to 50% to make a high coercive force.

By adding 0.01 to 5 atomic % of a rare earth element and a nonmagnetic metal element to a bulk material having such a structure, the coercive force can be made two to ten times that of the original bulk material, and at this time, since the rare earth element and the nonmagnetic metal element are distributed unevenly in the vicinity of the fluorine-containing phase, the magnetic anisotropy energy in the vicinity of the grain boundary is increased, and a decrease in the residual flux density due to the addition of the rare earth element and the nonmagnetic metal element can be suppressed to 1% or less.

Even if magnetic materials having such a fluorine-containing grain boundary phase contain light elements such as hydrogen, carbon, nitrogen and oxygen, halogen elements other than fluorine, and inevitable impurities, the magnetic characteristics little vary.

Example 23

A gel obtained by swelling a composition of $(Fe_{0.6}Co_{0.3}Cr_{0.1})F_2$ with an alcohol solvent is subjected to a centrifugal separator to separate an amorphous $(Fe_{0.7}Co_{0.3})F_2$ composition. The centrifugation is carried out by filling the centrifugal separator with an Ar-10% $H_2$ gas, making the atmosphere in a reductive one, and heating at 150° C.

In the centrifugation, the noncrystalline of the composition of $(Fe_{0.7}Co_{0.3}Cr_{0.1})F_2$ is crystallized while fluorine is being reduced and removed from the noncrystalline to grow a composition of $(Fe_{0.7}Co_{0.3}Cr_{0.1})(H, F)_{0.001\text{-}2}$ having a crystal grain diameter of 1 to 100 nm. The composition is subjected to a heat treatment in a magnetic field at 200 to 700° C., so that a part of the composition causes the spinodal decomposition to grow a Cr-rich phase containing fluorine in the vicinity of the grain boundary including the grain boundary. The Cr-rich phase is a phase containing 10 to 90 atomic % of Cr, and has a Cr concentration higher than that in an adjacent Fe—Co-rich phase. Some of the crystals grow continuously in the magnetic field direction, and the direction of the magnetic anisotropy becomes parallel with the magnetic field direction. Crystals having a fluorine content exceeding 10% grow on a part of the grain boundary, and exhibit a matching relation with the crystal of the Fe—Co-rich phase in the magnetic field direction. A matching distortion is caused in the Fe—Co-rich phase in the matching relation, and an increase in the magnetic anisotropy energy by the lattice distortion in the vicinity of the interface leads to an increase in the coercive force.

A ferromagnetic material composed of at least three phases of the Fe—Co-rich phase, the Cr-rich phase and the fluorine-containing phase can be made to have a coercive force of 5 to 10 kOe because of a high magnetic anisotropy energy due to the uneven distribution of Cr and fluorine and the lattice distortion, and a molded magnet having a residual flux density of 1.4 T and a coercive force of 10 kOe can be fabricated by heat molding at 700° C. Characteristics nearly equal to those of such a molded magnet using no rare earth element can be achieved even by using alloy-based magnets in which Cr is displaced with another metal element such as Al, Mn, V, Ti, Mo and As, and the containing other light elements and inevitable impurities raises no problem.

In the case of adding 0.01 to 5 atomic % of Sm to the composition of $(Fe_{0.6}Co_{0.3}Cr_{0.1})F_2$, since Sm is unevenly distributed accompanied by Fe and Co atoms in the vicinity of unevenly distributed fluorine, and the magnetocrystalline anisotropy energy in the vicinity of the grain boundary is increased, a magnetic material having a coercive force of 20 to 50 kOe and a residual flux density of 1.7 T can be obtained. With Sm exceeding 5%, the coercive force is maintained, but the residual flux density is likely to decrease. With the Sm concentration of less than 0.01%, since the increase width of the coercive force is as small as 1 to 5 kOe, the optimum amount of Sm added is 0.01 to 5 atomic %. Even if another rare earth element is used in place of Sm, the effect on increasing the coercive force can be attained.

A magnet as in the present Example can be obtained by using compositions, other than the $(Fe_{0.6}Co_{0.3}Cr_{0.1})F_2$, such as $(Fe_{0.01\text{-}0.1}Co_{0.5\text{-}0.89}Cr_{0.1})F_2$, $(Ni_{0.5}Al_{10.2}Co_{0.3})F_{1\text{-}3}$, $(Fe_{0.8}Co_{0.1}Zr_{0.1})F_{0.1\text{-}3}$, $Mn_{0.4}Al_{0.4}C_{0.2}$, $Mn_{0.4}Bi_{0.4}C_{0.2}$ and $Mn_{0.4}V_{0.4}C_{0.2}$; the compositions can form a texture exhibiting a modulation period of 0.1 to 100 nm by utilizing a self-organization process or the like for the compositional modulation near the spinodal decomposition, and the uneven distribution of fluorine, the uneven distribution of the constituting elements in the vicinity of the grain boundary and the lattice distortion of the grain boundary can provide a magnet whose coercive force exceeds 5 kOe and residual flux density exceeds 1 T without using a rare earth element.

Example 24

An $(Fe_{0.7}Co_{0.3}Zr_{0.1})_{10}F_{0.1}$ powder is fabricated by the following means to make a raw material of a magnetic material. Fe, Co and Zr pieces are weighed, charged in a vacuum melting furnace to fabricate $Fe_{0.7}Co_{0.3}Zr_{0.1}$. The molten alloy of $Fe_{0.7}Co_{0.3}Zr_{0.1}$ is blown out for quenching to a rotating roll in an Ar gas atmosphere. The quenched powder has an average grain diameter of 1 to 50 nm. The quenched powder is coated with about 1% by weight of a solution having an amorphous structure having a composition of $SmF_3$, and heated and pulverized.

In order to suppress an increase in the grain diameter, the heating uses a rapid heating condition, and is carried out to 600° C. in 3 min. Heating at a heating rate of 20° C./min or higher can suppress an abnormal crystal growth. By preventing the abnormal crystal growth exceeding a crystal grain diameter of 500 nm, the grain diameter after the pulverization can be made small, and the uneven distribution state of Sm and fluorine can be made even, whereby a high coercive force of 10 kOe or more can be achieved.

By pulverization in an Ar gas atmosphere at a temperature of 600° C., the powder can be pulverized to grains whose grain diameter is near that of a quenched powder in a quenched state. At 600° C., fluorine diffuses into defective portions such as grain boundaries and causes brittleness, and Sm which is a constituting element of the fluoride solution diffuses through defective portions of the quenched powder along with the diffusion of fluorine atoms, and a phase having a high concentration of Sm or Zr is formed in the vicinity of the grain boundary, thereby increasing the magnetocrystalline anisotropy energy.

After the rapid heating pulverization, by quenching the powder at a cooling rate of 10° C./min or higher, the uneven distribution state of Sm and fluorine is maintained, and fluorides and oxy-fluorides having metastable structures are formed. The average texture after the rapid heating pulverization has a core/shell structure as described below.

The central portion of the powder has $(Fe_{0.7}Co_{0.3}Zr_{0.1})_{10}F_{0.1}$; and in the periphery side thereof, $Sm(Fe_{0.7}Co_{0.3}Zr_{0.1})_{10}F_{0.5}$ grows; and on the outermost periphery, $SmF_3$ and Sm(OF) grow. In a range having a small amount of fluorine, the powder center has $Fe_{0.7}Co_{0.3}Zr_{0.1}$; in the peripheral side, $Sm(Fe_{0.7}Co_{0.3}Zr_{0.1})_{10}F_{0.1}$ grows; and on the outermost periphery, Sm(OF) grows.

Some of the outermost peripheral phases are peeled off in the above-mentioned pulverization, and the Sm concentration of the magnetic powder having a core/shell structure is 0.01 to 5 atomic %. If the Sm concentration exceeds 5 atomic %, since the saturation magnetic flux density remarkably decreases, in order to secure a residual flux density of 1.7 T or more, setting the saturation magnetic flux density at 2.0 T or more, the Sm concentration needs to be made 5 atomic % or less. In the case of Sm of less than 0.01%, since a coercive force of 10 kOe or more is hardly obtained, and demagnetization is liable to occur, the magnetic powder is used only in magnetic circuits having a permeance coefficient of 2 or more and hardly demagnetized.

The crystal structure of each phase having grown in the powder depends on the commingling of inevitable impurities, the temperature history of the above-mentioned heat treatment, and the pulverization condition, but its typical example is: the central portion is a body-centered cubic or tetragonal phase, or a mixed phase thereof; the peripheral side is a hexagonal, tetragonal, orthorhombic, rhombohedral or monoclinic phase, or a mixed phase thereof; and the outermost periphery phase containing a high concentration of fluorine has various types of crystal structures containing non-crystallines depending on the oxygen concentration, and some of oxy-fluorides have a metastable cubic or face-centered cubic structure.

Since the ferromagnetic phase in the average powder central portion contains no Sm, and Sm is distributed averagely unevenly in the peripheral side of the ferromagnetic phase, the concentration of Sm can be decreased, and the residual flux density can be increased. Additionally, the above-mentioned material has a curie point of 490° C., which is higher than that of NdFeB-based magnets. Such a material whose residual flux density is 1.7 T or more and curie point is 400° C. or higher can be achieved by the above-mentioned core/shell texture, and this can be satisfied also by using materials other than the above-mentioned SmFeCoZrF-based material, and can be represented by the following general composition formula.

$$A(Fe_xCo_yM_z)+B(R_hFe_iCo_jM_kF_l)+C(R_oFe_pCo_qM_rF_s) \quad (1)$$

In the formula (1), Fe is iron; Co is cobalt; M is one or a plurality of metal elements excluding Fe and Co; R is a rare earth element; F is fluorine, or one or a plurality of light elements or halogen elements containing fluorine, such as fluorine and hydrogen, fluorine and nitrogen, fluorine and carbon, and fluorine and oxygen; and x, y, z, h, i, j, k, l, o, p, q, r and s are positive numbers. The first term is a ferromagnetic phase in the vicinity of the magnetic powder or the crystal grain center; the second term is a fluorine-containing ferromagnetic phase in contact with a peripheral side of the ferromagnetic phase of the first term; and the third term is a fluoride phase growing in the outermost periphery or the grain boundary. In order to make the residual flux density 1.7 T or more, since the saturation magnetic flux density needs to be raised, x>y>z, i>j>k>l and s>p>q>r. Since fluorine needs to have a maximum concentration on the outermost periphery of the powder or crystal grain, s>l>0 and h+i+j+k>o+p+q+r. If the volume fraction of the each phase is denoted as A, B and C, and A+B+C=1 (100%), A>C>0 and B>C>0.

Some of crystals of the ferromagnetic phases of the first term and second term have the similar crystal structure; a part of the interface between the phases forms an interface exhibiting lattice matching; lattice distortion is present in a part of the interface; and such a magnetic coupling that the magnetizations between the ferromagnetic phases are parallel with each other is caused. The magnetocrystalline anisotropy energy of the phase of the second term is larger than the magnetocrystalline anisotropy energy of the phase of the first term. Some of fluorine atoms of the second term intrude into interstitial positions, and increase the lattice volume.

The crystal structure of the phase containing fluorine of the third term is different from the crystal structure of the fluorine-containing ferromagnetic phase of the second term; the interface exhibiting matching between the phases of the second term and third term has a smaller area than the matching interface between the first term and second term; the magnetizations of the ferromagnetic phases of the first term and second term are larger than the magnetization of the fluorine-containing phase of the third term.

In the case of A>B>C>0, the residual flux density is high, and by making C<0.1 (10%), desirably C<0.001 (0.1%), a residual flux density of 1.7 T or more can be achieved. In the phase of the second term or third term, a metastable phase is formed, and the structure or texture varies along with heating; the crystal structure of the ferromagnetic phase of the first term is a body-centered cubic or tetragonal phase, or a mixed phase thereof; the crystal structure of the ferromagnetic phase of the second term is a hexagonal, tetragonal, orthorhombic, rhombohedral or monoclinic phase, or a mixed phase thereof; and the phase of the third term containing fluorine in a high concentration on the outermost periphery or crystal grain boundary has various types of crystal structures containing noncrystallines depending on the oxygen concentration, and partially contains oxy-fluorides, and the crystal structure of the oxy-fluorides has a metastable cubic or face-centered cubic structure.

The magnetic powder represented by the general formula (1) described above is mixed with a solvent capable of preventing oxidation, molded in a magnetic field in an inert gas, and thereafter heated and pressurized to fabricate an anisotropic magnet of 98% in density; on the grain boundary, a fluorine-containing phase can be formed, in the vicinity of the grain boundary along the grain boundary, a fluorine-containing ferromagnetic phase or an antiferromagnetic phase can be formed, and further in the central portion thereof, a ferromagnetic phase containing no fluorine can be formed; as a result of carrying out rapid heating at a rate of 100° C./min or more in the heating and pressurizing, and rapid cooling of 150° C./min or more in the temperature region of 300° C. or higher, oxygen-containing fluorides on the grain boundary takes a cubic structure, and a magnet having a residual flux density of 1.8 T, a coercive force of 25 kOe and a curie point of 570° C. could be achieved by making the Sm concentration as the whole magnet to be 1 to 2 atomic %.

Such a magnet has a lower rare earth element concentration than that of conventional Nd—Fe—B based, Sm—Fe—N based and Sm—Co based magnets and the like, and exhibits a higher residual flux density than these conventional materials; and by applying such a magnet to every magnetic circuit, both of the size-reduction, high-performance and weight-reduction, and the performance improvement of magnet application products can simultaneously be satisfied. In the (1) shown above, even in a system containing no Co, the formation of the phases of the first to third terms can simultaneously satisfy a high coercive force and a high residual flux density both; and for the second term, $Sm_2Fe_{17}F_{1-3}$, $Sm_2(Fe, Mo)_{17}F_{1-3}$, $Sm_2(Fe, Ga)_{17}F_{1-3}$, $Sm_2(Fe, Mo)_{17}(N, F)_{1-3}$ and the like, and additionally, fluoride-containing compounds or compounds containing an element having a high electronegativity represented by RxMyNz can be used. In the above RxMyNz, R is one or more rare earth elements; M is one or more metal elements other than rare earth elements; and N is one or a plurality of elements having an electronegativity of 2.0 or higher.

Example 25

One layer of an atomic layer of an Fe-20% F composition containing 20 atomic % of fluorine atoms is fabricated on a MgO (001) single crystal by a reactive sputtering method using plasma containing fluorine. After one atomic layer of Fe is formed on the former atomic layer, an atomic layer of an Fe-10% Ti composition is formed thereon, and one atomic layer of Fe is further formed thereon. By repeating the above-mentioned fabrication of the atomic layers, the F-containing atomic layer and the Ti-containing atomic layer are periodically formed in Fe. Some of fluorine atoms are disposed at interstitial positions between Fe—Fe atoms. Some of Ti atoms are arranged at displacement positions of Fe atoms.

An Fe atom is disposed between a Ti and a F atom; electrons which Ti release can be received by F atoms through Fe atoms, and such release and reception of electrons through Fe brings about a localization of the electron distribution, and generates the anisotropy in the electron distribution. Such a transfer of electrons through Fe atoms needs that an element having a large electronegativity or electron affinity and an element having a small electronegativity or electron affinity are disposed in a pair in the vicinity of the Fe atoms. Since the growth of a Ti—F based compound in which Ti and F are bonded is likely to eliminate the transfer of electrons through the Fe, one or a plurality of Fe atoms need to be disposed between a Ti and a F atom.

Formation of an artificial laminate film having matching interfaces as seen in the present Example and the periodical disposition of fluorine and a low-electronegativity element through iron can develop the magnetic anisotropy by making the electron distribution anisotropic, and can increase the anisotropic magnetic field. Since the interstitial disposition of fluorine atoms and the displacement disposition of Ti deform peripheral lattices, the symmetry of the crystal varies, and the crystal orientation causes the anisotropy. The electron transfer and the lattice distortion increase the magnetic anisotropy of Fe, developing the coercive force. A material obtained by repeatingly laminating an Fe/Fe-20% F/Fe/Fe-10% Ti has a saturation magnetic flux density of 1.8 T, a residual flux density of 1.6 T and a coercive force of 7 kOe.

For a material satisfying the residual flux density of 1.5 T or more and the coercive force of 5 kOe or more as seen in the present Example, other than the case where Ti is disposed in an iron/fluorine-based material, one or two or more kinds of elements having an electronegativity of 3.0 or lower can be used instead of Ti, and by periodically arranging fluorine and a low-electronegativity element through Fe, the electron state of Fe is varied. Even if some of Fe atoms have antiferromagnetic bonds through fluorine and oxygen atoms and low-electronegativity elements, the above-mentioned magnetic characteristics can be achieved. Magnetic materials having a structure similar to that in the present Example can be represented by the following formula.

$$Fe_xM_yF_z \quad (2)$$

In the formula (2), Fe is iron; M is an element having an electronegativity (of Pauling) of 3.0 or lower; F is fluorine; the composition range is X=0.8 to 0.95, Y=0.01 to 0.1 and Z=0.001 to 0.2, and X+Y+Z=1.0 (100%); and the material has such arrangements (n is 1 to 10) or bonds as M-Fe—F, M-Fe—Fe—(n atoms of Fe)—F and M-Fe—Fe—(n atoms of Fe)—F-M, and these arrangements in which F is disposed has an orientation.

The lattice distortion caused by the disposition of some of fluoride atoms at interstitial positions and the disposition of low-electronegativity elements M at displacement positions contribute to an increase in the magnetic anisotropy of Fe, and develop the coercive force. In order to make the coercive force 10 kOe or more, the anisotropy of electron orbits needs to be raised by making the electronegativity of the low-electronegativity elements M to be 2.0 or lower. Even if oxygen, hydrogen, carbon, nitrogen or other metal elements, which are contained inevitably in the magnetic material, are commingled therein in about 1,000 ppm, the magnetic characteristics are not largely varied; and even if F is altered partially to other halogen elements such as chlorine, or light elements such as hydrogen, nitrogen and boron, and a part of Fe is altered to other transition metal elements and rare earth elements, the magnetic anisotropy energy is increased by arranging elements, whose difference in electronegativity is 1 or higher as described above, through Fe atoms.

With respect to the crystal structure, one of a cubic, orthorhombic, monoclinic, hexagonal and rhombohedral structures grows, and the lattice distortion is caused in the vicinity of fluorine and low-electronegativity elements. With X of less than 0.8 in the formula (2), the residual flux density decreases to less than 1.5 T, and magnetic characteristics exceeding those of Nd—Fe—B based magnets cannot be secured. By contrast, with X exceeding 0.95, it is difficult to make the coercive force 5 kOe or more by a ferromagnetic element of Fe alone. If the concentration Y of low-electronegativity elements exceeds 0.1, the residual flux density is decreased to less than 1.5 T; and if less than 0.01, a coercive force of 5 kOe or more cannot be exhibited. With the fluorine concentration Z of less than 0.001, the magnetic anisotropy energy cannot be increased, and the coercive force is less than 5 kOe; and with the fluorine concentration exceeding 0.2, a stable fluoride is liable to grow, and the proportion of the fluoride atom arrangement having a metastable interstitial disposition becomes small, decreasing the magnetic characteristics.

Magnetic materials satisfying the composition represented by the formula (2) and the above-mentioned atomic arrangement of F, Fe and the M element can be fabricated by various types of film forming means other than the above-mentioned sputtering method, such as a vapor-deposition method, a laser beam deposition and an ion beam deposition; and combinations with Example 1 of the present invention can form a ribbon-shaped high-coercive force magnetic material whose the size and shape is controlled, and use of an organic or inorganic binder material can make the magnetic material bulky.

The arrangement of the interstitially disposed F element in which the element M other than Fe, and Fe have such arrangements (n is 1 to 10) or bonds as M-Fe—F, M-Fe—Fe—(n atoms of Fe)—F and M-Fe—Fe—(n atoms of Fe)—F-M as seen in the present Example has effects such as an increase in the magnetic moment of Fe, making a spin structure of iron partially antiferromagnetic, an increase in the magnetic resistance, an increase in the magnetic anisotropy energy, an increase in the magneto-calorific effect, an increase in the magneto-optical effect, an increase in the magneto-refrigeration effect, an increased in the magnetostriction, a rise in the superconductive transition temperature, and the like; and the magnetic material can be applied to magnetic recording materials such as magnetic heads and magnetic discs, magnetic circuits such as magnetic materials and magnetic motors, and magnetic application products such as magnetic refrigerators, magnetostriction actuators, superconduction application devices, magnetic shield and magnetic memories; and even if a part of, or all of Fe is displaced with Co, Ni, Mn, V and Cr, and a part of F is displaced with H, O, C, N, B, Cl, S and P, the same effects can be achieved.

Example 26

A $Ce_{0.1}(Fe_{0.7}Co_{0.3})_{10}Al_{0.2}$ alloy is melted under vacuum into a button form. The molten alloy as a master alloy is poured in a mineral oil in which ammonium fluoride is melted. The $Ce_{0.1}(Fe_{0.7}Co_{0.3})_{10}Al_{0.2}$ alloy is charged in a quartz nozzle, and the $Ce_{0.1}(Fe_{0.7}Co_{0.3})_{10}Al_{0.2}$ alloy in the quartz nozzle is high-frequency melted in an Ar gas atmosphere, and jetted under pressure from the tip hole of the nozzle. The jetted $Ce_{0.1}(Fe_{0.7}Co_{0.3})_{10}Al_{0.2}$ alloy is made into a powder or ribbon in a foil form, cylindrical form or flat form.

The $Ce_{0.1}(Fe_{0.7}Co_{0.3})_{10}Al_{0.2}$ alloy is quenched simultaneously with the jetting, and the reaction with ammonium fluoride progresses. The average grain diameter of crystal grains of the alloy becomes 1 to 300 nm due to the quenching, and fluorine, hydrogen, nitrogen, carbon and the like are incorporated in the alloy. Since the alloy is heated to a temperature higher than the melting temperature in the jetting, the cooling rate becomes 100 to 500° C./s, and the surface vicinity of the alloy is fluorinated. The fluorine concentration of the alloy after the quenching is 1 to 67% at a depth of 10 nm or less from the surface.

The fluorine concentration gradient formed by the quenching fluorination as described above has, since the powder has a flat shape, a high concentration gradient in the flat plane. After the quenching fluorination, the powder is subjected to a heat treatment in an Ar atmosphere to make Ce distributed unevenly on the surface or in the vicinity of the grain boundary having a high fluorine concentration, and the coercive force increased. It was confirmed by mass spectrometry that Ce is unevenly distributed by quenching after the heat treatment temperature of 600° C. is held for 2 hours. If the temperature exceeds 900° C., coarsening of the crystal grains is observed, and the coercive force is decreased.

In order to make the coercive force 5 kOe or more, the heat treatment at 300° C. to 800° C. is needed. A powder quenched after heating at 600° C. is held for 2 hours is pulverized utilizing a property of being a brittle fluoride to fabricate a magnetic powder having anisotropy; the magnetic powder is molded in a magnetic field, and thereafter pressure molded to obtain a molded body of 7.2 to 7.6 g/cm$^3$ in density. The magnetic characteristics of the molded body are a residual flux density of 1.7 T and a coercive force of 12 kOe.

The reason why magnetic characteristics can be attained by the Ce content of about 1 atomic % in such a manner is that: (1) the uneven distribution of Ce raises the magnetocrystalline anisotropy, and hardly causes the magnetization reversion: (2) fluoride promotes the Ce uneven distribution; (3) the FeCo alloy is formed in the vicinity of the center of the grain, and the Ce-unevenly distributed phase is formed in the peripheral side of the grain, and the FeCo alloy contributes to a high residual flux density; (4) the fluorinate phase or oxyfluorinate phase of the grain boundary makes the ferromagnetic coupling between the grains discontinuous and eliminates the continuity of the magnetization reversion; (5) since the diffusion direction of fluorine or the texture after the fluorination has anisotropy, the magnetic characteristics have anisotropy; (6) crystals having uniaxial anisotropy such as a hexagonal or tetragonal structure grow in the vicinity of the grain boundary, and the magnetocrystalline anisotropy energy is thereby raised; and (7) elements forming stable fluorides, such as Al, promote the diffusion and uneven distribution of fluorine and the stabilization of the unevenly distributed structure.

Magnets exhibiting a residual flux density exceeding magnetic characteristics of the Nd—Fe—B based, Sm—Fe—N based or Sm—Co based magnet as seen in the present Example can be fabricated in the following case. The composition formula is $$RexFeyCozMaFb \quad (3)$$

and in the formula (3), Re is a rare earth element; Fe is iron; Co is cobalt; M is a rare earth element and a metal element other than iron and cobalt; F is fluorine; and $x+y+z+a+b=1$, $x\leq 0.05$ (5 atomic % or less), $y>Z>a>0$, and $b>0.001$. The composition formula represents a composition of the whole magnet, and the composition is largely different between the grain boundary, the vicinity of the grain boundary, the surface of the magnetic powder, the vicinity of the surface of the magnetic powder, and the grain center.

The features are as follows: (1) the grain boundary is an oxy-fluoride or a fluoride; (2) the grain central portion has a low content of a rare earth element; (3) a rare earth element is distributed unevenly on the grain boundary or in the vicinity of the grain boundary; (4) a metal element M is distributed unevenly on the grain boundary or in the vicinity of the grain boundary; (5) one element of hydrogen, carbon, nitrogen and oxygen is distributed unevenly; (6) the crystal structure is different between the grain central portion and the vicinity of the grain boundary triple point, and in the case where the grain central portion is constituted of a plurality of crystal structures, the crystal structure is different between one of the plural of crystal structures and the crystal structure in the vicinity of the grain boundary; (7) crystals having uniaxial or unidirectional symmetry such as a hexagonal or tetragonal structure are formed in the vicinity of the grain boundary, and the axis c of the hexagonal structure or the axis c of the tetragonal structure has a specific orientational relation with the crystals in the grain central portion wherein the grain boundary vicinity refers to a range from the grain boundary to fifth to tenth atoms from the grain boundary; and (8) elements having an electronegativity of Pauling of 3 or lower, desirably 1.5 or lower are partially disposed at positions of atoms most adjacent, secondly and thirdly adjacent to fluorine atoms.

Example 27

A $Mn_1(Fe_{0.7}Co_{0.3})_{10}Al_{0.2}$ alloy is vacuum melted and formed into a shape of a button. This is used as a master alloy, and a molten metal thereof is poured into a mineral oil in which ammonium fluoride is dissolved. The $Mn_1(Fe_{0.7}Co_{0.3})_{10}Al_{0.2}$ alloy is inserted in a quartz nozzle, and the $Mn_1(Fe_{0.7}Co_{0.3})_{10}Al_{0.2}$ alloy in the quartz nozzle is melted with high frequency in an Ar gas atmosphere and injected under pressure through a tip hole of the nozzle. The injected $Mn_1(Fe_{0.7}Co_{0.3})_{10}Al_{0.2}$ alloy forms a powder or a ribbon having a foil shape, a cylindrical shape, or a flat shape. The alloy is quenched simultaneously with the injection and allowed to react with ammonium fluoride heated and maintained at 100° C. The crystal grain of the $Mn_1(Fe_{0.7}Co_{0.3})_{10}Al_{0.2}$ alloy has an average grain diameter of 1 to 100 nm by quenching, and fluorine, hydrogen, nitrogen, carbon and the like are incorporated into the alloy at a concentration of 100 to 10000 ppm. Since the alloy is heated to a melting temperature or higher at the time of the injection, the cooling rate is in the range of 50 to 300° C./s, and the alloy is fluorinated at the surface and the vicinity thereof. The fluorine concentration of the alloy after the quenching is 10 to 67% in a depth of 10 nm or less from the surface.

The fluorine concentration gradient formed by quenching fluorination as described above has a high concentration gradient in the vicinity of the outermost surface. By the heat treatment in an Ar atmosphere after the fluoridation by quenching, Mn, Al, and carbon are unevenly distributed at the surface or near the grain boundary where the fluorine concentration is high to increase the coercive force. It has been identified by X-ray spectroscopy, mass spectrometry and the like that Mn or Al is unevenly distributed by maintaining at a heat treatment temperature of 400° C. for 2 hours followed by quenching. If the temperature exceeds 1000° C., the crystal grain will be increased to reduce the coercive force.

In order to obtain a coercive force of 5 kOe or more, the heat treatment temperature needs to be in the range of 500 to 800° C. The powder which was heated and held at 400° C. for 2 hours and then quenched was pulverized utilizing the property of brittle fluoride to prepare anisotropic magnetic particles, which were molded in a magnetic field and then press molded to obtain moldings having a density of 7.0 to 7.6 g/cm$^3$. The magnetic properties of the moldings include a residual flux density of 1.65 T, a coercive force of 10 kOe, and a curie point of 520° C.

The reason why a magnet which has a Mn content of about 9 atomic % and does not use a rare earth element can be obtained as described above is described in the following (1) to (8). (1) Mn and Al are unevenly distributed, increasing crystal magnetic anisotropy to make it hard to cause the magnetic reversion. (2) Fluorine promotes uneven distribution of Al. (3) A FeCo alloy is formed near the center of grains and a Mn-unevenly distributed-phase is formed on the peripheral side of grains, and the FeCo alloy contributes to a high residual flux density. (4) A fluoride phase or an oxy-fluoride phase having a small magnetization at the grain boundary causes ferromagnetic coupling between grains to be discontinuous to eliminate the continuity of magnetic reversion. (5) Since the diffusion direction of fluorine or the structure after fluorination has anisotropy, the magnetic properties have anisotropy. (6) A phase having an antiferromagnetic magnetic array grows in the vicinity of the grain boundaries. (7) An element which forms a stable fluoride such as Al promotes the diffusion and uneven distribution of fluorine and the stability of an unevenly distributed structure. (8) A super exchange interaction which is observed in iron oxide works between Mn and a fluorine atom, contributing to an increase in magnetization and prevention of magnetic reversion.

A magnet which shows a residual flux density exceeding the magnetic properties of a Nd—Fe—B-based magnet, a Sm—Fe—N-based magnet or a Sm—Co-based magnet as described in the present Example can be prepared in the following case. The composition formula is $$MxFeyCozNaFb \quad (4),$$

wherein M is a metal element other than a rare earth element; Fe is iron; Co is cobalt; N is a metal element other than a rare earth element, iron, cobalt and M element, which is a fluoride-forming element; F is fluorine; $x+y+z+a+b=1$, $0.09\leq x\leq 0.18$ (18 atomic % or less and 9 atomic % or more);

y>z>a>0; and b>0.001. This composition formula shows the composition of the whole magnet, and the composition at the grain center greatly differs from the composition of a grain boundary, in the vicinity of the grain boundary, the surface of magnetic particles, and in the vicinity of the surface of magnetic particles.

The features are as follows. (1) A grain boundary is composed of an oxy-fluoride or a fluoride. (2) A rare earth element is not contained. (3) The metal element N is unevenly distributed with fluorine in a grain boundary or in the vicinity of the grain boundary. (4) Metal elements M and N are unevenly distributed in a grain boundary or in the vicinity of the grain boundary. (5) Any one element of hydrogen, carbon, nitrogen, and oxygen is unevenly distributed. (6) The crystal structure at the grain central portion differs from the crystal structure in the vicinity of the grain boundary triple point. When the grain central portion is composed of a plurality of crystal structures, any one of the crystal structures differs from the crystal structure in the vicinity of the grain boundary. (7) An unevenly distributed phase having a different magnetic structure from that of the grain center grows in the vicinity of the grain boundary. Here, the vicinity of the grain boundary refers to the range from a grain boundary interface to the fifth to tenth atom. (8) Elements having a Pauling's electronegativity of 3 or less are partially located at the nearest-neighbor, the second or the third nearest-neighbor atomic positions of a fluorine atom.

In order to achieve the magnetic properties equivalent to a Nd—Fe—B-based magnet without using a rare earth element, a material having a material composition according to formula (4) and the following features besides the above features can be used.

(1) In order to fix the magnetization of Fe without using Co, a fluorine-containing antiferromagnetic material or a fluorine-containing ferrimagnetic material magnetically coupled with Fe is formed in a grain boundary or in the vicinity of the grain boundary. Examples of the fluorine-based antiferromagnetic material include a MnFeF-based material, a NiOF-based material, a NiMnF-based material, a MnIrF-based material, and a MnPtF-based material. Examples of the ferrimagnetic material include a fluorine-containing ferrite phase such as a FeOF-based material, a MnAlF-based material, a CrMnF-based material, and a NiFeRu-based laminated material.

(2) In order to increase the anisotropy energy in the vicinity of the grain boundary without using Co, a part of fluorine atoms, iron, and an element having a small electronegativity is orderly arranged to add anisotropy to the electron distribution of iron atoms. For this purpose, it is necessary to arrange fluorine atoms and one or a plurality of atoms having an electronegativity of 3 or less within the range from the nearest-neighbor atomic positions to the fifth nearest-neighbor atomic positions (atoms at the fifth neighbor sites) as viewed from iron atoms, thereby forming an anisotropic distribution of the electron density of states of Fe atoms. In order to have a coercive force of 20 kOe or more, it is necessary to arrange fluorine atoms and one or a plurality of atoms having an electronegativity of 2 or less within the range from the nearest-neighbor atomic positions to the fifth nearest-neighbor atomic positions (atoms at the fifth neighbor sites) as viewed from iron atoms, thereby forming an anisotropic distribution of the electron density of states of Fe atoms, in the above description. At this time, it is important that fluorine atom positions and elements having a small electronegativity are orderly arranged, and the elements having a small electronegativity are not located at the nearest-neighbor atomic positions of the fluorine atoms. Such a technique of increasing anisotropy energy by changing the distribution of the electron density of states of iron utilizing the electronegativity difference of elements can be achieved with a halogen element having a larger electronegativity than oxygen and the like besides fluorine. This technique allows a magnetic material having a residual flux density of 1.0 T or more to be achieved. It is possible to use the electronegativity difference to change the electron density of states of metal elements such as Mn and Cr other than Fe to change the magnetic arrangement and coupling state between spins. When Mn is used, an exchange interaction of $Mn^{n+}$—F— $Mn^{m+}$ (m and n are different positive numbers) will work between Mn and F, which contributes to magnetic reversion control and an increase in magnetization by providing an antiferromagnetic or ferromagnetic state.

(3) When a Co atom is used, a Co—Fe-based alloy having a Co concentration of 30 to 100% can be used as a phase in the vicinity of a grain center. In order to increase magnetic anisotropy in the vicinity of the grain boundary, a CoFeF-based, a CoF-based, a CoCr-based, a CoCrF-based, a CoMn-based, a CoMnAl-based, a CoMnSi-based, a CoMnF-based, a CoMnAlF-based, a CoMnSiF based, a CoPtF-based, and a CoCrPtF-based phase and the like are formed along the grain boundary or a grain boundary within 10 atomic layers or less from the grain boundary. At this time, it is desirable that there is an orientation relationship between the hexagonal c-axis direction of a Co or a CoFe alloy phase and a phase formed for the above high magnetic anisotropy, in order to obtain high coercive force. It is suitable for increasing the performance of magnets that the spin direction of high magnetic anisotropy in the vicinity of the grain boundary is parallel with the c-axis direction of a Co or a CoFe phase. Further, in order to increase the anisotropy energy of Co, a technique of incorporating a fluorine atom can be used, and the anisotropy energy of Co is also increased by changing the distribution of the electron density of states of Co atoms by locating fluorine and a small electronegativity element around the Co atoms. Thereby, it is possible to obtain magnet characteristics comparable to a NdFeB-based magnet without using a rare earth element.

Example 28

Mn is vacuum melted and heated to 700° C. again for reduction in an 1% hydrogen-argon atmosphere, thus obtaining Mn having an oxygen concentration of 200 to 2000 ppm. The low oxygen concentration Mn is vacuum deposited to prepare fine particles having a grain diameter 1 to 100 nm. Mn particles are formed on a substrate at a deposition rate of 1 nm/min at a vacuum degree of $1\times10^{-5}$ Pa or less, and then the Mn fine particles are taken out in an Ar gas atmosphere by lift-off. Fluorine, nitrogen, and hydrogen are diffused from the surface of the Mn fine particles by mixing the Mn fine particles with a solution of ammonium fluoride and heating the resulting mixture to 200° C. Although $MnF_2$ grows on the surface of the Mn fine particles, fluorine atoms are located at interstitial positions or displacement positions under the surface thereof to form a coupling of Mn—F, Mn—N, or Mn—H, in a part of which a super exchange coupling such as $Mn^{2+}$—F—$Mn^{3+}$ can also be identified. There is a tendency that the direction of the spin of a metal element which is adjacent to a fluorine atom becomes reverse by the super exchange interaction through fluorine. The fluorine concentration is different with the heating and diffusion time and tends to be higher with the increase in the diffusion time. The average fluorine concentration is 2 atomic % in a heating time of 10 hours. Oxygen as an impurity forms MnO, in which a part of the atomic positions of oxygen is replaced by fluorine.

The fluorine in this oxide has an effect of converting an antiferromagnetic oxide to a ferromagnetic substance in the range of a fluorine concentration of 1 atomic % to 20 atomic %. Further, a fluoride in which hydrogen and oxygen are contained in MnFx (X=0.1 to 2) also becomes an antiferromagnetic or ferromagnetic substance which shows superconductivity depending on a fluorine concentration. $MnF_{0.5}O_{0.5}$ shows ferromagnetism depending on the atomic position of F, and the spins of Mn are arranged in a parallel direction because Mn atoms are located at the nearest-neighbor atomic positions of the fluorine atom.

The formation of such a ferromagnetic Mn fluoride can be achieved by a low temperature treatment at 200° C. as described above at an average fluorine concentration of the whole grain of 0.01 to 20 atomic % and at an oxygen concentration of 200 to 2000 ppm, and spontaneous magnetization develops by the ferromagnetism obtained by a fluorination reaction. It is possible to produce magnetic coupling between an antiferromagnetic substance and a ferromagnetic substance utilizing the fact that an antiferromagnetic substance is changed to a ferromagnetic substance in a heating and diffusion process depending on the concentration of fluorine which is a diffusion element as described in the present Example, and it is possible to make the magnetization of a ferromagnetic substance hard to be reversed. An example of preparing a hard magnetic material using the fluorination of Mn is shown in the following Example.

Example 29

Mn and Sr having a purity of 99% are vacuum melted and heated to 700° C. again for reduction in a 1% hydrogen-argon atmosphere, thus obtaining an alloy having an oxygen concentration of 200 to 2000 ppm. The oxygen-containing Mn-20% Sr alloy is vacuum deposited to prepare Mn-20% Sr fine particles having a grain diameter of 1 to 100 nm. The Mn-20% Sr particles are formed on a substrate at a deposition rate of 0.1 nm/min at a vacuum degree of $1\times10^{-5}$ Pa or less, and then the Mn-20% Sr fine particles are taken out in an Ar gas atmosphere by lift-off. Fluorine, nitrogen, and hydrogen are diffused from the surface of the Mn-20% Sr fine particles by mixing the Mn-20% Sr fine particles with a solution of ammonium fluoride and heating the resulting mixture to 200° C.

$(Mn_{0.8}Sr_{0.2})(O, F)_2$ grows on the surface of the fine particles, and fluorine atoms are located at interstitial positions or displacement positions under the surface thereof to form a coupling of Mn—F, Mn—N, Sr—F, Sr—N, Mn—H, or Sr—H, in a part of which super exchange coupling such as $Mn^{2+}$—F—$Mn^{3+}$ and $Sr^{2+}$—F—$Mn^{3+}$ can also be identified. The fluorine concentration changes with heating and diffusion time and tends to be higher with the increase in the diffusion time. The average fluorine concentration is 5 atomic % in a heating time of 10 hours. Oxygen as an impurity forms $Mn_lSr_mO_n$ or $Mn_lSr_mO^nF^p$ (l, n, m, and p are positive numbers), in which a part of the atom positions of oxygen is replaced by fluorine. Such fluorides show ferromagnetism depending on the atomic positions of F, and the spins of Mn are arranged in a parallel direction because Mn atoms and Sr are located at the nearest-neighbor to the third nearest-neighbor atomic positions of the fluorine atom, thereby capable of forming a hard magnetic material having a saturation magnetic flux density of 0.8 T, a curie point of 650 K, and an anisotropic magnetic field of 6 MA/m.

As a material equivalent or superior to a hard magnetic material having a saturation magnetic flux density of 0.8 T, a curie point of 650 K, and an anisotropic magnetic field of 6 MA/m to be achieved without using iron and a rare earth element, there can be mentioned a material satisfying the following formula.

$$A_hB_iC_jF_k \quad (5)$$

In the formula, A is Mn or Cr; B is an element having an electronegativity of 3 or less;

C is any element selected from oxygen, nitrogen, hydrogen, boron, and chlorine; F is fluorine; any of h, i, j, and k is a positive number; h+i+j+k=1.0; h>i>j; and 0.0001<k<0.3. A structure in which A and B elements are located at the nearest-neighbor atomic positions to the third nearest-neighbor atomic positions of a fluorine atom is observed in a part of the material. When the B element has the electronegativity that is larger than 3, the bias of the electron distribution of Mn and Cr is changed to significantly reduce magnetization. Further, when fluorine exceeds 0.3 (30 atomic %), a stable oxy-fluoride and fluoride will grow, reducing the proportion of a structure in which A and B elements are located at the nearest-neighbor atomic positions to the third nearest-neighbor atomic positions to fluorine. This provides a saturation magnetic flux density of 0.1 to 0.5 T.

Further, when fluorine is 0.0001 or less, it is difficult to obtain a ferromagnetic material at room temperature or above since the effect of electronegativity is small. The difference of electronegativity between the A element and fluorine is 1.48 for Mn and 1.38 for Cr because the electronegativity of Mn, Cr, and F is 1.5, 1.6, and 3.98, respectively. The anisotropy in the distribution of the electron density of states is liable to be developed when the electronegativity of the element corresponding to B in formula (5) is less than 1.5, and Zr, Hf, Mg, Ca, Ba, Li, Na, K, Sc, and Sr are desirably included in such an element. The magnetic moment of some Mn atoms increases to 4.6 to 5.0 μB by introducing fluorine. The magnetic moment of some fluorine atoms is in the range of −0.2 to +0.2 μB at this time.

In such a fluoride having both a covalent bond property and an ionic bond property, the anisotropy of the electron density of states influences various physical properties, promoting the temperature increase of a superconducting property, an increase in a magneto-optical effect, an increase in a magnetostriction effect, an increase in a magnetic specific heat effect, an increase in a thermoelectric effect, an increase in a magnetoresistive effect, and an increase in the Neel point of an antiferromagnetic material, and also contributing to an increase in the curie point and coercive force of a hard magnetic material.

Example 30

Fe and Co are weighed to prepare a Fe-60% Co alloy. To the alloy is added 1 atomic % of Sm to prepare $Sm_{0.01}(Fe_{0.4}Co_{0.6})_{0.99}$. The resulting alloy is mixed with an ammonium fluoride powder followed by heating and pulverization. The $Sm_{0.01}(Fe_{0.4}Co_{0.6})_{0.99}$ powder is exposed to a gas generated by the decomposition of ammonium fluoride at a heating temperature of 200° C., which advances pulverization and fluorination. The fluorination occurs at the grain boundary of the $Sm_{0.01}(Fe_{0.4}Co_{0.6})_{0.99}$ powder, which embrittles the grain boundary to further advance pulverization, providing an average grain diameter of 0.1 to 2 μm. A fluoride such as SmOF and $SmF_3$ grows on the surface of these magnetic particles, and a fluoride having a $Th_2Zn_{17}$ structure or a hexagonal fluoride grows on the inner circumference side of the magnetic particles on the surface of which the above fluoride is formed. The lattice constants of the fluoride having a $Th_2Zn_{17}$ structure are a=0.85 to 0.95 nm and c=1.24-1.31 nm. Further, the lattice constants of the hexagonal fluoride are a=0.49 to 0.52 nm and c=0.41 to 0.45 nm. The fluoride having a $Th_2Zn_{17}$ structure or a hexagonal fluoride grows on the inner side of a fluoride which has grown at the outermost surface of the magnetic particles in the range of a thickness of 1 to 500 nm, and on the further inner side, a Fe—Co phase having a bcc (body-centered cubic), fcc (face-centered cubic), or hcp (hexagonal close-packed) structure grows.

The saturation magnetic flux density of these Fe—Co phases are 1.8 to 2.4 T, and magnetic reversion does not occur easily due to the ferromagnetic coupling with the fluoride having a $Th_2Zn_{17}$ structure or the hexagonal fluoride as described above, both having high magnetocrystalline anisotropy, thereby developing a coercive force. A bonded magnet using a non-magnetic metal, organic or inorganic binder can be formed using the above magnetic particles, and a bonded magnet having a residual flux density of 1.5 T and a coercive force of 12 kOe can be prepared. Further, fluorination and pulverization are further advanced by the pulverization together with ammonium fluoride powder at 250° C. for obtaining anisotropic magnetic particles, and magnetic particles having an average grain diameter of 0.01 to 0.1 μm can be prepared. Thus, it is possible to obtain an anisotropic bonded magnet or an anisotropic molded magnet showing magnetic properties higher than the above bonded magnet by molding in a magnetic field followed by compression molding. Such a magnet uses only 1% of a rare earth element, which allows reduction of rare elements. Furthermore, such a magnet allows improvement in magnetic performance by low cost, can be applied to all magnetic circuits, and can contribute to reduce the size and weight of a magnet application product.

A magnet having magnetic properties equivalent to those in the present Example can be achieved by the composition represented by the following formula.

$$R_hFe_iCo_jM_kF_x \quad (6)$$

In the formula, R is one or more rare earth elements; Fe is iron; Co is cobalt; M is a metal element other than iron and cobalt; F is fluorine; h, i, j, k, and x are positive numbers; h+i+j+k+x=1 (100%); h=0.001 to 0.08; i+j>h+k+x; x=0.005 to 0.1; and k<0.1. A fluoride containing fluorine in a higher concentration than in formulas (6) is formed on the outermost surface of the magnetic particles. The magnet can be achieved because two or more crystal structures of a ferromagnetic phase grow. A ferromagnetic phase having a highest saturation magnetic flux density can be achieved because the fluorine concentration is less than 1 atomic %. If H becomes higher than 0.08, the reduction in the residual flux density will be remarkable. If the total content of Fe and Co is reduced, the curie point will also be reduced with the reduction in the residual flux density. If x which shows the average fluorine concentration of the whole powder exceeds 0.1, a high concentration fluorine compound at the outermost surface will increase, and a rare earth element will also be concentrated by the fluoride. As a result, magnetization and coercive force are reduced. The range of X for unevenly distributing a rare earth element in a phase having high magnetocrystalline anisotropy energy is 0.005 to 0.1. Note that, even if oxygen, hydrogen, carbon, and nitrogen as inevitably contained impurities are contained in a range that does not prevent the growth of a fluoride having high anisotropy energy, there will be no big influence.

Example 31

An alcohol in which ammonium fluoride ($NH_4F$) is dissolved is mixed with 1% of Fe ions, heated at a rate of 1° C./hour with stirring, held at 200° C. for 10 hours, and then cooled. Ammonium fluoride is decomposed by heating to form amorphous or partially crystallized amorphous Fe-5 atomic % F grains in the solution. Water content in the above alcohol solution is 100 ppm or less. If the water content exceeds 100 ppm, oxygen is liable to be contained in the Fe grains, significantly reducing magnetic properties.

During the forming of the Fe-5 atomic % F grains, an external magnetic field of 10 kOe is applied to add anisotropy to the grains. Grains are liable to be connected in the magnetic field direction, capable of forming a one-dimensional magnetic substance having a diameter of about 1 nm and a width of 100 to 1000 nm, in which grains are connected to form a needle-like shape. The average grain diameter of the Fe-5 atomic % F grains is about 1 nm. The average grain diameter depends on the heating rate, heating temperature, and heat time of alcohol, the amount of Fe ions added, stirring speed and the like. Therefore, each parameter is adjusted. After the Fe grains are formed, Co ions are added to the alcohol, and the mixture is heated again, and the surface of the Fe grains is coated with Co having an average thickness of about 0.3 nm. After the Co coating, Cr ions are further added, and Co is coated with Cr having an average thickness of 0.2 nm. The prepared grains have a structure of Fe-5% F, Co, and Cr from the grain center on the average and an average grain diameter of 2 nm.

The grains in the solvent are temporarily molded in a magnetic field without being exposed to atmospheric air and then heated and compressed without access to atmospheric air to crystallize the grains. By pressurizing at a load of 1 t/cm$^2$ at 500° C., a Fe-10% Co-3% F alloy and a Co-40% Cr-1% F alloy are formed into moldings, thereby preparing a compositionally modulated alloy of a FeCoF-based alloy and a CoCrF alloy having a modulation period of 1 to 2 nm. This compositional modulation period is dependent on the diameter of the grains prepared first and the film thickness of Co and Cr. Although magnetic properties are different with the modulation period, modulated composition, modulated crystal orientation and the like, a magnetic material having a coercive force of 20 kOe and a residual flux density of 1.6 T can be prepared. In the present Example, fluorine increases the anisotropy energy of Fe or Co and contributes to the promotion of the ordering or a composition difference of an ordered alloy and the stability improvement of a modulated interface, thus improving magnetic properties.

When a magnet having magnetic properties exceeding a coercive force of 20 kOe and a residual flux density of 1.6 T is formed by substantially the same process as in the present Example, the following formula (7) corresponds in addition to the above composition.

$$A(Fe_xM_yF_z)+B(Fe_hM_iF_j) \quad (7)$$

In the formula, A≥B; x, y, z, h, i, and j are positive numbers; x>y>z; i>h; x+y+z=1; h+i+j=1; z=0.001 to 0.1; j=0.005 to 0.7; magnetization of the phase of the first term is 10 or more times as large as the magnetization of the phase of the second term on an average; when the phases of the first term and the second term are defined as one period, the period is 1 to 500 nm; A is the volume rate of the first term; B is the volume rate of the second term; Fe is iron; M is one or a plurality of elements other than iron; F is fluorine or a halogen element.

The content of oxygen, nitrogen, hydrogen, carbon and the like which are inevitably mixed and a compound containing these elements will not be largely changed if the above compositional modulation is formed on an average. The most suitable M element is an element having a small electronegativity, which is an element other than iron and desirably has a Pauling's electronegativity of 2.0 or less.

The formula (7) will be further described. The first term is a phase which bears magnetization, and the second term is a phase which is in contact with the phase of the first term at an interface to form a uniaxial crystal. In order to increase the residual flux density, the volume rate of the first term needs to be at least equal to or higher than the volume rate of the second term. Therefore, it is desirable to reduce the volume rate of the second term. Further, in addition to the effect of fluorine on increasing the magnetic anisotropy of a ferromagnetic phase, fluorine promotes compositional modulation and can increase the magnetization of the first term by increasing the concentration of M and fluorine of the second term by selecting the M element. Further, fluorine can change the spin arrangement of neighbor atoms and can develop coercive force utilizing the coupling between spins. When a rare earth element is contained in the M element, the magnetocrystalline anisotropy in the vicinity of the interface increases, achieving a coercive force of 20 kOe at a rare earth element concentration of the whole molding of 1 atomic %. Further, when the modulation period is 100 nm or less, a maximum coercive force will be obtained, and when it is 1 nm or less, a coercive force of 5 kOe or less will be obtained.

Although ammonium fluoride is used for fluorination in the present Example, the same fluorination is possible if it is a fluorine-containing solution which is decomposed at 200° C. or below. Further, although hydrogen and nitrogen are generated during fluorination and mixed with growing grains, these elements are almost uninfluential to a compositional modulation period. If these elements can also be unevenly distributed in the second term together with impurity elements, there will be no big influence also on magnetic properties, and a magnetic material having a magnetic force of 20 kOe and a residual flux density of 1.6 T can be prepared.

Example 32

A $Dy_{0.01}(Fe_{0.7}Co_{0.3})_{10}Al_{0.2}$ alloy is vacuum melted and formed into a shape of a button. This is used as a master alloy, and a molten metal thereof is poured into a mineral oil in which ammonium acid fluoride is dissolved. The $Dy_{0.01}(Fe_{0.7}Co_{0.3})_{10}Al_{0.2}$ alloy is inserted in a quartz nozzle, and the $Dy_{0.01}(Fe_{0.7}Co_{0.3})_{10}Al_{0.2}$ alloy in the quartz nozzle is melted with high frequency in an Ar gas atmosphere and injected under pressure through a tip hole of the nozzle. The injected $Dy_{0.01}(Fe_{0.7}Co_{0.3})_{10}Al_{0.2}$ alloy forms a powder or a ribbon having a foil shape, a cylindrical shape, or a flat shape. The alloy is quenched simultaneously with the injection and allowed to react with ammonium acid fluoride. The crystal grain of the $Dy_{0.01}(Fe_{0.7}Co_{0.3})_{10}Al_{0.2}$ alloy has an average grain diameter of 1 to 30 nm by quenching, and fluorine, hydrogen, nitrogen, carbon and the like are incorporated into the alloy. Since the alloy is heated to a melting temperature or higher at the time of the injection, the cooling rate is in the range of 100 to 200° C./s, and the alloy is fluorinated in the vicinity of the surface. The fluorine concentration of the alloy after the quenching is 10 to 67% in a depth of 100 nm or less from the surface.

The concentration gradient of fluorine formed by the quenching fluorination molten metal as described above has a high concentration gradient in the direction perpendicular to a flat surface since the powder has a flat shape. By the heat treatment in an Ar atmosphere after the fluoridation by quenching, Dy is unevenly distributed on the outermost surface or in the vicinity of the grain boundary where the fluorine concentration is high, thereby increasing coercive force.

The arrangement of a part of the spins of Dy in parallel with the spins of Fe and a part of the spins of Dy in anti-parallel with the spins of Fe achieves the development of coercive force by antiferromagnetic coupling and an increase in magnetization by ferromagnetic coupling. It has been identified from mass spectrometry that Dy is unevenly distributed by holding a heat treatment temperature of 600° C. for 2 hours and then quenching. A part of Dy has an ordered structure with F and Fe. If the temperature exceeds 900° C., crystal grains will be coarsened to reduce coercive force. In order to obtain a coercive force of 5 kOe or more, a part of Dy needs to be ordered by a heat treatment at 300 to 800° C. A powder which had been heated and held at 600° C. for 2 hours and then quenched was pulverized utilizing a property of brittle fluoride to prepare anisotropic magnetic particles, which were molded in a magnetic field and then press molded to obtain moldings having a density of 7.2 to 7.6 g/cm$^3$. The moldings have magnetic properties of a residual flux density of 1.8 T and a coercive force of 12 kOe.

The reason why the magnet properties can be obtained at a Dy content of 0.1 atomic % as described above is as follows. (1) Dy is unevenly distributed and ordered so as to fix magnetization by the spin arrangement which forms ferromagnetic and antiferromagnetic coupling with Fe, thereby making it hard to cause the magnetic reversion. (2) Fluorine promotes uneven distribution and ordering of Dy. (3) A FeCo alloy is formed near the center of grains and a Dy-unevenly distributed-phase is formed on the peripheral side of grains, and the FeCo alloy contributes to a high residual flux density. (4) A fluoride phase or an oxy-fluoride phase at the grain boundary causes ferromagnetic coupling between grains to be discontinuous to eliminate the continuity of magnetic reversion. (5) Since the diffusion direction of fluorine or the structure after fluorination has anisotropy, the magnetic properties have anisotropy. (6) An element which forms a stable fluoride such as Al promotes the diffusion and uneven distribution of fluorine and the stability of an unevenly distributed structure.

A magnet which shows a residual flux density exceeding the magnetic properties of a Nd—Fe—B-based magnet, a Sm—Fe—N-based magnet or a Sm—Co-based magnet as described in the present Example can be prepared in the following case. The composition formula is $$Re_xFe_yCo_zM_aF_b \quad (8),$$

wherein Re is a heavy rare earth element; Fe is iron; Co is cobalt; M is a metal element other than a rare earth element, iron, and cobalt; F is a halogen element such as fluorine or chlorine; $x+y+z+a+b=1$; $0.0005 \le x \le 0.01$ (1 atomic % or less); $y>z>a>0$; and $b>0.001$.

This composition formula shows the composition of the whole magnet, and the composition at the grain center greatly differs from the composition of a grain boundary, in the vicinity of the grain boundary, the surface of magnetic particles, and in the vicinity of the surface of magnetic particles. A magnet having performance equivalent to a Nd—Fe—B based magnet can be prepared using a heavy rare earth element Re in the range of 1 to 12 atomic %. However, the content is desirably in an amount of 1 atomic % because a heavy rare earth element is expensive.

The features are as follows. (1) A grain boundary is composed of an oxy-fluoride or a fluoride. (2) The concentration of a rare earth element is low in the central portion of a grain. (3) The rare earth element is unevenly distributed in a grain boundary or in the vicinity of the grain boundary and partly ordered with fluorine and iron. (4) The metal element M is unevenly distributed in a grain boundary or in the vicinity of the grain boundary. (5) Any one element of hydrogen, carbon, nitrogen, and oxygen is unevenly distributed. (6) The crystal structure at the grain central portion differs from the crystal structure in the vicinity of the grain boundary triple point. When the grain central portion is composed of a plurality of crystal structures, any one of the crystal structures differs from the crystal structure in the vicinity of the grain boundary. (7) Elements having a Pauling's electronegativity of 3 or less, desirably 1.5 or less, are partially located at the nearest-neighbor, the second or the third nearest-neighbor atomic positions of a fluorine atom.

In the present Example, various solutions such as mineral oil or alcohol containing fluorine can be used instead of mineral oil in which ammonium acid fluoride is dissolved. In order to accelerate the fluorination reaction, it is also possible to inject the above fluorine-containing solution around an exhaust nozzle of the molten metal. Various molding techniques such as microwave heating, plasma sintering, energization sintering, hot extrusion, shock wave forming, and rolling mill forming can be employed for the forming of a fluorine-containing powder.

Example 33

A master alloy having a purity of 99.99% prepared by removing impurities in Fe, Mn, and Ti is weighed. The $Fe_{0.8}Mn_{0.1}Ti_{0.1}$ alloy is vacuum melted, reduced with hydrogen, and then pulverized in an Ar gas atmosphere. A powder having a powder diameter of 100 μm is mixed with an ammonium acid fluoride solution, heated to 150° C., and pulverized by a ball mill. Fluorination advances at the same time as the $Fe_{0.8}Mn_{0.1}Ti_{0.1}$ alloy is pulverized by the ball mill. A powder having a diameter of 0.1 to 5 μm is obtained by the ball mill process at 150° C. for 100 hours.

The average composition of the powder is $(Fe_{0.8}Mn_{0.1}Ti_{0.1})_{1-x}F_x$, wherein X is 0.001 to 0.1. Mn and Ti are unevenly distributed at the grain boundary and in the vicinity of a grain surface, and a part of fluorine is located at interstitial positions such as octahedral positions or tetrahedral positions between Fe, Mn, or Ti atoms. A part of Mn or Ti unevenly distributed in the vicinity of the grain boundary forms a super lattice with F and Fe. It has an arrangement of Fe—F—Fe, Mn—F—Mn, Mn—F—Fe, Mn—F—Ti, or Fe—F—Ti. The spin arrangement of Fe and Mn changes by the super exchange coupling through F in these atomic arrangements. A part of Mn has antiferromagnetic coupling by the super exchange interaction through Fe and F. A part of Mn has ferromagnetic coupling with Fe. Magnetic property values such as magnetization and magnetic resistance largely change with the coexistence of a covalent bond and an ionic bond.

The electron density of states of Fe and Mn atoms adjacent to Ti atoms changes with Ti having a small electronegativity in response to the influence of F. When Mn is located at the nearest-neighbor positions of Ti, the electrons of Mn are drawn to Fe atoms close to F atoms, and a bias is produced in the electron density of states of Mn and Fe. The bias of such electron density of states greatly influences the physical properties of Mn and Fe and develops magnetic anisotropy in Fe and Mn, and the coupling state between spins also changes depending on the atomic arrangement. When a super lattice is formed, coercive force changes depending on the atomic arrangement and the degree of order by the elements constituting the super lattice.

When an ordered phase in which fluorine atoms have entered the interatomic positions of Fe and Mn atoms is formed and the volume of a crystal lattice is increased by 0.1 to 8% by locating fluorine, a coercive force of 16 kOe and a residual flux density of 1.5 T can be achieved. Magnetic properties tends to be reduced with the reduction in the degree of order of the ordered phase, and a coercive force of less than 1 kOe is obtained at a degree of order of 0.1 or less.

A magnet having magnetic properties equivalent to the one in the present Example can be achieved by the composition represented by following formula.

$$Fe_iM_jF_k \quad (9)$$

The formula has the following conditions: Fe is iron; M is an element other than iron having a Pauling's electronegativity of 1.5 or less; F is fluorine or chlorine; i, j, and k are positive numbers; i+j+k=1 (100%); k=0.001 to 0.2; i>j; and i>0.6; a fluoride or an oxy-fluoride containing a higher concentration of fluorine than that in formula (9) is formed on the outermost surface of magnetic particles; a part of a phase containing fluorine and M is antiferromagnetic; and an ordered phase having ferromagnetic coupling and antiferromagnetic coupling between the spins of neighbor atoms of fluorine atoms is grown.

Note that, in the fluorination process, it is possible to use a solution, gas, or plasma which contains fluorine, in addition to the techniques in other Examples and ammonium acid fluoride. Further, even if 1 to 200 ppm of oxygen, nitrogen, carbon, hydrogen, and the like are incorporated as impurities, there is no big difference. When a rare earth element is contained in the above ordered phase, coercive force and residual flux density will be further increased. If the concentration of a rare earth element is in the range of 0.1 to 5% based on the whole magnet, coercive force can be increased by antiferromagnetic coupling and residual flux density can be increased to 1.6 to 1.7 T by arranging a part of the spins of the rare earth element in parallel with Fe and a part of the rare earth element in anti-parallel with Fe or in a direction at an angle of ±90 degrees or less from the anti-parallel direction. It is possible to increase residual flux density by replacing a part of Fe by Co. Furthermore, fluorine may be replaced by an element having a large electronegativity such as other halogen elements.

Example 34

Iron and cobalt having a purity of 99% are weighed, reduced by heating in a hydrogen atmosphere, and then subjected to arc melting in an argon gas, thereby preparing a Fe-10 atomic % Co alloy. The alloy is inserted in a carbon tube and melted with a high-frequency wave in an argon gas atmosphere. Then, the molten alloy is blown from a blowing hole of the carbon tube to a rotating roller and quenched.

Mineral oil in which ammonium fluoride is dissolved in an amount of about 1 wt % is blown in the vicinity of the above blowing hole. A part of ammonium fluoride in the mineral oil is decomposed on a molten metal or a foil body surface, and the foil body quenched at a cooling rate of $10^5$ to $10^6$ K/s by the decomposed gas component is fluorinated. Some fluorine atoms enter between the lattices of the Fe-10 atomic % Co alloy and expand the interatomic distance, thereby increasing atomic magnetic moment and crystal magnetic energy. In the Fe-10 atomic % Co alloy which fluorine atoms have entered, the increase in atomic magnetic moment and the increase in crystal anisotropy energy are observed at a fluorine concentration of 0.1 to 10 atomic %. Uniaxial magnetic anisotropy energy increases at a fluorine concentration of 5 to 10 atomic %, which increases coercive force. A coercive force of 8 kOe was identified at a fluorine concentration of 10 atomic %.

The Fe-10% Co-10% F alloyed powder prepared through this solution fluorination process is molded in a magnetic field and then heated and molded at 300° C. Thereby, a powder in which (Fe, Co)(F, C)$_2$ or (Fe, Co)(C, F)$_3$ has grown on the surface of the Fe—Co—F alloy and alloyed powder having a bct (body-centered tetragonal) or fct (face-centered tetragonal) structure is molded at a density of 98%, and an oxy-fluoride grows on a part of the powder surface. At this time, it is possible to prepare a magnet having a saturation magnetic flux density of 2.3 T and a residual flux density of 1.6 T.

In the present Example, a foil body of a Fe-10% Co-10% Cr alloy in which 10 atomic % of Cr is added to a Fe-10 atomic % Co alloy is fluorinated by a mineral oil spraying technique in the same manner as described above. The fluorinated foil body shows a tendency that Cr is unevenly distributed in a region having a high concentration of fluorine on the surface of powder, and the center of powder serves as a Fe rich phase, and the peripheral part of powder serves as a CoCr rich phase. The Fe rich phase is a phase of 80 atomic % Fe to 95 atomic % Fe, and the CoCr rich phase is a phase of 20 to 60% Co, 20 to 70% Cr, and 0.1 to 15% F (fluorine). It was possible to identify that a FeCoCrF-based phase having a crystal structure partly different from the Fe rich phase was formed by the uneven distribution of Cr, which has increased coercive force and provided magnetic properties of a residual flux density of 1.6 T and a coercive force of 9.5 kOe.

Transition metal elements and rare earth elements other than Cr, Fe, and Co as the elements to be added can be unevenly distributed in a powder or in the vicinity of a grain boundary with the composition being modulated in a period close to the size of a crystal grain. The anisotropy energy or the anisotropy field of magnetic particles or moldings increases with the increase in the magnetocrystalline anisotropy of the unevenly distributed phase, which increases coercive force.

Example 35

Fe—Co—F based nanoparticles are prepared from an iron fluoride and a cobalt fluoride dissolved in an alcohol solvent. The composition of each fluoride is adjusted to obtain an amorphous structure from a higher-order structure fluoride in solution, thus forming nanoparticles in the solvent. In the above process of forming nanoparticles, a magnetic field of 10 kOe is applied to the solution to form anisotropy in the direction of the applied magnetic field. By heating in a magnetic field an alcohol solution or a colloidal solution in which the compositions of $FeF_{1.7}$ and $CoF_{1.6}$ are mixed, amorphous particles grow at 10 kOe and 250° C., and nanoparticles having an average grain diameter of 1 to 30 nm grow at 300° C. with an easy magnetization direction.

The fluorine composition different from the stoichiometry of $FeF_2$ and $CoF_2$ suppresses the growth of coarse grains of $FeF_2$, $CoF_2$, or (Fe, Co)$F_2$. The growth of coarse grains can be prevented by giving a fluorine concentration difference of 10% or more from the fluorine concentration of the stoichiometry ($FeF_2$ and $CoF_2$). By applying a magnetic field when an amorphous material or a crystalline material grows from a solution, the atomic arrangement of Fe—Co, Fe—F—Fe, Co—F—Fe, or Co—F—Co can be largely arranged in a magnetic field direction, thus providing magnetic anisotropy.

After growing the above nanoparticles having magnetic anisotropy in a magnetic field, an alcohol solution of a fluoride containing a rare earth element is further applied to the surface of the nanoparticles to form a grain boundary phase containing the rare earth element and fluorine. When Sm is selected as a rare earth element, a solution of a higher-order structure or an amorphous material having a composition of $SmF_2$ is applied to a Fe—Co—F-based grain. The surface of the Fe—Co—F grain is coated with a grain or a membrane of Sm—F. The resulting material is heated at 150 to 300° C., thereby removing the solvent and advancing a reaction at the interface of the Fe—Co—F grain and the grain or membrane of Sm—F.

The Sm—F grain or membrane having a structure close to an amorphous material easily reacts with the Fe—Co—F grain. Diffusion advances easily even at low temperatures, and a metastable phase grows. $Sm_x(Fe, Co)_yF_z$ grows from the vicinity of the interface of the Fe—Co—F grain and the grain or membrane of Sm—F, and fluorine atoms are located at octahedral interstitial positions. Thereby, the magnetocrystalline anisotropy energy near the interface increases.

In above $Sm_x(Fe, Co)_yF_z$, the magnetocrystalline anisotropy can be increased by a composition in the range in which X is 0.1 to 3, y is 10 to 30, and F is 0.001 to 10. The center of the nanoparticles is composed of a Fe—Co-based alloy. A Fe—Co—F-based alloy grows at the outside as viewed from the center, and the $Sm_x(Fe, Co)_yF_z$ grows outside these alloys.

Such magnetic particles in which a rare earth element-ferromagnetic metal-fluorine ternary compound is formed on the peripheral side of ferromagnetic metallic particles can reduce the amount of the rare earth element used and shows excellent magnet characteristics because it can achieve a high residual flux density. When average growth phases from the central portion to the peripheral side of the nanoparticles are $Fe_{0.7}Co_{0.3}$, $Fe_{0.7}Co_{0.3}F_{0.01}$, $Sm_2(Fe_{0.7}Co_{0.3})_{17}F_3$, and SmOF, a high residual flux density and high coercive force can be achieved by making the ratio of the ferromagnetic phase at the central portion hardly containing Sm to 20 to 90 volume % and the volume rate of a ferromagnetic rare earth fluoride to 10 to 70%. Magnetic properties of a residual flux density of 1.6 T, a coercive force of 25 kOe, and a curie point of 570° C. are obtained when a $Fe_{0.7}Co_{0.3}$ phase containing 1 atomic % or less of Sm is 20%, $Fe_{0.7}Co_{0.3}F_{0.01}$ containing 5 atomic % or less of Sm is 30%, $Sm_2(Fe_{0.7}Co_{0.3})_{17}F_3$ is 40%, and SmOF or Sm(O, F, C) is 10%.

Note that, the $Fe_{0.7}Co_{0.3}$ phase has a bcc structure; 20%; $Fe_{0.7}Co_{0.3}F_{0.01}$ containing 5 atomic % or less of Sm (30%) is tetragonal or hexagonal; $Sm_2(Fe_{0.7}Co_{0.3})_{17}F_3$ having an average thickness of 1 to 40 nm is hexagonal or tetragonal; and SmOF or Sm(O, F, C) is cubic, rhombohedral, or orthorhombic. A part of these crystals has an interface having orientation relationship. Ferromagnetic coupling works between phases in the vicinity of the interface between the $Fe_{0.7}Co_{0.3}$ phase having an average diameter of 1 to 30 nm and the $Sm_2(Fe_{0.7}Co_{0.3})_{17}F_3$ phase and the interface between the $Fe_{0.7}Co_{0.3}F_{0.01}$ phase and the $Sm_2(Fe_{0.7}Co_{0.3})_{17}F_3$ phase. This suppresses the magnetic reversion of a ferromagnetic phase having a low content of a rare earth element, thereby achieving high coercive force.

The alcohol solvent in the present Example is replaced by a mineral oil having a boiling point of 200° C. or higher to thereby prepare a colloid having a composition of $FeF_{1.7}$ and $CoF_{1.6}$ in the mineral oil. The resulting colloid is then mixed with a colloid having a composition of $SmF_2$. Thereby, it is possible to grow the $Sm_2(Fe_{0.7}Co_{0.3})_{17}F_3$ phase with an average grain diameter of 1 to 100 nm without using a solid ferromagnetic powder. Furthermore, a magnet can be formed by putting a solution having a fluoride composition in a hollow body such as a carbon nanotube to allow crystals to grow, applying a magnetic field to the solution to orientate the crystals, eliminating the tube with other solutions or chemicals, and then densifying the crystals by various molding techniques.

A material which can produce ferromagnetic nanoparticles without using a solid ferromagnetic powder as described in the present Example is represented by the following composition formula.

$$RExMyFz \quad (10)$$

In formula (10), RE is one or more rare earth elements; M is at least one of Fe, Co, and Ni and one or more non-magnetic metal elements other than rare earth elements to be added to these elements; F is a halogen element including fluorine and chlorine or sulfur; $0.01<X<3$; $1<M<30$; and $0.001<z<10$. When X is 0.01 or less, a coercive force of 10 kOe or more is not obtained without using other unevenly distribution process or the like. When X is 3 or more, the concentration of the rare earth element is high, significantly reducing residual flux density. When M is 1 or less, residual flux density will be 0.5 T or less, significantly reducing magnet characteristics, and when M is 30 or more, saturation magnetic flux density will be high, but residual flux density will be low.

Further, when Z is 0.001 or less, the increase in the curie point by the incorporation of fluorine atoms will be small, and the curie point will be 300° C. or lower, increasing heat demagnetization. When Z is 10 or more, magnetization will decrease because the magnetic arrangement of ferromagnetic elements turns into antiferromagnetic arrangement rather than ferromagnetic arrangement. However, magnetic properties can be improved by obtaining ferrimagnetism by adding an element which produces exchange coupling between the antiferromagnetically arranged phase and a ferromagnetic phase or changes magnetic coupling and increasing the degree of order. The value of Z fluctuates according to the positions of local nanoparticles in X, Y, and Z, and the range of fluctuation is 5 to 50%.

In the fluoride (fluorine compound) of formula (10), magnetic structures and crystal structures largely change with the concentration and atomic positions of fluorine. The crystal structures include tetragonal of a $ThMn_{12}$ type structure, hexagonal such as a $CaCu_5$ type and a $Th_2Ni_{17}$ type, orthorhombic, rhombohedral such as a $Th_2Zn_{17}$ type, and monoclinic such as a $R_3T_{29}$ type. In these crystals, the size of the crystal lattice changes with the concentration and the atom positions of fluorine, and the lattice volume is expanded by locating fluorine atoms at interatomic positions.

Further, the influence of high electronegativity reaches the nearest-neighbor atomic positions, the second nearest-neighbor atomic positions, the third, the fourth, and the fifth atomic positions from the fluorine atoms, and the distribution of electron density of states of the atoms located in the vicinity of these fluorine atoms changes. Consequently, depending on the type and structure of the element, there are observed an increase in the magnetic moment, an increase in the exchange coupling between spins, and an increase in the anisotropic energy resulting from the bias of electron distribution. In the present Example, the inclusion of light elements such as hydrogen, nitrogen, oxygen, and carbon inevitably mixed, the mixing of metal elements as impurities, and the uneven distribution of these metal elements on a grain boundary, an interface, or the outermost surface of nanoparticles will not particularly inhibit magnetic properties, if the structure of the fluoride is not largely changed.

The above nanoparticles can be applied to a bonded magnet in which an organic material or an inorganic material is used as a binder material, and can be used as a raw material of a magnet compact prepared by employing various molding techniques such as hot compression molding in which the raw material can be molded at a molding temperature of 500° C. or lower, impact molding, rolling mill forming, and energization molding.

Example 36

Fe—F based nanoparticles are prepared from an iron fluoride dissolved in an alcohol solvent. The composition of the iron fluoride is adjusted, and nanoparticles are formed in the solvent through an amorphous structure from a substantially transparent fluoride instead of a solid powder having a higher-order structure in solution. In the process of forming nanoparticles, a magnetic field of 10 kOe is applied to the solution to form anisotropy in the direction of the applied magnetic field. By heating in a magnetic field the alcohol solution in which a colloid having a composition of $FeF_{23}$ is dissolved, amorphous particles grow at 10 kOe and 150° C., and nanoparticles having an average grain diameter of 1 to 10 nm grow with an easy magnetization direction at 300° C.

The composition of fluorine having a higher concentration than the stoichiometry of $FeF_2$ suppresses the growth of coarse $FeF_2$ grains. The growth of coarse grains and the growth of a ferromagnetic iron showing soft magnetism can be prevented by containing fluorine in a concentration higher by 10% or more than the fluorine concentration of the stoichiometric composition ($FeF_2$). By applying a magnetic field when an amorphous material or a crystalline material grows from a solution, the atomic arrangement of Fe—F—Fe can be largely arranged in a magnetic field direction, thus providing magnetic anisotropy.

The nanoparticles having magnetic anisotropy is grown in a magnetic field, and an ammonium fluoride-containing alcohol solution is added thereto followed by heating to fluorinate the iron-fluorine-based compound having anisotropy. The iron fluoride is further fluorinated in an alcohol solution in which ammonium fluoride is dissolved in an amount of 1 wt %, and iron having a high fluorine concentration represented by FenFm ($n<m$, and N and m are positive numbers) grows. This iron fluoride having a high fluorine concentration is a hexagonal substitution type compound. A magnet having a residual flux density of 0.3 to 1.0 T is obtained by mixing the hexagonal fluoride with an element having a different valence to grow a crystal having lattice constants of a=5.3 to 6.5 angstroms and c=15 to 35 angstroms.

Further, in the present Example, a ferrimagnetic oxy-fluoride of FenFmOl (m, m, and l are positive numbers) is obtained by using an alcohol containing 100 ppm to 10000 ppm of water as a solvent. A fluorine-containing ferrimagnetic material such as $MOFe_2(O, F)_3$, $M(O, F)Fe_2(O, F)_3$, $MFFe(O, F)_3$ or a fluorine-containing compound having a magnetic structure in which spins are spirally arranged grows with a bivalent metal ion M. Some fluorine atoms are located at face-centered cubic lattice points; metal ions are located at a plurality of sites; and fluorine and oxygen atoms are orderly arranged through metal ions and iron. As a result, magnetic moment increases and a residual flux density of 0.6 to 0.9 T can be achieved. Note that all the fluorination agents containing fluorine such as ammonium bifluoride can be used as a fluorination agent other than ammonium fluoride.

Example 37

Fe—Co—F-based nanoparticles are prepared from an amorphous iron fluoride and an amorphous cobalt fluoride dissolved in mineral oil. The composition of each fluoride having an amorphous structure is adjusted, and nanoparticles are formed in mineral oil through generation of microcrystalline nuclei from a fluoride having a short-distance order in mineral oil. In the above process of forming nanoparticles, a magnetic field of 100 kOe is applied to form anisotropy having a structure in which fluorine atoms and Fe or Co atoms are arranged in parallel in the direction of the applied magnetic field, such as Fe—F—Fe or Fe—F—Co, thereby adding magnetic anisotropy. By heating in a magnetic field the mineral oil or colloidal mineral oil in which the compositions of $FeF_{1.5}$ and $CoF_{1.4}$ are mixed, crystal nuclei grow at 100 kOe and 150° C., and nanoparticles having an average grain diameter of 5 to 100 nm grow with an easy magnetization direction at 200° C.

The composition of fluorine different from the stoichiometric composition of $FeF_2$ and $CoF_2$ suppresses the stable growth of coarse grains of $FeF_2$, $CoF_2$, or $(Fe, Co)F_2$. The growth of coarse grains can be prevented by giving a fluorine concentration difference of 20% or more from the fluorine concentration of the stoichiometry ($FeF_2$ and $CoF_2$). By applying a magnetic field when crystal nuclei or crystalline material having a diameter of 0.5 to 2 nm grow from the mineral oil, the atomic arrangement of Fe—Co, Fe—F—Fe, Co—F—Fe, or Co—F—Co can be largely arranged in a magnetic field direction, thus providing magnetic anisotropy. After growing the nanoparticles having magnetic anisotropy in a magnetic field, a mineral oil containing an amorphous fluoride containing a rare earth element is further applied to the surface of the nanoparticles to form a surface phase or a grain boundary phase containing the rare earth element and fluorine.

When La is selected as a rare earth element, a mineral oil containing a higher-order structure or an amorphous material having a composition of LaF2 is applied to a Fe—Co—F-based grain. The surface of the Fe—Co—F grain is coated with a grain or a membrane of La—F. The resulting material is rapidly heated at 250 to 500° C. (at a heating rate of 100° C./s or more) and quenched (at a cooling rate of about 50° C./s), thereby removing a hydrocarbon-based mineral oil while suppressing the grain growth and advancing a reaction at the interface of the Fe—Co—F grain and a grain or membrane of La—F. The amorphous La—F grain or membrane easily reacts with the Fe—Co—F grain. Diffusion advances easily even at low temperatures, and a metastable phase grows. $La_x(Fe, Co)_yF_z$ grows from the vicinity of the interface of the Fe—Co—F grain and the grain or membrane of La—F, and fluorine atoms are located at octahedral interstitial positions or tetrahedral interstitial positions. Thereby, a lattice strain is generated and the magnetocrystalline anisotropy energy near the interface increases.

In above $La_x(Fe, Co)_yF_z$, the magnetocrystalline anisotropy can be increased by the composition in which X is 0.01 to 3, y is 10 to 30, and F is 0.0001 to 5. The center of the nanoparticles is composed of a Fe—Co-based alloy or a Fe—Co—F-based alloy, and the $La_x(Fe, Co)_yF_z$ grows outside these alloys. Such magnetic particles in which a rare earth element-ferromagnetic metal-fluorine ternary compound is formed on the peripheral side of ferromagnetic metallic particles have a ferromagnetic phase containing no rare earth element formed substantially in the central portion. The magnetic particles can reduce the amount of a rare earth element used and can achieve high residual flux density. Therefore, the use amount of a rare earth element, which is expensive and rare, can be reduced by about 50 to 95%. The resulting magnet is inexpensive and shows excellent characteristics.

When average growth phases from the central portion to the peripheral side of the nanoparticles are $Fe_{0.7}Co_{0.3}$, $Fe_{0.7}Co_{0.3}F_{0.01}$, $La_2(Fe_{0.7}Co_{0.3})_{17}F_{0.1\text{-}3}$, and LaOF, a high residual flux density and a high coercive force can be achieved by making the ratio of the ferromagnetic phase at the central portion hardly containing La to 5 to 90 volume % and the volume rate of a ferromagnetic rare earth fluoride to 10 to 80%. Magnetic properties of a residual flux density of 1.6 T, a coercive force of 21 kOe, and a curie point of 560° C. are obtained when a $Fe_{0.7}Co_{0.3}$ phase containing 1 atomic % or less of La is 50%, $Fe_{0.7}Co_{0.3}F_{0.01}$ containing 5 atomic % or less of La is 10%, $La_2(Fe_{0.7}Co_{0.3})_{17}F_{0.1\text{-}3}$ is 35%, and LaOF or La(O, F, C) is 5%.

Grains formed from a solvent such as mineral oil have a higher uniformity of fluorine concentration and concentration distribution than those prepared by using a pulverized powder having a grain diameter of 0.1 to 5 μm. Similar to the pulverized powder, nanoparticles as described in the present Examples are dependent on grain diameter, surface state, reaction temperature, concentration of other light elements (carbon, nitrogen, hydrogen, oxygen) and the like.

Note that, the $Fe_{0.7}Co_{0.3}$ phase has a bcc structure; $Fe_{0.7}Co_{0.3}F_{0.01}$ containing 5 atomic % or less of La is tetragonal or hexagonal; $La_2(Fe_{0.7}Co_{0.3})_{17}F_{0.1\text{-}3}$ having an average thickness of 1 to 40 nm is hexagonal or tetragonal; and LaOF or La(O, F, C) is cubic, rhombohedral, or orthorhombic. A part of these crystals has an interface having orientation relationship. Ferromagnetic coupling works between phases in the vicinity of the interface between the $Fe_{0.7}Co_{0.3}$ phase having an average diameter of 1 to 30 nm and the $La_2(Fe_{0.7}Co_{0.3})_{17}F_{0.1\text{-}3}$ phase and the interface between the $Fe_{0.7}Co_{0.3}F_{0.01}$ phase and the $La_2(Fe_{0.7}Co_{0.3})_{17}F_{0.1\text{-}3}$ phase. This suppresses the magnetic reversion of a ferromagnetic phase having a low content of a rare earth element, thereby achieving high coercive force.

Even when a rare earth element other than La as described above is used, a $Th_2Zn_{17}$ type structure, a $Th_2Ni_{17}$ type structure, or a $CaCu_5$ type grows, and a unit cell volume increases by 0.01 to 7% by the incorporation of fluorine into the interatomic positions. Thereby, it was possible to identify any of the following: an increase in the curie point or magnetocrystalline anisotropy energy, an increase in residual flux density, an increase in a magnetoresistive effect, an increase in a magneto-optical effect, an increase in magnetic specific heat, an increase in superconductivity transition temperature, an increase in a thermoelectric effect, an increase in a magnetostriction constant, an increase in a thermoelectric effect, an increase in a Néel temperature, improvement in fluorescent characteristics, a hydrogen absorption effect, improvement in corrosion resistance, and the like.

It has been identified that, in the above characteristics, a thermoelectric effect, superconductivity transition temperature, fluorescent characteristics, hydrogen absorption characteristics, and corrosion resistance change depending on an external magnetic field. When the following materials were formed, the improvement in the characteristics of various physical property values as described above was identified. Examples of these materials include: $Ce_2Fe_{17}F_1$, $Ce_2Fe_{17}F_2$, $Ce_2Fe_{17}C_1F_1$, $Pr_2Fe_{17}F_2$, $Pr_2Fe_{17}C_2F_2$, $Nd_2Fe_{17}F_2$, $Nd_2Fe_{17}C_1F_1$, $Sm_2Fe_{17}F_{0.001}$, $Sm_2Fe_{17}F_{0.02}$, $Sm_2Fe_{17}F_{0.1}$, $Sm_2Fe_{17}F_{0.2}$, $Sm_2Fe_{17}F_{0.3}$, $Sm_2Fe_{17}F_2$, $Sm_2Fe_{17}F_{2.9}$, $Sm_2Fe_{17}F_{3.2}$, $Sm_2Fe_{17.2}F_{2.9}$, $Sm_2Fe_{17}H_{0.2}F_{0.1}$, $Sm_2Fe_{17}B_{0.1}F_{0.1}$, $Sm_2Fe_{17}C_{0.2}F_{0.2}$, $Sm_2(Fe_{0.95}Mn_{0.05})_{17}F_3$, $Sm_2(Fe_{0.95}Mn_{0.05})_{17}F_{0.5}$, $Sm_2Fe_{17}Ca_{0.05}F_{2.9}$, $Sm_2(Fe_{0.9}Ga_{0.1})_{17}F_{2.9}$, $Sm_2(Fe_{0.99}Ga_{0.01})_{17}F_{0.9}$, $Sm_2(Fe_{0.99}Zr_{0.01})_{17}F_{1.9}$, $Sm_2(Fe_{0.98}Zr_{0.01}Cu_{0.01})_{17}F_{1.9}$, $Sm_2(Fe_{0.99}Ga_{0.01})_{17}F_{0.9}$, $Sm_2Fe_{17}C_{0.3}F_1$, $Sm_2Fe_{17}C_{0.9}F_2$, $Sm_2Fe_{17}C_{2.5}F_3$, $Gd_2Fe_{17}F_2$, $Gd_2Fe_{17}C_2F_{1.3}$, $Tb_2Fe_{17}F_2$, $Tbd_2Fe_{17}C_1F_{1.1}$, $Dy_2Fe_{17}F_2$, $Ho_2Fe_{17}F_{2.9}$, $Er_2Fe_{17}F_2$, $Er_2Fe_{17}C_{0.3}F_1$, $Tm_2Fe_{17}F_{2.9}$, $Tm_2Fe_{17}C_{0.9}F_1$, $Yb_2Fe_{17}F_2$, $Yb_2Fe_{17}C_{0.3}F_1$, $Y_2Fe_{17}F_2$, $Th_2Fe_{17}F_2$, $Sm_2(Fe_{0.7}Co_{0.3})_{17}F_2$, $Sm_2(Fe_{0.1}Co_{0.9})_{17}F_2$, $Sm_2(Fe_{0.7}Co_{0.3})_{17}HF_2$, $Sm_2(Fe_{0.7}Co_{0.3})_{17}C_{0.1}H_{0.2}F_2$, $(Sm_{0.9}Pr_{0.1})_2(Fe_{0.7}Co_{0.3})_{17}F_2$, $(Sm_{0.9}La_{0.1})_2(Fe_{0.7}Co_{0.3})_{17}F_2$, and the like.

Further, when the following materials were grown, it was possible to identify the improvement in the characteristics of various physical properties as described above in fluorine-containing phase of a tetragonal structure. Examples of these materials include: $YFe_{11}TiF_{0.01\text{-}3}$, $YFe_{11}VF_{0.01\text{-}3}$, $YFe_{11}TiN_{0.2}F_{0.01\text{-}2}$, $CeFe_{11}TiF_{0.01\text{-}3}$, $CeFe_{11}VF_{0.01\text{-}3}$, $CeFe_{11}TiN_{0.2}F_{0.01\text{-}2}$, $NdFe_{11}TiF_{0.01\text{-}3}$, $NdFe_{11}VF_{0.01\text{-}3}$, $NdFe_{11}TiN_{0.2}F_{0.01\text{-}2}$, $SmFe_{11}TiF_{0.01\text{-}3}$, $SmFe_{11}VF_{0.01\text{-}3.3}$, $SmFe_{11}TiN_{0.2}F_{0.01\text{-}2.7}$, $SmFe_{11}TiN_{0.01}F_{0.01\text{-}2.7}$, $Sm(Fe_{0.9}Co_{0.1})_{11}TiN_{0.2}F_{0.01\text{-}2.7}$, $Sm(Fe_{0.4}Co_{0.6})_{11}TiN_{0.2}F_{0.01\text{-}2.7}$, $SmFe_{11}MoF_{0.01\text{-}2.7}$, $SmFe_{11}MoH_{0.1}F_{0.01\text{-}2.7}$, $GdFe_{11}TiF_{0.01\text{-}3}$, $GdFe_{11}VF_{0.01\text{-}3}$, $GdFe_{11}TiN_{0.2}F_{0.01\text{-}2}$, $TbFe_{11}TiF_{0.01\text{-}3}$, $TbFe_{11}VF_{0.01\text{-}3}$, $TbFe_{11}TiN_{0.2}F_{0.01\text{-}2}$, $DyFe_{11}TiF_{0.01\text{-}3}$, $DyFe_{11}VF_{0.01\text{-}3}$, $DyFe_{11}TiN_{0.2}F_{0.01\text{-}2}$, $ErFe_{11}TiF_{0.01\text{-}3}$, $ErFe_{11}VF_{0.01\text{-}3}$, $ErFe_{11}TiN_{0.2}F_{0.01\text{-}2}$, $YFe_{10}Si_2F_{0.01\text{-}3}$, $YFe_{10}Si_2C_{0.3}F_{0.01\text{-}3}$, and the like.

In these compounds, various elements (metal elements and light elements) may be contained without destroying the main structure of the above compositions. F may be replaced by any other halogen elements or a mixture of a halogen element and a light element (B, C, N, O, H, S, P).

Further, these fluorine-containing compounds include a composition in which the direction of magnetic anisotropy changes in a temperature range of 4.2 K to 300 K, and a composition in which transition of a crystal structure or a change of spin arrangement is identified. The above fluorine-containing compounds can be partially formed by using a green compact or a sintered compact composed of iron-based or cobalt-based nanoparticles containing no rare earth element and coating a solution containing a rare earth fluoride on the surface thereof followed by heating and diffusion. It is also possible to locally grow a fluorine compound as described above, which is a metastable phase, by ensuring a diffusion length while selectively heating a fluoride using electromagnetic waves such as millimeter waves and microwaves during the heating and diffusion.

A material which can produce ferromagnetic nanoparticles without using a solid ferromagnetic powder as an initial raw material as described in the present Example is represented by the following composition formula.

$$RExMyHz \quad (11)$$

In formula (11), RE is one or more rare earth elements; M is at least one of Fe, Co, or Ni and one or more non-magnetic metal elements other than rare earth elements to be added to these elements; H is one or more of a halogen element including fluorine and a light element; $0.01<X<3$; $1<M<20$; and $0.001<z<10$. When X is 0.01 or less, a coercive force of 10 kOe or more is not obtained without using other unevenly distribution process or the like.

When X is 3 or more, the concentration of a rare earth element is high, significantly reducing residual flux density. When M is 1 or less, residual flux density will be 0.5 T or less, significantly reducing magnet characteristics, and when M is 20 or more, saturation magnetic flux density will be high, but residual flux density will be low. Further, when Z is 0.001 or less, the increase in the curie point by the incorporation of halogen element will be small, and the curie point will be 350° C. or lower, increasing heat demagnetization.

When Z is 10 or more, magnetization will decrease because the magnetic arrangement of ferromagnetic elements turns into antiferromagnetic or ferrimagnetic arrangement rather than ferromagnetic arrangement. However, magnetic properties can be improved by producing exchange coupling between the phase in which the spins are antiferromagnetically or ferrimagnetically arranged and a ferromagnetic phase. The value of Z fluctuates according to the positions of local nanoparticles in X, Y, and Z, and the range of fluctuation is 5 to 50% with respect to the average composition. In the halide of formula (11), magnetic structures and crystal structures largely change with the concentration and atomic positions of a halogen element and the degree of order. The crystal structures include tetragonal of a $ThMn_{12}$ type structure, hexagonal such as a $CaCu_5$ type and a $Th_2Ni_{17}$ type, as well as orthorhombic, rhombohedral such as a $Th_2Zn_{17}$ type, and monoclinic such as a $R_3T_{29}$ type.

In these crystals, the size of the crystal lattice changes with the concentration and the atomic positions of halogen element, and the lattice volume is expanded by locating halogen element atoms at interatomic positions. Further, the influence of high electronegativity reaches the nearest-neighbor atomic positions, the second nearest-neighbor atomic positions, the third to the sixth atomic positions from the halogen element, and the distribution of electron density of states of the atoms located in the vicinity of these halogen element changes. Consequently, depending on the type and structure of the element, there are observed an increase in the magnetic moment, the plus and minus and an increase in the coupling force of the exchange coupling between spins, and an increase in the anisotropic energy resulting from the bias of electron distribution. A plurality of internal magnetic fields depending on the sites of iron are detected by the Mossbauer effect, and the values of the internal magnetic fields and isomer shifts show values different from those of carbides and nitrides.

The above nanoparticles can be applied to a bonded magnet in which an organic material or an inorganic material is used as a binder material, and can be used as a raw material of a magnet compact prepared by employing various molding techniques such as hot compression molding in which the raw material can be molded at a molding temperature of 600° C. or lower, impact molding, rolling mill forming, energization molding, rapid heating molding, hydrostatic molding, pressure molding under strong magnetic field, friction agitation molding, an aerosol deposition method, molding using microwaves and millimeter waves, and the like. Thus, the nanoparticles can be mixed with a conventional powder to prepare composite magnetic particles, the conventional powder including NdFeB-based, SmFeN-based, SmCo-based, and ferrite magnet magnetic particles, a NdFeB-based/Fe-based nanocomposite powder, and a SmFeN-based/Fe-based nanocomposite powder. Further, the nanoparticles can be used for preparing a compact using a laminated film, a multilayer film or a nanocomposite film, a thin film, a slurry, or a thick film.

A pinning type or a nucleation type magnet prepared in the present Example can be applied to all the magnetic circuit products such as a rotating machine such as a generator and a motor, a loudspeaker, a memory core, a magnetic head for hard disks, a voice coil motor, a spindle motor, and medical equipment such MRI.

Example 38

After an alloy composed of Sm and Fe is melted, the alloy is reduced in a hydrogen atmosphere heated at 700° C., and then quenched to fabricate a powder, which is then pulverized to average grain diameter of 1 μm. The pulverized powder is partially nitrided with a mixed gas of hydrogen and ammonia. The powder after the nitriding has an average composition of $Sm_2Fe_{17}N_{0.1}$. The curie point is made 200° C. or higher by the nitriding; and a fluorination reaction is progressed in the following fluorination process under the application of a magnetic field. The nitrided powder is charged in a reactor in a magnetic field, and fluorinated at a temperature of 170° C., a magnetic field of 10 kOe and a fluorine ($F_2$) gas pressure of 0.1 atm, and treated in a diffusion time in which the composition in the vicinity of the powder center becomes $Sm_2Fe_{17}F_2$. The composition in the vicinity of the powder surface is $Sm_2Fe_{17}F_3N_{0.1}$; and on the outermost periphery or outermost surface, SmOF, $SmF_2$, $Sm_aFe_bO_cF_d$ (a, b, c and d are all positive numbers) and the like, which have a crystal structure different from a hexagonal one, grow, and some of fluorides and oxy-fluorides containing nitrogen, carbon and hydrogen contain 0.1 to 30 atomic % of iron, and exhibit antiferromagnetism or ferrimagnetism.

Such an antiferromagnetic or ferrimagnetic phase has partially a magnetic coupling with the hexagonal structure, fixes the magnetization of the hexagonal structure affected by the magnetic coupling in the above-mentioned magnetic field-application direction, and makes the magnetization hardly rotate and maintains the single domain state. In order to align the magnetic coupling, the direction of the powder during the fluorination treatment is made nearly parallel to the direction of the magnetic field. Since the fluorination treatment is progressed at a temperature of 120° C. to 350° C., the curie point before the fluorination is raised and the magnetic field orientation is carried out. Fluorination after the partial nitriding can align the direction of the magnetic coupling with the antiferromagnetic phase growing by the fluorination, and shifts the demagnetization curve and increases the coercive force. In the case where the powder shape is a flat powder, the antiferromagnetic phase and the ferrimagnetic phase are formed along the surface of the powder, and the increase of the coercive force due to magnetic coupling becomes remarkable, and molding can be carried out by pressurizing the magnetic powder charging part for the fluorination reaction in a magnetic field during the reaction.

The curie point and the Neel temperature of the fluoride in the present Example can be measured from the temperature dependency of the magnetization, and the fluoride has a plurality of ferromagnetic resonance frequencies, and a plurality of internal magnetic fields measured by Mossbauer effect.

The following is clear from these evaluation results. (1) Fluorine is present in a plurality of phases of the ferromagnetic phase, antiferromagnetic phase, ferrimagnetic phase or paramagnetic phase. (2) A part of fluorine present in the ferromagnetic phase is disposed at interstitial positions, and strengthens the ferromagnetic coupling of adjacent atoms. (3) The fluorine intrusion raises the curie point of the ferromagnetic phase. (4) The fluorine intrusion increases the magnetocrystalline anisotropy energy of the ferromagnetic phase. (5) The fluorine intrusion increases the unit lattice volume of the ferromagnetic phase. (6) The fluorine incorporation into the antiferromagnetic phase and or the ferrimagnetic phase raises the magnetic transformation point. (7) Fluorine present in the antiferromagnetic phase or the ferrimagnetic phase is disposed at displacement positions or interstitial positions, and some of fluorine atoms form an ordered phase. Some of fluorine atoms and atoms adjacent to the fluorine atoms have an inverse-spinel type structure. (8) The magnetic moment of some of iron atoms exceeds 2.2 μB. (9) Some of fluorine atoms have a magnetic moment. (10) Some of interfaces between the ferromagnetic phase and the antiferromagnetic phase, and the ferromagnetic phase and the ferrimagnetic phase are matching interfaces, and the interfaces exhibit magnetic coupling. (11) The fluoride has both an ionic bonding property and a covalent bonding property. (12) The direction dependency of the magnetocrystalline anisotropy energy varies at a low temperature equal to or lower than room temperature. (13) Some of fluorides exhibit an ionic conductivity and a piezoelectricity. (14) In some of fluorides, the electric resistance varies before and after magnetization. (15) The spin exchange coupling of adjacent atoms interposing fluorine varies.

In order to strengthen the magnetic coupling with the antiferromagnetic phase or the ferrimagnetic phase, the magnetic transformation point of the antiferromagnetism or the ferrimagnetism needs to be raised. Therefor, various types of additives can be used, and making MxFy (M is at least one metal element, F is fluorine, and x and y are positive numbers) grow at the grain boundary and the interface with the main phase is effective. In the present Example, in place of the $F_2$ gas, a fluorine (F)-containing gas such as $CF_4$, $C_2F_6$, $NF_3$, $SF_6$, HF, $SiF_4$, $COF_2$, $ClF_3$ and $IF_3$, and a mixed gas thereof with another gas can be used.

Example 39

A Sm—Fe alloy is melted under vacuum, and after the solution treatment, the alloy is pulverized. After the pulverization, the alloy is heat treated in a mixed gas atmosphere of hydrogen and fluorine to be decomposed to $SmH_2$, $SmF_3$, $FeF_2$, $FeF_3$, and the like; thereafter, hydrogen is removed in vacuum, and the mixture is recrystallized. By adding a metal element such as Ti, Zr and Al to the alloy, anisotropy can be imparted to a Sm—Fe—F based powder after hydrogen release. Oxides in the powder are mixed with a Ca powder, and the mixture is heated and reduced in an Ar gas atmosphere, and then CaO is removed as $Ca(OH)_2$; and the Sm—Fe—F based alloy powder can be manufactured also using a high-purity fluorine or a mixed gas with fluorine, hydrogen and nitrogen. Main phase compounds of a rare earth/iron/fluorine-based alloy powder capable of being fabricated by such means are as follows.

$Ce_2Fe_{17}F_{0.2}$, $Ce_2Fe_{17}F_2$, $Ce_2Fe_{17}C_1F_1$, $Pr_2Fe_{17}F_2$, $Pr_2Fe_{17}C_2F_2$, $Nd_2Fe_{17}F_2$, $Nd_2Fe_{17}C_1F_1$, $Sm_2Fe_{17}F_{0.001}$, $Sm_2Fe_{17}F_{0.02}$, $Sm_2Fe_{17}F_{0.1}$, $Sm_2Fe_{17}F_{0.2}$, $Sm_2Fe_{17}F_{0.3}$, $Sm_2Fe_{17}F_2$, $Sm_2Fe_{17}F_{2.9}$, $Sm_2Fe_{17}F_{3.0}$, $Sm_2Fe_{17}F_{3.5}$, $Sm_2Fe_{17}(H_{0.1}F_{0.9})_{3.0}$, $Sm_2Fe_{17}(C_{0.1}F_{0.9})_{3.0}$, $Sm_2Fe_{17}(B_{0.1}F_{0.9})_{3.0}$, $Sm_2Fe_{17}F_3N_{0.1}$, $Sm_2Fe_{17}(N_{0.1}F_{0.9})_{3.0}$, $Sm_2Fe_{17}(H_{0.05}C_{0.05}F_{0.9})_{3.0}$, $Sm_2Fe_{17}(N_{0.05}C_{0.01}F_{0.94})_{3.0}$, $Sm_2Fe_{17.2}F_{3.0}$, $Sm_2Fe_{16.8}F_{3.0}$, $Sm_{2.1}Fe_{17}F_{3.0}$, $Sm_2Fe_{17}H_{0.2}F_{0.1}$, $Sm_2Fe_{17}B_{0.1}F_{0.1}$, $Sm_2Fe_{17}C_{0.2}F_{0.2}$, $Sm_2Fe_{17}Al_{0.05}F_{2.9}$, $Sm_2(Fe_{0.95}Mn_{0.05})_{17}F_3$, $Sm_2(Fe_{0.95}Mn_{0.05})_{17}F_{0.5}$, $Sm_2Fe_{17}Ca_{0.05}F_{2.9}$, $Sm_2(Fe_{0.9}Ga_{0.1})_{17}F_{2.9}$, $Sm_2(Fe_{0.99}Ga_{0.01})_{17}F_{0.9}$, $Sm_2(Fe_{0.99}Zr_{0.01})_{17}F_{1.9}$, $Sm_2(Fe_{0.99}Nb_{0.01})_{17}F_{2.9}$, $Sm_2(Fe_{0.99}V_{0.01})_{17}F_{3.0}$, $Sm_2(Fe_{0.99}W_{0.01})_{17}F_{3.0}$, $Sm_2(Fe_{0.98}Zr_{0.01}Cu_{0.01})_{17}F_{1.9}$, $Sm_2(Fe_{0.98}Al_{0.01}Al_{0.01})_{17}F_{1.9}$, $Sm_2(Fe_{0.95}Zr_{0.04}Cu_{0.01})_{19}F_{2.9}$, $Sm_2(Fe_{0.7}Co_{0.2}Zr_{0.05}Cu_{0.05})_{19}F_{1.5}$, $Sm_2(Fe_{0.99}Ga_{0.01})_{17}F_{0.9}$, $Sm_2Fe_{17}C_{0.3}F_1$, $Sm_2Fe_{17}C_{0.9}F_2$, $Sm_2Fe_{17}C_{2.5}F_3$, $(Sm_{0.9}Pr_{0.1})_2Fe_{17}F_{3.0}$, $(Sm_{0.9}La_{0.1})_2Fe_{17}F_{3.0}$, $(Sm_{0.9}Nd_{0.1})_2Fe_{17}F_{3.0}$, $(Sm_{0.9}Ce_{0.1})_2Fe_{17}F_{3.0}$, $Gd_2Fe_{17}F_2$, $Gd_2Fe_{17}C_2F_{1.3}$, $Tb_2Fe_{17}F_2$, $Tb_2Fe_{17}C_1F_{1.1}$, $Dy_2Fe_{17}F_2$, $Ho_2Fe_{17}F_{2.9}$, $Er_2Fe_{17}F_2$, $Er_2Fe_{17}C_{0.3}F_1$, $Tm_2Fe_{17}F_{2.9}$, $Tm_2Fe_{17}C_{0.9}F_1$, $Yb_2Fe_{17}F_2$, $Yb_2Fe_{17}C_{0.3}F_1$, $Y_2Fe_{17}F_2$, $Y_2Fe_{17}F_3$, $Y_2(Fe_{0.9}Cr_{0.1})_{17}F_2$, $Th_2Fe_{17}F_2$, $Sm_2(Fe_{0.7}Co_{0.3})_{17}F_2$, $Sm_2(Fe_{0.65}Co_{0.3}Mn_{0.05})_{17}F_3$, $Sm_2(Fe_{0.1}Co_{0.9})_{17}F_2$, $Sm_2(Fe_{0.7}Co_{0.3})_{17}HF_2$, $Sm_2(Fe_{0.7}Co_{0.3})_{17}C_{0.1}H_{0.2}F_2$, $(Sm_{0.9}Pr_{0.1})_2(Fe_{0.7}Co_{0.3})_{17}F_2$, $(Sm_{0.9}La_{0.1})_2(Fe_{0.7}Co_{0.3})_{17}F_2$, $YFe_{11}TiF_{0.01\text{-}3}$, $YFe_{11}VF_{0.01\text{-}3}$, $YFe_{11}TiN_{0.2}F_{0.01\text{-}2}$, $CeFe_{11}TiF_{0.01\text{-}3}$, $CeFe_{11}VF_{0.01\text{-}3}$, $CeFe_{11}TiN_{0.2}F_{0.01\text{-}2}$, $NdFe_{11}TiF_{0.01\text{-}3}$, $NdFe_{11}VF_{0.01-3}$, $NdFe_{11}TiN_{0.2}F_{0.01-2}$, $SmFe_{11}TiF_{0.01-3}$, $SmFe_{13}TiF_{0.01-3}$, $SmFe_{15}TiF_{0.01-3}$, $SmFe_{11}VF_{0.01-3.3}$, $SmFe_{13}VF_{0.01-3}$, $SmFe_{11}TiN_{0.2}F_{0.01-2.7}$, $SmFe_{11}TiN_{0.01}F_{0.01-2.7}$, $Sm(Fe_{0.9}Co_{0.1})_{11}TiN_{0.2}F_{0.01-2.7}$. $Sm(Fe_{0.4}Co_{0.6})_{11}TiN_{0.2}F_{0.01-2.7}$, $Sm(Fe_{0.4}Co_{0.6})_{13}TiN_{0.2}F_{0.01-2.7}$, $Sm(Fe_{0.4}Co_{0.6})_{15}TiF_{0.01-2.7}$, $Sm_3(Fe_{0.4}Co_{0.6})_{29}TiF_{0.1-3}$, $Sm_2(Fe_{0.4}Co_{0.6})_{29}TiF_{0.1-4}$, $Sm_1(Fe_{0.4}Co_{0.6})_{29}TiF_{0.1-4}$, $Sm_2(Fe_{0.4}Co_{0.6})_{29}ZrF_{0.1-4}$, $Sm_2(Fe_{0.4}Co_{0.6})_{29}AlF_{0.1-4}$, $Sm_2(Fe_{0.4}Co_{0.6})_{29}CaF_{0.1-4}$, $Sm_2(Fe_{0.4}Co_{0.6})_{29}BiF_{0.1-4}$, $Sm_2(Fe_{0.4}Co_{0.6})_{29}LiF_{0.1-4}$, $Sm_2(Fe_{0.4}Co_{0.6})_{29}AsF_{0.1-4}$, $SmFe_{11}MoF_{0.01-2.7}$, $SmFe_{11}MoH_{0.1}F_{0.01-2.7}$, $GdFe_{11}TiF_{0.01-3}$, $GdFe_{11}VF_{0.01-3}$, $GdFe_{11}TiN_{0.2}F_{0.01-2}$, $TbFe_{11}TiF_{0.01-3}$, $TbFe_{11}VF_{0.01-3}$, $TbFe_{11}TiN_{0.2}F_{0.01-2}$, $DyFe_{11}TiF_{0.01-3}$, $DyFe_{11}VF_{0.01-3}$, $DyFe_{11}TiN_{0.2}F_{0.01-2}$, $ErFe_{11}TiF_{0.01-3}$, $ErFe_{11}VF_{0.01-3}$, $ErFe_{11}TiN_{0.2}F_{0.01-2}$, $YFe_{10}Si_2F_{0.01-3}$ and $YFe_{10}Si_2C_{0.3}F_{0.01-3}$ With respect to the magnetic powders described above, some of fluorine atoms are incorporated at interatomic positions, and the unit lattice volume is increased by 0.01 to 10%, and due to an uneven distribution of the electronic density of states of atoms adjacent to the fluorine atoms, one of the following could be confirmed in comparison with the cases before fluorine is incorporated: a rise in the curie point, an increase in the magnetocrystalline anisotropy energy, an increase in the residual flux density, an increase in the magneto-resistance effect, an increase in the magneto-optical effect, an increase in the magnetic specific heat, a rise in the superconductive transition temperature, an increase in the thermoelectric effect, an increase in the magnetostriction constant, an increase in the thermoelectric effect, a rise in Neel temperature, and the like. The compounds described above may contain various elements (metal elements and light elements) without damaging the main structure of the above-mentioned compositions, and the element may be a halogen element, and a mixture of a halogen element and a light element (B, C, N, O, H, P and S) in place of F.

In the magnetic powder other than the above-mentioned main phase, compounds having a higher fluorine concentration than the main phase and having a lower magnetization than the main phase grow on a part of the outermost surface or grain boundary. In the above-mentioned compositions of the main phase compounds, compounds having different fluorine concentrations can be fabricated in the range as mentioned above, and the unit cell volume is likely to increase along with the increase in the fluorine concentration although depending on the crystal structure and the arrangement of constituting elements. An anisotropic bond magnet fabricated by using a powder containing the above-mentioned fluoride and cohering the powder with an organic compound or an inorganic compound has an energy product of 20 to 40 MGOe, and can be applied to various types of magnetic circuit products. The above-mentioned fluorine-containing compound can be formed as a metastable phase in which fluorine has intruded by using a green compact obtained by compression molding iron-based grains containing no rare earth element, or a sintered compact obtained by heating and sintering the grains, applying a solution containing a rare earth fluoride on the surface of the compact, and thereafter heat diffusing the solution at 200 to 500° C. and quenching the compact. In the heat diffusion, by securing a diffusion distance while the fluoride is selectively heated using an electromagnetic wave such as a millimeter wave or a microwave, a fluoride which is a high corrosion-resistive metastable phase as described above can be grown locally.

Example 40

A $(Fe_{0.7}Co_{0.3}Zr_{0.05}Cu_{0.05})_{10}F_{0.1}$ powder is fabricated by the following means to make a raw material of a magnetic material. Fe, Co, Cu and Zr pieces are weighed, charged in a vacuum melting furnace to fabricate $Fe_{0.7}Co_{0.3}Zr_{0.05}Cu_{0.05}$. The $Fe_{0.7}Co_{0.3}Zr_{0.1}$ is blown out as a melted alloy on a rotating roll in a mixed gas atmosphere of $F_2$ and Ar to quench the alloy. The quenched powder has an average crystal grain diameter of 1 to 50 nm. The quenched powder is coated with about 0.1% by weight of a solution of an amorphous structure containing $SmF_2$ as its composition, and heated and pulverized. In order to suppress the increase in the grain diameter, the heating uses a rapid heating condition, and the heating is carried out to 400° C. in 3 min. By carrying out the hating at a heating rate of 20° C./min or higher, the abnormal crystal growth can be suppressed. By preventing the abnormal crystal growth in which the crystal grain diameter exceeds 500 nm, the grain diameter after the pulverization can be made small and uneven distribution states of Sm and fluorine can be made to be nearly equal, thereby achieving a high coercive force of 100 kOe or more. The average texture after the rapid heating and pulverization has a core/shell structure as follows.

The powder center has $Fe_{0.7}Co_{0.3}Zr_{0.05}Cu_{0.05}$; in the peripheral side, $Sm(Fe_{0.7}Co_{0.3}Zr_{0.05}Cu_{0.05})_{10}F_{0.5}$ grows; and on the outermost periphery, $SmF_3$ and Sm(OF) grow. The region having a small amount of fluorine is the powder center; in the peripheral side, $Sm(Fe_{0.7}Co_{0.3}Zr_{0.05}Cu_{0.05})_{10}F_{0.1}$ grows; and on the outermost periphery, fluorides and oxyfluorides having a low concentration of Fe, such as Sm(OF), grow. That is, the powder is constituted of three kinds of phases if roughly classified, and these are an iron/cobalt-rich phase, a rare earth/iron/cobalt fluoride phase, and a rare earth fluoride phase. Typical textures constituted of these three kinds of phases are shown in FIG. 3.

Figure 3:
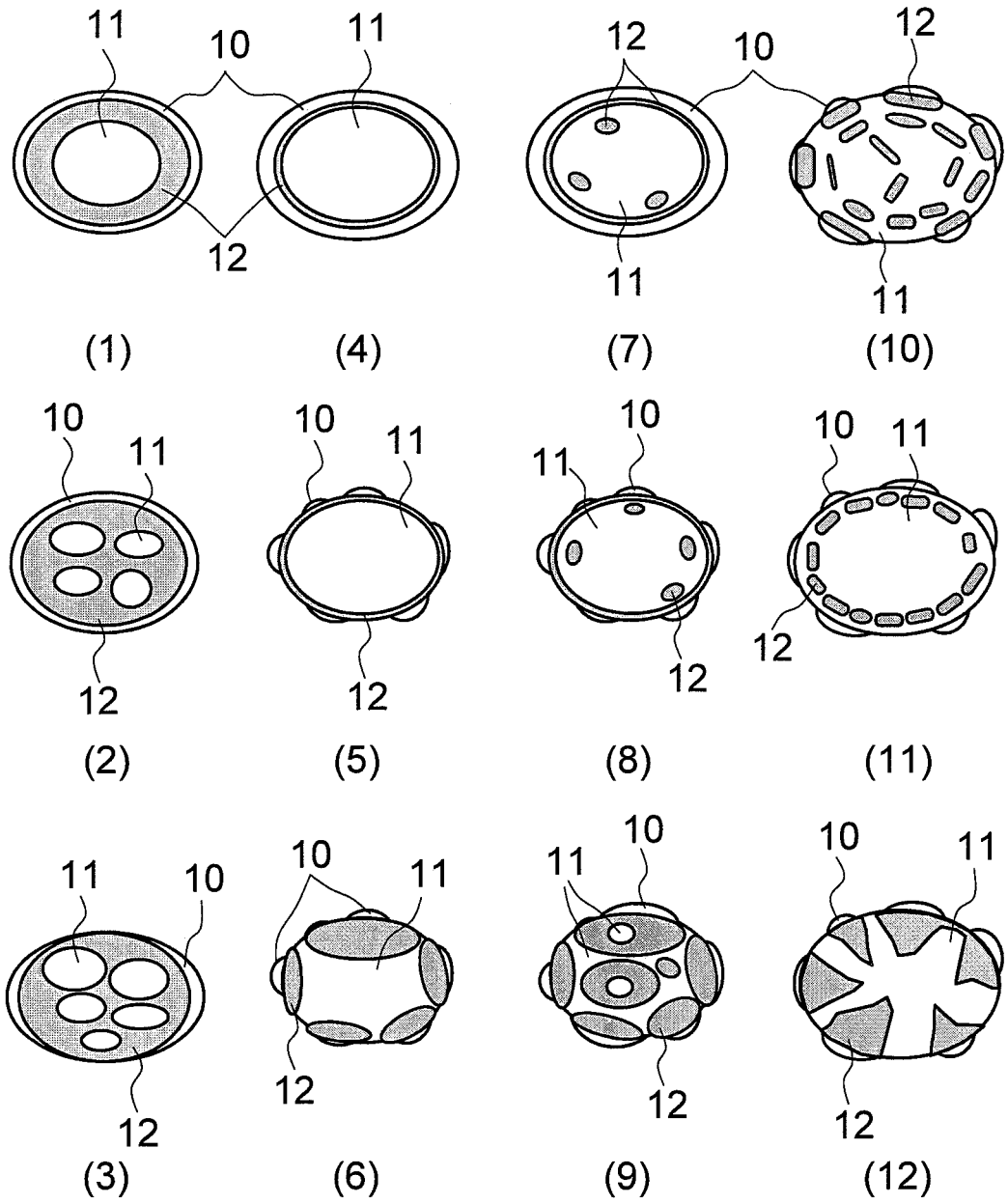
FIG. 3 is a diagram showing typical textures constituted of three types of phases of an iron/cobalt rich phase, a rare earth/iron/cobalt fluoride phase and a rare earth fluoride phase.

In (1) to (12) in FIG. 3, the textures are constituted of three phases of a rare earth fluoride phase 10, a rare earth/iron/cobalt fluoride phase 12, and an iron/cobalt-rich phase 11; and the rare earth fluoride phase 10 grows in the peripheral side, and the rare earth/iron/cobalt fluoride phase 12 and the iron/cobalt-rich phase 11 are formed on the inner peripheral side thereof. The distribution of the rare earth/iron/cobalt fluoride phase 12 and the iron/cobalt-rich phase 11 depends largely on the material composition, the heat treatment, the cooling rate, the aging and the like.

As the reaction progresses, the rare earth fluoride phase 10 as the outermost peripheral phase becomes thin due to the diffusion of fluorine to the rare earth/iron/cobalt fluoride phase 12, and the covering state becomes discontinuous in some cases as seen in (3), (5), (6), (8), (9), (10), (11) and (12). A strong magnetic coupling is generated between the rare earth/iron/cobalt fluoride phase 12 and the iron/cobalt-rich phase 11. In the interface between the rare earth fluoride phase 10 of the peripheral side, and the rare earth/iron/cobalt fluoride phase 12 or the iron/cobalt-rich phase 11, the exchange coupling of ferromagnetism/ferromagnetism or ferromagnetism/antiferromagnetism, or the super exchange interaction due to the ionic coupling is generated in some cases.

In (1), (2), (3), (4), (5), (7) and (8) in which the iron/cobalt-rich phase 11 is completely covered with the rare earth/iron/cobalt fluoride phase 12, the magnetization of the iron/cobalt-rich phase 11 is hardly reversed by the effect of a high magnetocrystalline anisotropy of the rare earth/iron/cobalt fluoride phase 12, and the coercive force is increased. In the case of (10) and (11), the magnetization of the iron/cobalt-rich phase 11 is easily restricted by the rare earth fluoride phase 10, and is hardly reversed.

Although the crystal structure of each phase having grown in the powder is different depending on the commingling of inevitable impurities, the temperature history of the above-mentioned heat treatment, and the pulverization condition, typical examples thereof are: the rare earth fluoride phase 10 is a fluoride or an oxy-fluoride containing oxygen having a cubic, orthorhombic or hexagonal structure, or a noncrystalline; the rare earth/iron/cobalt fluoride phase 12 has a hexagonal, tetragonal, orthorhombic, rhombohedral or monoclinic structure, and a mixed phase thereof; and the iron/cobalt-rich phase 11 is a cubic or hexagonal structure; and some of these any crystals grow as an ordered phase.

Since the ferromagnetic phase of the average powder central portion contains no Sm, which is averagely unevenly distributed on the peripheral side of the ferromagnetic phase, the concentration of Sm can be decreased and the residual flux density can be increased. Additionally, the above-mentioned material has a curie point of 550° C., which is higher than that of NdFeB-based magnets. A material exhibiting a residual flux density of 1.7 T or more and having a curie point of 400° C. or higher can be achieved by the above-mentioned textures shown in FIG. 3, and these conditions can be satisfied also by using a material other than the above-mentioned SmFeCoZrCuF, and the material can be described by the following general composition formula.

$$A(Fe_xCo_yM_z)+B(R_hFe_iCo_jM_kF_l)+C(R_oFe_pCo_qM_rF_s) \quad (12)$$

In the formula (12), Fe is iron; Co is cobalt; M is one or more metal elements excluding Fe and Co; R is a rare earth element; F is one or more light elements including fluorine or halogen elements, such as fluorine, fluorine and hydrogen, fluorine and nitrogen, fluorine and carbon, fluorine and oxygen, fluorine and boron, fluorine and chlorine, fluorine and phosphorus, and fluorine and sulfur; and x, y, z, h, i, j, k, l, o, p, q, r, and s are positive numbers. The first term is a ferromagnetic phase in the vicinity of the magnetic powder or crystal grain center; the second term is a fluorine-containing ferromagnetic phase in contact at an interface with a peripheral side of the ferromagnetic phase of the first term; and the third term is a fluoride phase growing in the outermost periphery or the grain boundary.

In order to make the residual flux density 1.7 T or more, since the saturation magnetic flux density needs to be raised, $x>y>z$, $i>j>k>1$ and $s>p>q>r$ ($x+y+z=1$, $h+i+j+k+l=1$, $o+p+q+r+s=1$). Since fluorine has a maximum concentration on the outermost periphery of the powder or crystal grain, $s>l>0$ and $h+i+j+k>o+p+q+r$. If the volume fraction of the each phase is denoted as A, B and C, and $A+B+C=1$ (100%), $A>C>0$ and $B>C>0$, Some of crystals of the ferromagnetic phases of the first term and second term have the similar crystal structure; a part of the interface between the phases forms an interface exhibiting lattice matching or having a crystal orientation relation; lattice distortion is present in a part of the interface; and such a magnetic coupling that the magnetizations between the ferromagnetic phases are parallel with each other is caused. The crystal orientation relation is that a plane of (hid) of the phase of the first term and a plane (ijk) of the ferromagnetic phase of the second term are parallel where h, k, l, i, j and k are ±n (n is a natural number including 0).

The magnetocrystalline anisotropy energy of the phase of the second term is larger than the magnetocrystalline anisotropy energy of the phase of the first term. Some of fluorine atoms of the second term intrude into interstitial positions, and increase the lattice volume. The crystal structure of the phase containing fluorine of the third term is different from the crystal structure of the fluorine-containing ferromagnetic phase of the second term; the interface exhibiting matching between the phases of the second term and third term has a smaller area than the matching interface between the first term and second term; the magnetizations of the ferromagnetic phases of the first term and second term are larger than the magnetization of the fluorine-containing phase of the third term.

In the case of $A>B>C>0$, the residual flux density is high, and by making $C<0.1$ (10%), desirably $C<0.001$ (0.1%), a residual flux density of 1.7 T or more can be achieved. In the phase of the second term or third term, a metastable phase is formed, and the structure or texture varies along with heating; the crystal structure of the ferromagnetic phase of the first term is a body-centered cubic or tetragonal phase, or a mixed phase thereof; the crystal structure of the ferromagnetic phase of the second term is a hexagonal, tetragonal, orthorhombic, rhombohedral or monoclinic phase, or a mixed phase thereof; and the phase containing fluorine in a high concentration on the outermost periphery or crystal grain boundary of the third term has various types of crystal structures containing noncrystallines depending on the oxygen or hydrogen concentration, and partially contains oxy-fluorides, and the crystal structure of the oxy-fluorides has a rhombohedral, cubic or the third term or face-centered cubic structure.

The magnetic powder represented by the general formula (12) shown above is mixed with a solvent capable of preventing oxidation, molded in a magnetic field in an inert gas, and thereafter pressurized in a plasma to fabricate an anisotropic magnet of 98% in density; on the grain boundary, a fluorine-containing phase can be formed, in the vicinity of the grain boundary along the grain boundary, a fluorine-containing ferromagnetic phase or an antiferromagnetic phase can be formed, and further in the central portion thereof, a ferromagnetic phase containing no fluorine can be formed; as a result of carrying out rapid heating at a rate of 100° C./min or more in the heating and pressurizing, and rapid cooling of 150° C./min or more in the temperature region of 300° C. or higher, oxygen-containing fluorides on the grain boundary takes a cubic structure, and a magnet having a residual flux density of 1.8 T, a coercive force of 25 kOe and a curie point of 570° C. could be achieved by making the Sm concentration as the whole magnet to be 1 to 2 atomic %, and any of the textures shown in (1) to (12) in FIG. 3 was confirmed inside molded bodies by the crystal grain.

Such a magnet has a lower rare earth element concentration than that of conventional Nd—Fe—B based, Sm—Fe—N based and Sm—Co based magnets and the like, and exhibits a higher residual flux density than these conventional materials; and by applying such a magnet to every magnetic circuit, both of the size-reduction, high-performance and weight-reduction, and the performance improvement of magnet application products can simultaneously be satisfied.

Example 41

A Ta film is formed on an alumina substrate of a temperature of 400° C. by using a sputtering apparatus, and a $Sm_2Fe_{17}F_2$ film is formed with the Ta film as an underlayer. The formation of the Ta film used a Ta target; and a $Sm_2Fe_{17}$ target was sputtered in a mixed gas of Ar and $F_2$. The mixed gas used is an Ar-10% $F_2$ gas, and the gas pressure during the sputtering is 1 mTorr. The $Sm_2Fe_{17}F_2$ film has a hexagonal crystal structure, and the orientation direction, the lattice distortion and the lattice constant vary depending on the substrate temperature, the gas pressure during sputtering, the fluorine concentration in the film, the crystallinity and crystal structure of the underlayer film, and the like. The crystal structure is a $TbCu_7$ structure; the lattice constant is a=0.47 to 0.52 nm, and c=0.40 to 0.45 nm, and c/a is smaller than 1. The easy magnetization direction of the $Sm_2Fe_{17}F_2$ film is the axis a or axis c direction; and with the $Sm_2Fe_{17}F_2$ film of 0.1 to 100 μm in thickness, the coercive force was 15 kOe, and the residual flux density was 1.5 T.

The orientation direction varies, and the above-mentioned lattice constant and axis ratio also vary depending on the substrate, the type of underlayer and the sputtering condition. These lattice constant, axis ratio and fluorine concentration are determination factors of the magnetic characteristics, and in a $Sm_{1.7\text{-}2.2}Fe_{15\text{-}21}F_{0.1\text{-}3}$ film, the case where c/a is 0.8 to 0.95 has a high coercive force. In a multilayer film obtained by laminating the $Sm_2Fe_{17}F_2$ film and an FeCo-based alloy film, a thin-film or a thick-film magnet having a strong interlayer magnetic coupling can be obtained; in a $Sm_2Fe_{17}F_2$ film/$Fe_{70}Co_{30}$ film (whose thicknesses are 50 nm/10 nm, respectively), a coercive force of 15 kOe and a residual flux density of 1.6 T can be achieved; although the direction of anisotropy varies depending on the film thickness and the film formation condition, by making a multilayer with such a ferromagnetic film, the use amount of rare earth elements can be reduced. By laminating the $Sm_2Fe_{17}F_2$ film and an FeCoF-based alloy film, the saturation magnetic flux density of the FeCo alloy can be increased; and in a film obtained by laminating 10 to 1,000 layers of a $Sm_2Fe_{17}F_2$ film/$Fe_{65}Co_{30}F_5$ film (whose average thicknesses are 30 nm/10 nm, respectively), a coercive force of 16 kOe and a residual flux density of 1.7 T could be achieved.

Such a magnetic material capable of securing a residual flux density of 1.6 T and a coercive force of 15 kOe can be achieved by laminating a film of a rare earth/iron/fluorine type of 0.01 to 15 atomic % in fluorine concentration and an iron-based alloy film having a saturation magnetic flux density of 1.7 T or more to interlayerly generate a ferromagnetic coupling. With the fluorine concentration of less than 0.01 atomic %, a practical material cannot be made because the curie point is as low as 150 to 300° C. With the fluorine concentration exceeding 15 atomic %, fluorides and oxy-fluorides having a low magnetization are liable to grow to make the control of the composition difficult, and the magnetization of the film as a whole is decreased.

By making these laminated films contain one or more metal elements, halogen elements other than fluorine, or semimetal elements, the coercive force can be increased 1.1 to 2 folds. Some of halogen elements including fluorine are disposed at either one site of displacement positions and interstitial positions of the unit lattice, and vary the lattice distortion and the adjacent atom positions; and since the elements have an ionic bonding property, an increase in the magnetic moment, an increase in the magnetocrystalline anisotropy, and an increase in the interlayer magnetic coupling force are brought about. As a substrate material for forming the fluorine-containing magnetic film according to the present invention, usable are various types of polycrystalline or single crystalline oxides, nitrides, carbides, borides, or fluoride, and various types of semiconductors (Si, GaAs and the like); and as an underlayer, usable are various types of metal film including noble metals such as Nb, Zr and Ti, and even if inevitable light element impurities such as oxygen, hydrogen and nitrogen, and inevitable metal impurities such as Mn are contained, if these impurities are ones which do not change largely the crystal structure and the lamination structure, especially the magnetic characteristics are not largely affected even if these impurities are locally unevenly distributed.

What is claimed is:

1. A magnetic material comprising a main phase comprising fluorine and a magnetic powder, the magnetic powder comprising at least one crystal grain having a uniform crystal structure and an angular difference in crystal orientation of 45° or less in average in the crystal structure, wherein the magnetic material is obtained by a fluorination reaction of the magnetic powder at a temperature from 50° to less than 500° C. in an atmosphere of a fluorine-containing gas generated by decomposing a member selected from the group consisting of ammonium fluoride, xenon fluoride, ammonium hydrogen fluoride, ammonium acid fluoride, salts composed of an amine and hydrogen fluoride, and krypton fluoride, wherein the magnetic powder comprises at least two compositions of fluoride; fluorine atoms are disposed at interstitial positions of iron or at interstitial positions of a transition metal element excluding iron and a rare earth element; and the composition formula is represented by:

$$RE_x(Fe_sM_T)_YF_Z+RE_U(Fe_SM_T)_VF_W$$

wherein RE denotes a rare earth element, M denotes a transition metal element excluding iron and a rare earth element, F denotes fluorine, X, Y, Z, S, T, U, V and W are positive numbers, $(Fe_sM_T)_YF_Z$ represents a composition of a central portion of the magnetic powder, $(Fe_SM_T)F_W$ represents a composition of a surface of the magnetic powder, X<Y, Z<Y, S>T, U<V, W<V and Z<W, and wherein the compositions of fluoride satisfy X<Y/10, Z<3, Z<Y/4, T<0.4 and S>T; and a volume proportion of a phase other than the main phase comprising fluorides and oxy-fluorides exhibiting no ferromagnetism and having a body-centered tetragonal or hexagonal structure is 0.01 to 10% with respect to the main phase.

2. The magnetic material according to claim 1, wherein fluorine atoms are disposed at interstitial positions of a crystal lattice of the magnetic powder; and the magnetic powder has a higher fluorine concentration in a surface of the magnetic powder than in a central portion of the magnetic powder or has a larger crystal lattice in the surface than in the central portion.

3. The magnetic material according to claim 1, wherein the magnetic material comprises the main phase further comprising a transition metal element.

4. The magnetic material according to claim 3, wherein the transition metal element is at least one selected from the group consisting of Ti, V, Cr, Mn, Fe, Co, Ni, Cu, Zr, Nb and Mo.

5. The magnetic material according to claim 1, wherein the magnetic powder comprises at least two compositions of fluoride;

fluorine atoms are disposed at interstitial positions of iron or at interstitial positions of a transition metal element excluding iron and a rare earth element; and the composition formula is represented by:

$$(Fe_SM_T)_YF_Z+(Fe_UM_V)_WF_X$$

wherein M denotes a transition metal element excluding iron and a rare earth element, F denotes fluorine, $(Fe_SM_T)_YF_Z$ represents a composition of a central portion of the magnetic powder, $(Fe_UM_V)_WF_X$ represents a composition a surface of the magnetic powder, Z<Y, X<W and Z<X.

6. The magnetic material according to claim 5, wherein the compositions of fluoride satisfy S>T and U>V.

7. The magnetic material according to claim 1, wherein the main phase further comprises $Re_1Fe_mN_n$, wherein Re is a rare earth element, and l, m and n are positive integers; $Re_1Fe_mC_n$, wherein Re is a rare earth element, and l, m and n are positive integers; $Re_1Fe_mB_n$, wherein Re is a rare earth element, and l, m and n are positive integers; $Re_1Fe_m$, wherein Re is a rare earth element, and l and m are positive integers; or $M_lFe_m$, wherein M is at least one transition element excluding Fe, Fe is iron, and l and m are positive integers.

8. The magnetic material according to claim 7, wherein an oxy-fluoride comprising a rare earth element is present in a surface of the crystal grain or the powder of the main phase.

9. A motor, using the magnetic material according to claim 1.

* * * * *